US007386250B2

(12) United States Patent
Ban et al.

(10) Patent No.: US 7,386,250 B2
(45) **Date of Patent: *Jun. 10, 2008**

(54) TONER SUPPLY CONTAINER AND ELECTROPHOTOGRAPHIC IMAGE FORMING APPARATUS

(75) Inventors: Yutaka Ban, Tokyo (JP); Kazuhiko Omata, Shizuoka-ken (JP); Kyota Miyazaki, Kawasaki (JP); Ayumu Murakami, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

This patent is subject to a terminal disclaimer.

(21) Appl. No.: 11/271,788

(22) Filed: Nov. 14, 2005

(65) Prior Publication Data

US 2007/0258735 A1 Nov. 8, 2007

Related U.S. Application Data

(60) Division of application No. 10/798,411, filed on Mar. 12, 2004, now Pat. No. 6,978,101, which is a division of application No. 10/397,209, filed on Mar. 27, 2003, now Pat. No. 6,968,139, which is a continuation-in-part of application No. 10/359,262, filed on Feb. 6, 2003, now Pat. No. 6,792,228, which is a division of application No. 09/905,104, filed on Jul. 16, 2001, now Pat. No. 6,594,458, which is a division of application No. 09/099,032, filed on Jun. 18, 1998, now Pat. No. 6,266,505.

(30) Foreign Application Priority Data

Jun. 19, 1997 (JP) ..... 1997-163078
Jun. 16, 1998 (JP) ..... 1998-168369

(51) Int. Cl.
*G03G 15/08* (2006.01)

(52) U.S. Cl. ..... 399/106; 399/258; 399/263

(58) Field of Classification Search ..... 399/103, 399/105, 106, 258, 260, 262, 263; 222/DIG. 1
See application file for complete search history.

(56) References Cited

U.S. PATENT DOCUMENTS 3,883,240 A 5/1975 Ito et al. ..... 399/116

(Continued)

FOREIGN PATENT DOCUMENTS

EP 0 670 530 A2 9/1995

(Continued)

OTHER PUBLICATIONS

US 5,057,872, 10/1991, Saijo et al. (withdrawn)

*Primary Examiner*—Robert Beatty
(74) *Attorney, Agent, or Firm*—Fitzpatrick, Cella, Harper & Scinto

(57) ABSTRACT

A toner supply container is detachably mountable to an image forming apparatus. The container includes a toner accommodating portion to accommodate toner and has a supply opening to supply toner into the image forming apparatus, a feeding member to feed the toner in the toner accommodating portion toward the supply opening, and a sealing member to seal the supply opening. The sealing member has a locking portion to be locked by a locking member provided in a main assembly of the apparatus, and a coupling portion to be coupled with a drive coupling member provided in the main assembly. The sealing member is rotatable integrally with the feeding member by a rotational force received by the coupling portion from the drive coupling member. The locking portion and the coupling portion are spaced apart from each other with respect to a mounting direction of the container.

1 Claim, 37 Drawing Sheets

U.S. PATENT DOCUMENTS

| | | | | |
|---|---|---|---|---|
| 4,212,264 | A | 7/1980 | Knechtel et al. | 118/653 |
| 4,422,750 | A | 12/1983 | Kawata | 118/612 |
| 4,611,730 | A | 9/1986 | Ikesue et al. | 222/167 |
| 4,622,916 | A | 11/1986 | Tanaka et al. | 118/688 |
| 4,641,945 | A | 2/1987 | Ikesue et al. | 399/262 |
| 4,744,493 | A | 5/1988 | Ikesue et al. | 222/167 |
| 4,878,603 | A | 11/1989 | Ikesue et al. | 222/167 |
| 4,937,625 | A | 6/1990 | Kato et al. | 399/258 |
| 4,943,830 | A | 7/1990 | Sulenski | 399/263 |
| 5,128,724 | A | 7/1992 | Hayashi et al. | 399/119 |
| 5,202,732 | A | 4/1993 | Yahata | 355/251 |
| 5,264,901 | A | 11/1993 | Rossiter | 355/260 |
| 5,296,900 | A | 3/1994 | Saijo et al. | 355/260 |
| 5,298,952 | A | 3/1994 | Kamijo et al. | 355/270 |
| 5,307,129 | A | 4/1994 | Miura et al. | 335/260 |
| 5,331,381 | A | 7/1994 | Ota et al. | 399/258 |
| 5,331,382 | A | 7/1994 | Miura et al. | 355/260 |
| 5,398,849 | A | 3/1995 | Smith et al. | 222/235 |
| 5,424,816 | A | 6/1995 | Fox et al. | 355/260 |
| 5,500,719 | A | 3/1996 | Ichikawa et al. | 555/260 |
| 5,548,384 | A | 8/1996 | Weed | 355/260 |
| 5,557,382 | A | 9/1996 | Tatsumi et al. | 399/262 |
| 5,579,101 | A | 11/1996 | Omata et al. | |
| 5,614,996 | A | 3/1997 | Tanda | 399/120 |
| 5,619,312 | A | 4/1997 | Hatano et al. | 399/61 |
| 5,627,631 | A | 5/1997 | Ichikawa et al. | 222/DIG. 1 |
| 5,629,759 | A | 5/1997 | Jyoroku | 399/262 |
| 5,669,044 | A | 9/1997 | Cuthbert | 399/120 |
| 5,784,669 | A | 7/1998 | Miura et al. | |
| 5,794,108 | A | 8/1998 | Yoshizawa et al. | 399/262 |
| 5,822,663 | A | 10/1998 | Ichikawa et al. | 399/262 |
| 5,828,935 | A | 10/1998 | Tatsumi et al. | 399/260 |
| 5,842,093 | A | 11/1998 | Tanda | 399/263 |
| 5,848,342 | A | 12/1998 | Tanda | 399/120 |
| 5,862,441 | A | 1/1999 | Ohata | 399/119 |
| 5,974,286 | A | 10/1999 | Ban et al. | |
| 6,014,536 | A | 1/2000 | Ban et al. | |
| 6,049,685 | A | 4/2000 | Murakami et al. | |
| 6,128,453 | A | 10/2000 | Ban et al. | 399/106 |
| 6,259,874 | B1 | 7/2001 | Murakami et al. | |
| 6,266,505 | B1 | 7/2001 | Ban et al. | 399/258 |
| 6,418,290 | B1 | 7/2002 | Isomura et al. | 399/254 |
| 6,542,709 | B1 | 4/2003 | Wang et al. | 399/263 |
| 6,594,458 | B2 | 7/2003 | Ban et al. | 399/106 |
| 6,792,228 | B2 * | 9/2004 | Ban et al. | 399/106 |
| 6,968,139 | B2 * | 11/2005 | Ban et al. | 399/106 |
| 6,978,101 | B2 * | 12/2005 | Ban et al. | 399/106 |
| 2002/0127032 | A1 | 9/2002 | Ban et al. | |
| 2003/0118365 | A1 | 6/2003 | Ban et al. | |
| 2003/0161653 | A1 | 8/2003 | Ban et al. | |

FOREIGN PATENT DOCUMENTS

| | | |
|---|---|---|
| EP | 0 708 387 | 4/1996 |
| EP | 0 736 818 | 10/1996 |
| EP | 0 740 227 A1 | 10/1996 |
| JP | SHO 59-40014 | 3/1984 |
| JP | 59-101674 | 6/1984 |
| JP | 60-233677 | 11/1985 |
| JP | 61-116372 | 3/1986 |
| JP | 61-99176 | 5/1986 |
| JP | 61-99177 | 5/1986 |
| JP | 64-23054 | 2/1989 |
| JP | 3-2882 | 1/1991 |
| JP | HEI 4-60672 | 2/1992 |
| JP | 6-186844 | 7/1994 |
| JP | 6-348121 | 12/1994 |
| JP | HEI 6-348121 | 12/1994 |
| JP | 07-004400 | 1/1995 |
| JP | 7-044000 | 2/1995 |
| JP | 07-113796 | 12/1995 |
| JP | 8-211719 | 8/1996 |
| JP | 8-278694 | 10/1996 |
| JP | HEI 9-100828 | 4/1997 |
| JP | 63-85660 | 4/1998 |
| JP | 10-319696 | 12/1998 |
| JP | 11-015272 | 1/1999 |

* cited by examiner

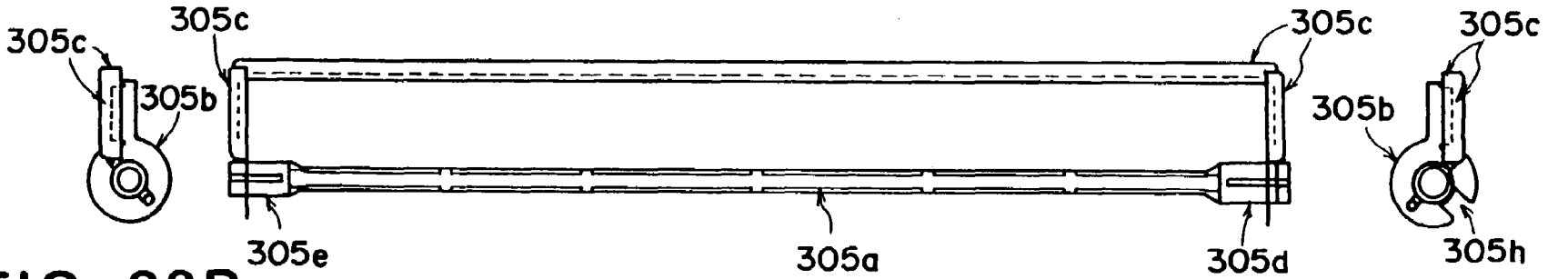
FIG. 28C
FIG. 28A
FIG. 28B
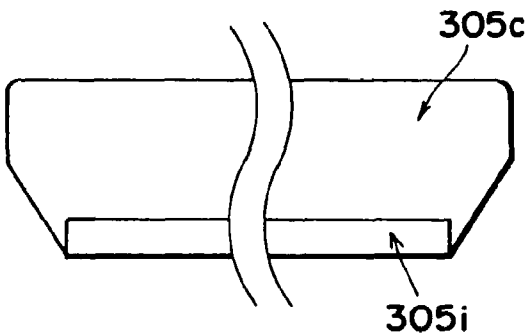
FIG. 30
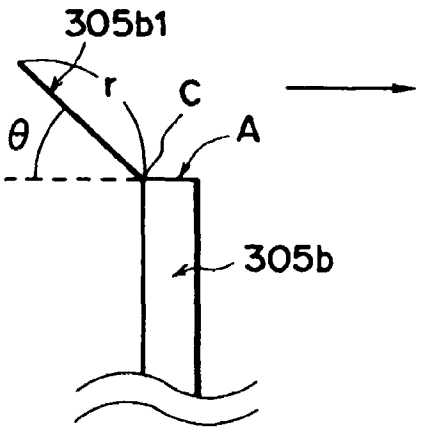
FIG. 29

TONER SUPPLY CONTAINER AND ELECTROPHOTOGRAPHIC IMAGE FORMING APPARATUS

CROSS-REFERENCE TO RELATED APPLICATIONS

This application is a divisional of U.S. patent application Ser. No. 10/798,411, filed Mar. 12, 2004, which is a divisional of U.S. patent application Ser. No. 10/397,209, filed Mar. 27, 2003, which is a continuation-in-part of U.S. patent application Ser. No. 10/359,262, filed Feb. 6, 2003, now U.S. Pat. No. 6,792,228 issued Sep. 14, 2004, which is a divisional of U.S. patent application Ser. No. 09/905,104, filed Jul. 16, 2001, now U.S. Pat. No. 6,594,458 issued Jul. 15, 2003, which is a divisional of U.S. patent application Ser. No. 09/099,032, filed Jun. 18, 1998, now U.S. Pat. No. 6,266,505 issued Jul. 24, 2001.

FIELD OF THE INVENTION AND RELATED ART

The present invention relates to a toner supply container detachably mountable to a main assembly of an electrophotographic image forming apparatus and an electrophotographic image forming apparatus to which the toner supply container is detachably mountable.

The electrophotographic image forming apparatus forms an image on a recording material using an electrophotographic-image-formation type process. Examples of an electrophotographic image forming apparatus include an electrophotographic copying machine, an electrophotographic printer (laser beam printer, LED printer or the like), a facsimile machine and a word processor.

Heretofore, an electrophotographic image forming apparatus, such as an electrophotographic copying machine or a printer, uses fine toner powder as a developer. When the developer in the main assembly of the apparatus is used up, the toner is supplied into the main assembly of the apparatus using a toner supply container.

Here, in a known system, since the toner is very fine powder or particles, the toner supply container is kept set within the main assembly of the apparatus, and the toner is discharged at a small rate through a small opening during the toner supply operation, so as to prevent toner scattering. In such a system, it is difficult to let the toner fall by the gravity or the like, and therefore, some feeding means is required.

An example of a toner supply container provided with such a toner feeding means is disclosed in Japanese Patent Application Publication No. HEI-7-113796. The toner supply container is generally cylindrical, and one end portion thereof is provided with a relatively small opening for discharging the toner. In the container, there is provided a helical toner feeding member which receives a driving force from the outside, penetrating through a wall of the end of the container.

A bearing seal mechanism is necessary to prevent toner leakage through the through-hole at the end for the drive transmission. Generally, the seal mechanism includes a gear member provided at the end of the feeding member, and a seal is sandwiched between the gear member and the container wall surface. The seal is in many cases an annular wool felt, oil seal or the like.

The toner supply container is used while being kept in the main assembly of the apparatus, and the toner is fed by rotation of the toner feeding member driven from the main assembly, and the toner is discharged at a small rate through the opening.

On the other hand, another toner supply container having toner feeding means is disclosed in Japanese Laid-open Patent Application No. HEI-7-4400. The toner supply container is in the form of a cylindrical bottle, and the inside surface thereof is provided with a helical rib, and a small toner discharging outlet is provided adjacent the center at one end.

The toner supply container, as contrasted to the above-described conventional example, does not have any inner feeding means, and is used while being kept in the main assembly of the apparatus, and the main body of the container itself is rotated by the main assembly to feed the toner. The toner fed to the end adjacent the discharging outlet is guided by an extended portion adjacent the opening to be raised toward the discharging outlet adjacent the center of the container, and then is discharged.

SUMMARY OF THE INVENTION

Accordingly, it is a principal object of the present invention to provide a toner supply container which is placed in a main assembly of an electrophotographic image forming apparatus and which supplies the toner into the main assembly with high reliability.

It is another object of the present invention to provide a toner supply container of a low manufacturing-cost type.

According to an aspect of the present invention, there is provided a toner supply container detachably mountable to a main assembly of an electrophotographic image forming apparatus, comprising: (a) a toner accommodating portion for accommodating toner; (b) a toner supply opening or port for discharging toner accommodated in the toner accommodating portion; and (c) a toner feeding member for feeding the toner accommodated in the toner accommodating portion toward the toner supply opening by rotation thereof. The center of rotation of the toner feeding member is in an opening region of the toner supply port as seen in the longitudinal direction of the toner feeding member.

According to an aspect of the present invention, there is provided a toner supply container detachably mountable to an image forming apparatus. The container comprises a toner accommodating portion configured to accommodate toner. The toner accommodating portion has a supply opening for supplying toner into the image forming apparatus. The container also comprises a feeding member, provided in the toner accommodating portion, configured and positioned to feed the toner in the toner accommodating portion toward the supply opening, and a sealing member configured and positioned to seal the supply opening. The sealing member has a locking portion for being locked by a locking member provided in a main assembly of the image forming apparatus, and a coupling portion for being coupled with a drive coupling member provided in the main assembly of the image forming apparatus. The sealing member is rotatable integrally with the feeding member by a rotational force received by the coupling portion from the drive coupling member. The locking portion and the coupling portion are spaced apart from each other with respect to a mounting direction of the toner supply container. In addition, the locking portion is capable of being locked by the locking member when the drive coupling member is in a retracted position at which the coupling portion is not coupled with the drive coupling member.

In this embodiment, the toner supply container is mountable to the main assembly of the image forming apparatus irrespective of whether the coupling portion is in or out of phase with respect to the drive coupling member of the main assembly of the image forming apparatus. In addition, the supply opening of the toner supply container is unsealable irrespective of whether the coupling portion is in or out of phase with respect to the drive coupling member. The locking portion is in the form of a groove provided along a full circumferential periphery, and the coupling portion includes a plurality of projections provided at discrete positions. The coupling portion extends from the sealing member. In addition, the container further comprises another coupling portion extending from the sealing member so that the container comprises two coupling portions. The locking portion is disposed downstream of the coupling portion with respect to the mounting direction of the toner supply container. The sealing member is capable of resealing the supply opening after unsealing of the supply opening.

In addition, the container further comprises a stirring member configured and positioned to stir the toner in the toner accommodating portion and a stirring coupling portion configured and positioned to receive a driving force for the stirring member from the main assembly of the image forming apparatus. The stirring member is disposed above the feeding member, and the stirring coupling portion is disposed above the sealing member. The stirring member and the feeding member are substantially vertically aligned with each other, and centers of rotation of the stirring coupling portion and the sealing member are substantially vertically aligned. The sealing member is coaxial with and integral with the feeding member. The sealing member and the feeding member are slidable relative to each other in the longitudinal direction while a coaxial relation therebetween is maintained. The feeding member has a rotational shaft which extends out through the supply opening and which is slidably engaged with the sealing member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4(A)-4(C) show a toner supply container according to the first embodiment of the present invention, wherein FIG. 4(A) is a partially sectional front view thereof FIG. 4(B) is a side view thereof, and FIG. 4(C) is a sectional side view thereof.

FIGS. 6(A)-6(D) show a sealing member for the toner supply container, wherein FIG. 6(A) is a front view thereof, FIG. 6(B) is a view taken along a line A of (A), FIG. 6(C) is a view taken along a line B of (A), and FIG. 6(D) is a sectional front view thereof.

FIGS. 7(A)-7(C) show the electrophotographic copying machine, wherein FIG. 7(A) is a side view thereof, FIG. 7(B) is a front view thereof, FIG. 7(C) is a top plan view thereof, wherein a cover for toner supply container exchange is opened.

FIGS. 10(A)-10(C) show a coupling member for the electrophotographic copying machine, wherein FIG. 10(A) is a front view thereof, FIG. 10(B) is a rear view thereof, and FIG. 10(C) is a sectional side view thereof.

FIGS. 11(A) and 11(B) show a feeding member, wherein FIG. 11(A) is a front view of the feeding member mounted to a shaft portion of the feeding member of the toner supply container, and FIG. 11(B) is a front view of a feeding member provided with a port.

FIGS. 14-1 through 14-5 are sectional views of a container and illustrate a toner discharging operation of the toner supply container according to an embodiment of the present invention.

FIGS. 21(A) and 21(B) show shows a toner supply container according to a third embodiment, wherein FIG. 21(A) is a perspective view as seen from the side near a sealing member, and FIG. 21(B) is a perspective view as seen from the side near a handle.

FIG. 22(A) through 22(F) show a toner supply container according to a third embodiment, wherein FIG. 22(A) is a front view thereof, FIG. 22(B) is a sectional view thereof, FIG. 22(C) is a left side view thereof, FIG. 22(D) is a right side view thereof, FIG. 22(E) is a sectional side view thereof, and FIG. 22(F) is a top plan view thereof.

FIGS. 25(A) and 25(B) show a toner accommodating part according to the third embodiment, wherein FIG. 25(A) is a perspective view as seen from a side near a supplement port, and FIG. 25(B) is a perspective view as seen from a side near a handle.

FIG. 26(A) through 26(F) show a toner accommodating part, wherein FIG. 26(A) is a front view thereof, FIG. 26(B) is a sectional view thereof, FIG. 26(C) is a left side view thereof, FIG. 26(D) is a right side view thereof, FIG. 26(E) is a sectional side view thereof, and FIG. 26(F) is a top plan view thereof.

FIGS. 27(A) through 27(D) show a sealing member, wherein FIG. 27(A) is a front view thereof, FIG. 27(B) is a view taken along a line A, FIG. 27(C) is a view taken along a line B, and FIG. 27(D) is a sectional front view thereof.

FIGS. 28(A) through 28(C) show a stirring member, wherein FIG. 28(A) is a front view thereof, FIG. 28(B) is a left side view thereof, and FIG. 28(C) is a right side view thereof FIG. 29 is an enlarged side view of a rigid blade portion.

FIG. 30 is an enlarged view of a flexible blade portion.

FIG. 31(A) through 31(D) show a stirring member according to another embodiment of the present invention, wherein FIG. 31(A) is a front view thereof, FIG. 31(B) is a left side view thereof, FIG. 31(C) is a right side view thereof, and FIG. 31(D) is a bottom view thereof.

FIGS. 37(A) through 37(D) show a drive transmission claw, wherein FIG. 37(A) is a sectional front view thereof, FIG. 37(B) is a side view thereof, FIG. 37(C) is a front view thereof, and FIG. 37(D) is a top plan view thereof.

FIGS. 38(A) through 38(D) show a transmitting member, wherein FIG. 38(A) is a sectional front view thereof, FIG. 38(B) and FIG. 38(C) are side views thereof, and FIG. 38(D) is a front view thereof.

DESCRIPTION OF THE PREFERRED EMBODIMENTS

The embodiment of the present invention will be described in conjunction with the accompanying drawings.

Figure 1:
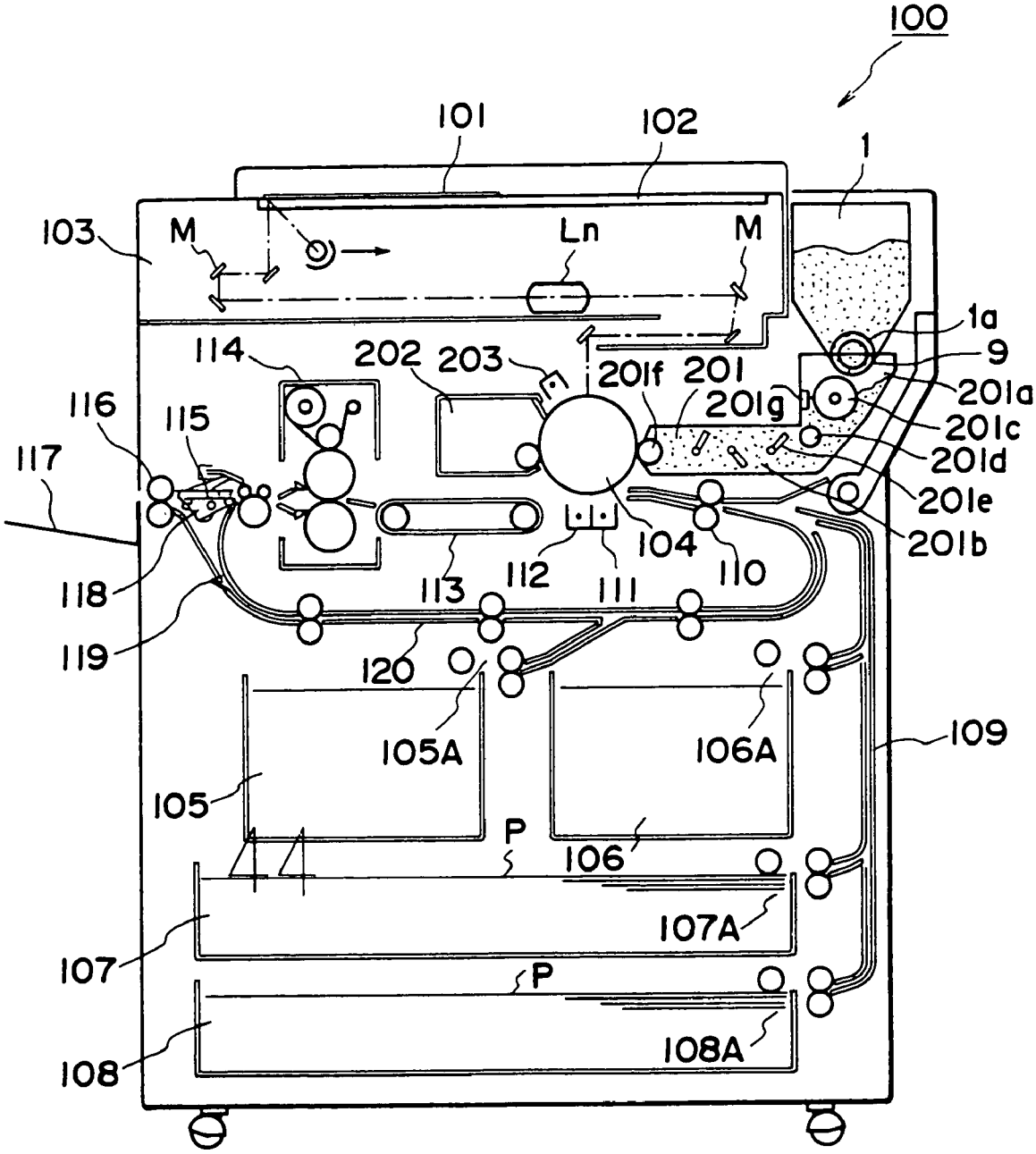
FIG. 1 is an illustration of an electrophotographic copying machine which is an example of an electrophotographic image forming apparatus to which a toner supply container according to the present invention is mountable.

Referring to FIG. 1, a description will first be provided with respect to a structure of an electrophotographic copying machine which is an example of an electrophotographic image forming apparatus to which a toner supply container according to the present invention is mountable.

In the figure, designated by 100 is a main assembly of the electrophotographic copying machine. Reference numeral 101 designates an original, which is placed on an original supporting platen glass 102. A light image corresponding to image information is formed on an electrophotographic photosensitive drum 104 through a plurality of mirrors M and a lens Ln of an optical portion 103. Designated by 105-108 are cassettes. Among the cassettes 105-108, the one containing the proper size sheets corresponding to the paper size of the original 101 or the information inputted by the user at the operating portion 100*a* is selected. The recording material is not limited to paper, but may be an OHP sheet or the like.

The one sheet P fed by pick-up and separating devices 105A-108A is fed to a registration roller 110 through a feeding portion 109, and is fed in synchronism with the rotation of the drum 104 and the scanning timing of the optical portion 103. Designated by 111, 112 are a transfer discharge device and a separation discharge device. The toner image formed on the drum 104 by a transfer discharge device 111 is transferred onto the sheet P. Then, the sheet P now having a transferred toner image is separated from the drum 104 by a separation discharge device 112.

The sheet P is fed by a feeding portion 113 to a fixing portion 114 where the toner image on the sheet is fixed by heat and pressure, and thereafter, the sheet is passed through the sheet discharge/reversion portion 115 and is discharged to a sheet discharge tray 117 by sheet discharging rollers 116 in the case of a one-sided copy mode. In the case of the both-sided copy mode, the sheet is fed to the registration roller 110 through refeeding paths 119, 120 under the control of the flapper 118 of the sheet discharge/reversion portion 115, and is again fed in the same way as in the one-sided copy mode and is discharged to the sheet discharge tray 117.

In the case of the superimposed copy mode, the sheet P is passed through the sheet discharge/reversion portion 115, and is partly discharged by the sheet discharging roller 116 temporarily. Thereafter, the terminal end of the sheet P passes by the flapper 118, and the flapper 118 is controlled when the sheet is still nipped by the sheet discharging roller 116, and the sheet discharging roller 116 is reversed so that it is refed into the apparatus. Then, the sheet is fed to the registration roller 110 through the refeeding portions 119, 120, and is fed in the same way as in the one-sided copy mode to the sheet discharge tray 117.

In the main assembly 100 of the apparatus, a developing station 201, a cleaner station 202, a primary charger 203 and the like are disposed around the drum 104. The developing station 201 functions to develop with toner an electrostatic latent image formed on the drum 104 by the optical portion 103 on the basis of the information of the original 101. A toner supply container 1 for supplying the toner to the developing station 201 is mounted to the main assembly 100 in the manner that an operator can mount and demount it. The developing station 201 has a toner hopper 201*a* and a developing device 201*b*. The toner hopper 201*a* includes a stirring member 201*c* for stirring the toner supplied from the toner supply container. The toner stirred by the stirring member 201*c* is fed to the developing device 201*b* by a magnet roller 201*d*. The developing device 201*b* includes a developing roller 201*f* and a feeding member 201*e*. The toner fed from the toner hopper 201*a* by the magnet roller 201*d*, is further fed to the developing roller 201*f* by the feeding member 201*e*, and then is supplied to the photosensitive drum 104 by the developing roller 201*f*.

The cleaning station is provided to remove the toner remaining on the photosensitive drum 104. The primary charger 203 functions to charge the photosensitive drum 104.

Figure 3:
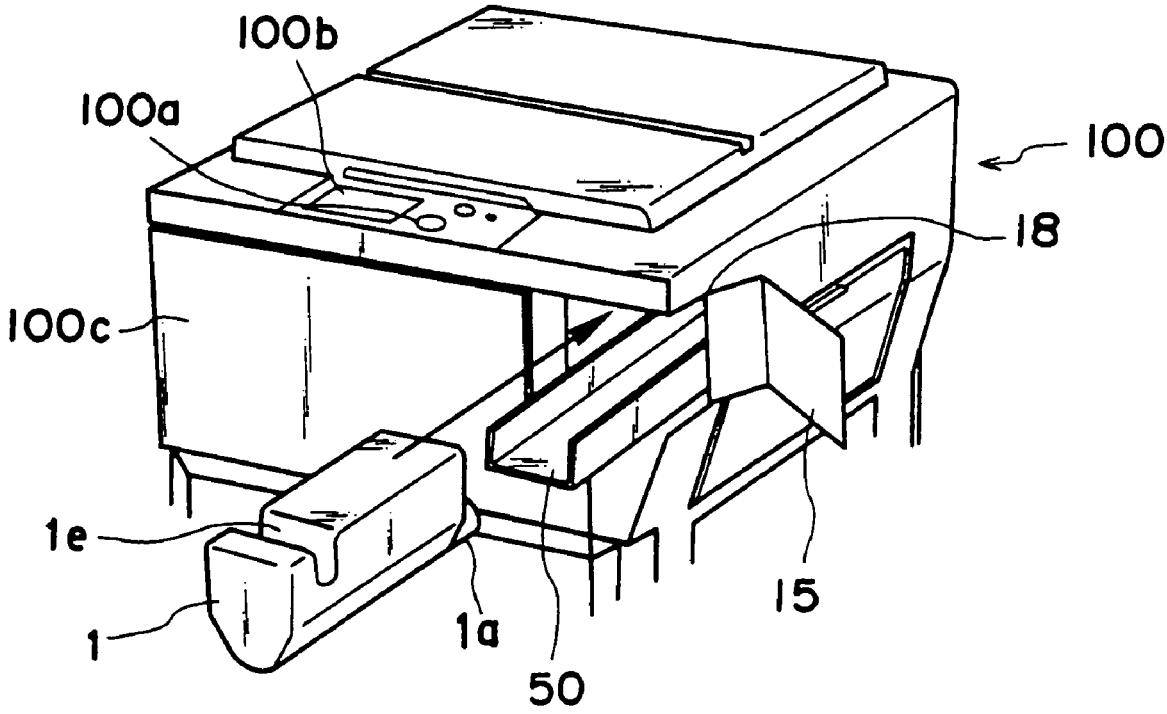
FIG. 3 is an illustration of the toner supply container and the electrophotographic copying machine, wherein the cover of the electrophotographic copying machine, for the exchange of the toner supply container, is opened to load the toner supply container.
Figure 4A:
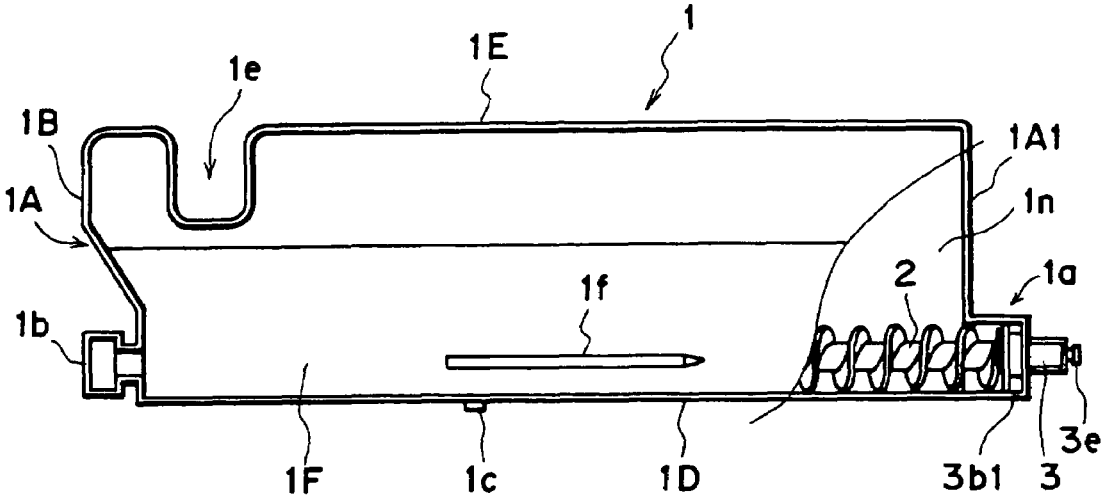
Figure 4B:
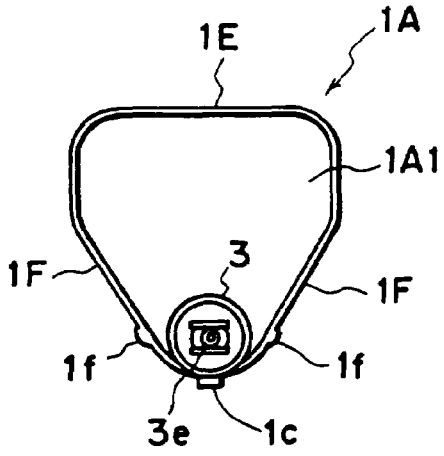
Figure 4C:
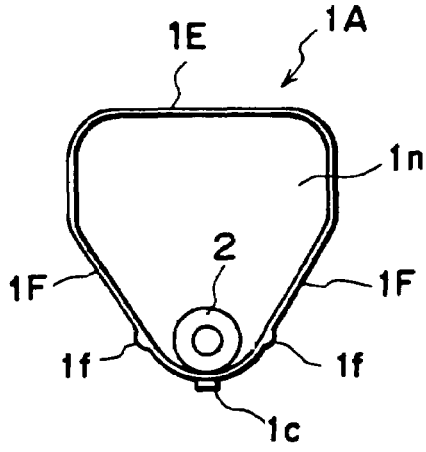

When the operator opens, as shown in FIG. 3, the cover 15, for exchanging the toner supply container, the cover being a part of the outer casing, the container receptor table 50 is drawn out to a predetermined position by a driving system (unshown). A toner supply container 1 is placed on the table 50. When the user takes out the container 1 from the main assembly 100 of the apparatus, the toner supply container 1 is removed from the table 50 which has been drawn out. The cover 15 is provided exclusively for mounting and demounting (exchanging) the toner supply container 1, and is opened or closed only when the container 1 is mounted or demounted. For the maintenance of the main assembly 100, a cover 100*c* at the front side is opened.

The toner supply container 1 may be directly mounted to or demounted from the main assembly 100 without using the container reception table 50.

Figure 5:
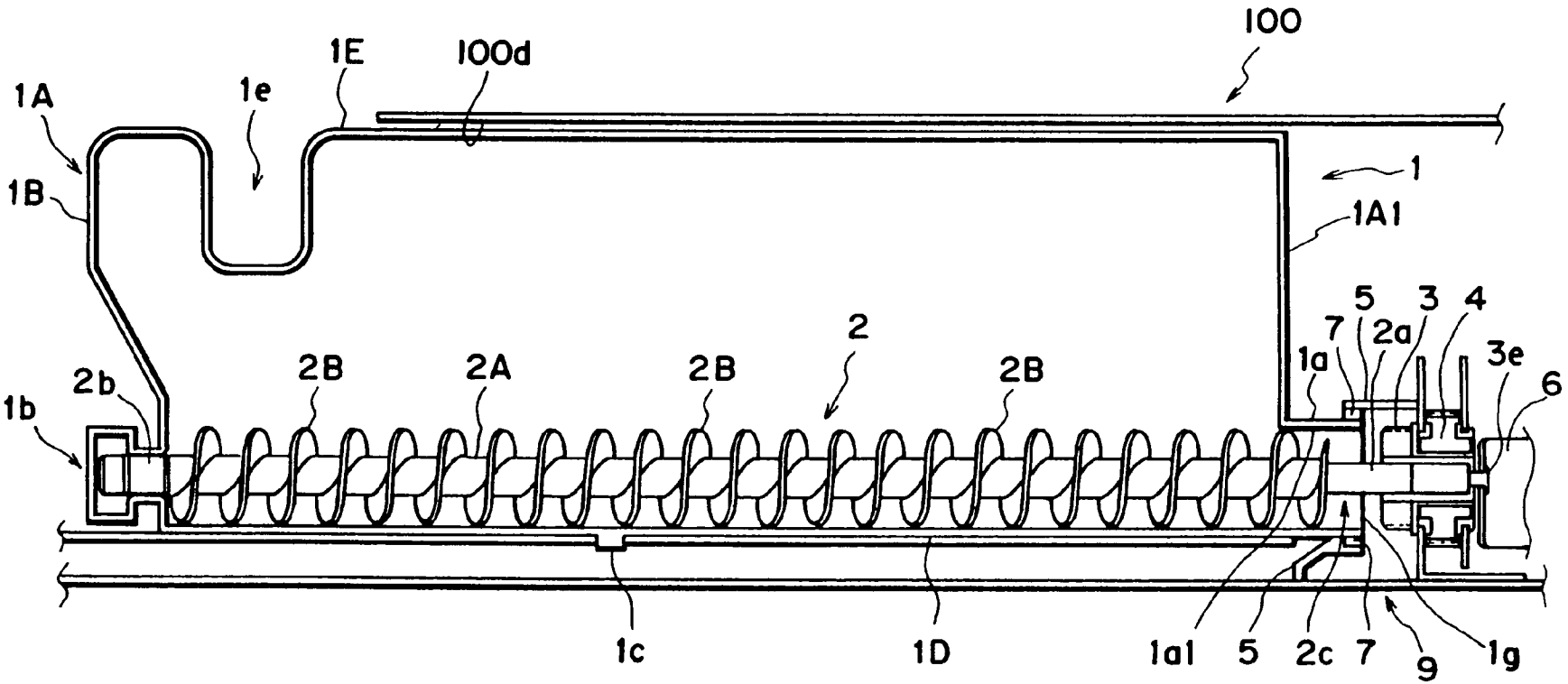
FIG. 5 is a sectional front view of the toner supply container which is mounted to the image forming apparatus, and is unsealed (opened).
Figure 6A:
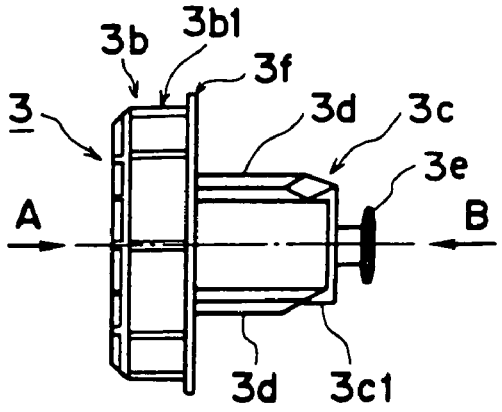
Figure 6B:
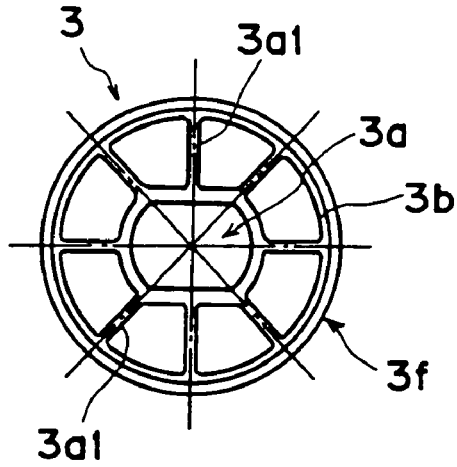
Figure 6C:
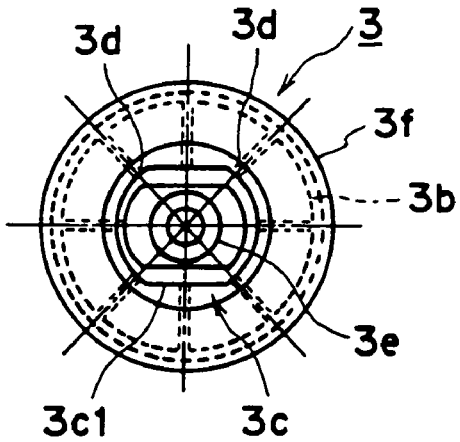
Figure 6D:
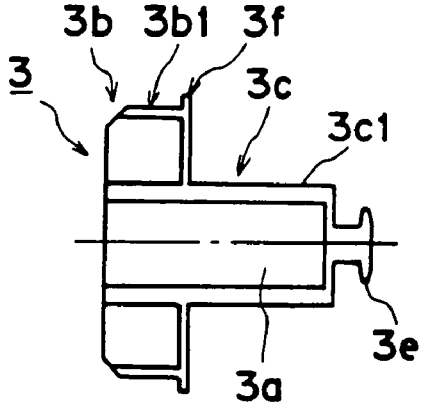
Figures 1, 14:
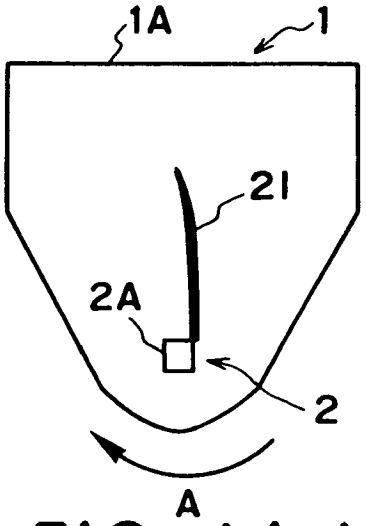
Figures 2, 14:
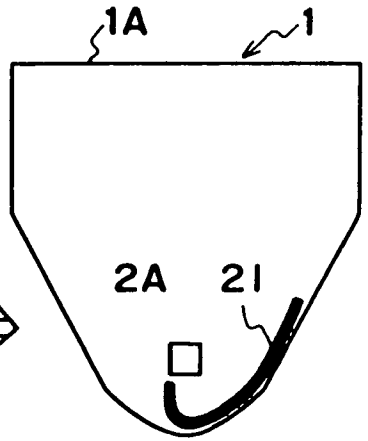
Figures 3, 14:
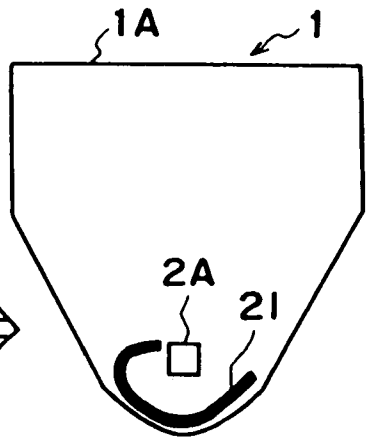
Figures 4, 14:
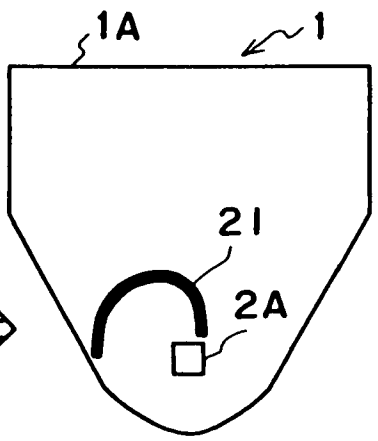
Figures 5, 14:
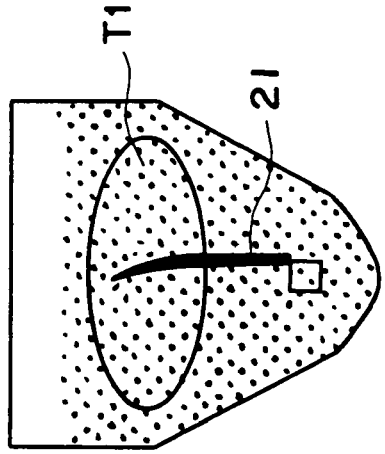
Figure 15:
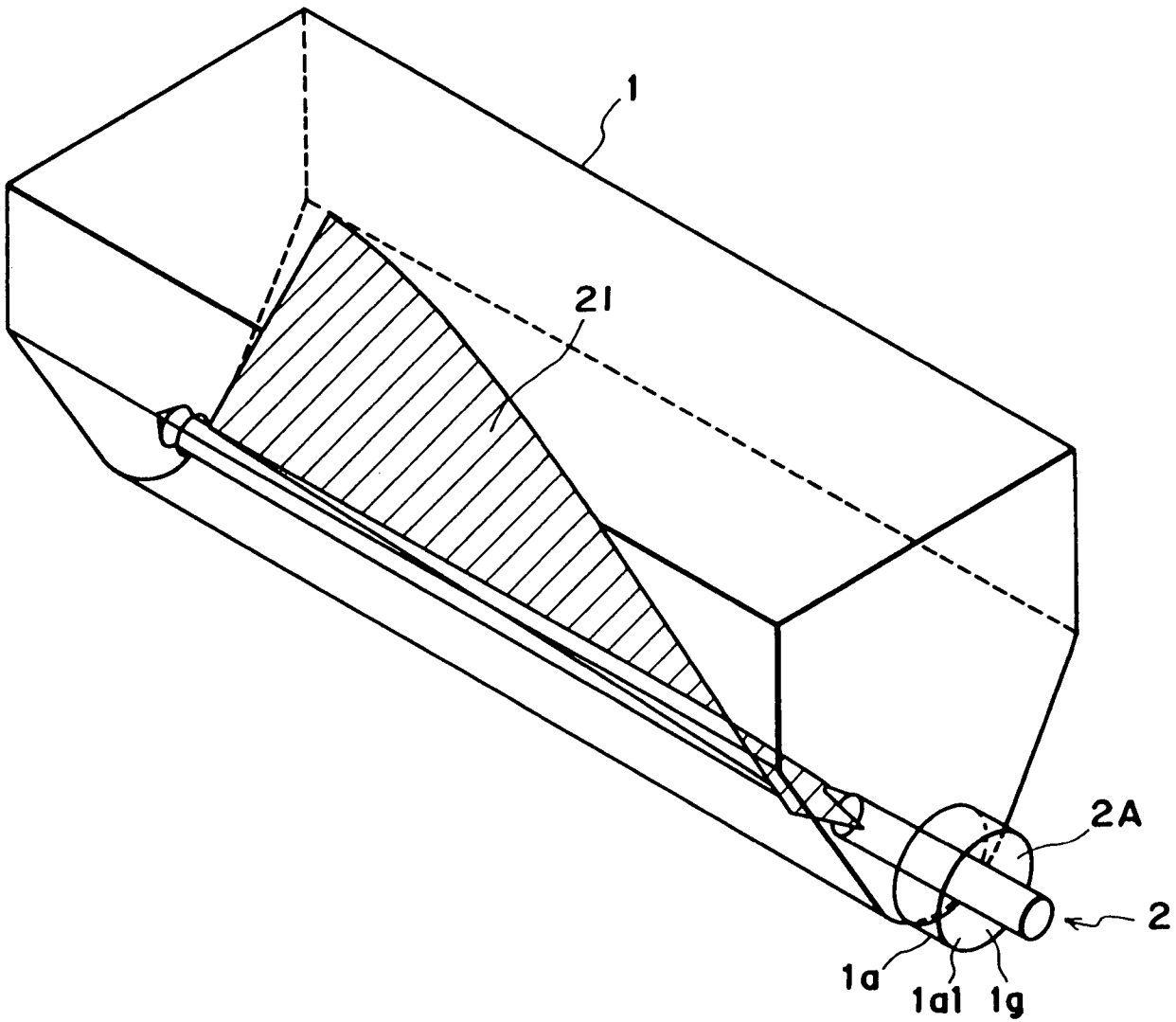
FIG. 15 is a perspective view illustrating a toner discharging principle of the toner supply container according to this embodiment.

Referring to FIGS. 4 and 5, the toner supply container according to the first embodiment of the present invention will be described. In FIG. 4, (A) is a partial sectional front view of the toner supply container of this embodiment. (B) is a side view of the toner supply container. (C) is a sectional side view of the toner supply container. FIG. 5 is a sectional front view wherein the toner supply container is loaded in the main assembly of the apparatus, and it has been unsealed.

In FIGS. 4 and 5, designated by 1A is a main part of the toner supply container (main body of the container). The powder toner is to develop the electrostatic latent image formed on the drum 104, and may be one component toner, two component toner or another. Designated by 2 is a feeding member for supplying the powder toner accommodated in the main body 1A of the container to the toner hopper 201*a* which is a receiving portion mounted to the main assembly 100. Designated by 3 is a sealing member, 4 is a coupling member, and 9 is a toner receiving port provided in the toner hopper 201*a* in the main assembly 100. The toner discharged from the toner supply container 1 is fed into the toner hopper 201*a* from the receiving port 9. The structure may be such that toner discharged from the toner supply container 1 is fed directly into the developing device 201*b* not through the toner hopper 201*a*.

The main body 1A of the toner supply container includes a curved portion 1F having a width which decreases toward the bottom, and a flat surface portion having a substantially constant width, and an arcuate configuration portion extending down from the flat surface portion. Here, the lower portion s refers to the portion that assumes a lower position when the toner supply container 1 is mounted to the main assembly 100 of the apparatus, and the bottom surface, the upper surface, the lower surface and the side surface are the surfaces which are the bottom surface, the upper surface, the lower surface and the side surface when the toner supply container 1 is mounted to the main assembly 100. The toner supply container 1 is shown in the same position as when it is mounted to the main assembly of the apparatus in FIGS. 4, 5, 14, 15, 16, 21, 22, 23, 24, 25, 26 and 39.

On a lower portion of a side surface 1A1 of the main assembly 1A of the container, a cylindrical toner supply port portion 1*a* for supplying the toner accommodated in the toner accommodating portion 1*n* into the main assembly of the apparatus, is formed as a projection. At one end portion of the toner supply port portion 1*a*, a toner supply port 1*g* is provided. A receiving portion 1*b* is formed to rotatably support the feeding member 2 at a position corresponding to the toner supply port portion 1*a* in the other side surface 1B. At an outside of the bottom surface 1D, there is provided an engaging portion 1*c* for engagement with an opening and closing means for the toner supply port, which is provided in the main assembly 100 and which will be described hereinafter, to move the toner supply container 1 in the mounting and demounting direction. In this embodiment, the engaging portion 1C is in the form of a dowel projected outwardly from the bottom surface 1D. The upper surface 1E is provided with a recess 1*e* for providing a grip for facilitating the operator when the toner supply container 1 is mounted to the main assembly 100 of the apparatus and when it is demounted from the main assembly 100. On the front side and the lower inclined surface of the back side, ribs 1*f* are extended parallel to each other to facilitate the handling of the main body 1A of the container when the user mounts the toner supply container 1 into the main assembly 100.

The main body 1A of the container may preferably be produced through injection molding, blow molding, injection blow molding or the like, of a plastic resin material, but another manufacturing method and/or material is also usable. The main body 1A may be divided into two or more parts, and the manufactured parts may be welded or bonded to unify them.

In this embodiment, an upper frame and a lower frame, which are manufactured respectively through injection molding of high impact polystyrene, are joined together by vibration welding.

On the other hand, the feeding member 2 functions to feed the toner accommodated in the main body 1A to the toner supply port 1*g*. The feeding member 2 includes, as shown in FIG. 5, a shaft portion 2A, and a rigid helical feeding blade 2B on the shaft portion 2A, which functions as a feeding portion for feeding the powder toner in a predetermined direction by rotation of the shaft portion 2A. The feeding member 2 is mounted to the main body 1A of the container with the axis of the shaft portion 2A substantially coaxial with the center of the toner supply port 1*g*.

The feeding member 2 is not limited to the so-called screw type of this embodiment, but may be flexible blades mounted on the shaft portion 2A, for example. The shaft portion and the blades may be integrally molded. In this embodiment, the shaft portion 2A and the blades 2B are made of plastic resin material and are integrally molded.

In this embodiment, the feeding member 2 includes an extending portion 2*c* which extends into the cylinder portion of the toner supply port portion 1*a*. In this embodiment, the extending portion 2*c*is projected outwardly from the toner supply port portion 1*a*. The free end portion of the extending portion 2*c* projected outwardly receives a rotation force from the main assembly 100 of the apparatus. To accomplish this, the free end portion is provided with a sealing member 3 which is movable in the axial direction.

As will be described in detail hereinafter, the sealing member 3 has four functions in this embodiment. More particularly, the four functions are (1) to seal the toner supply port portion 1*a*; (2) to receive the rotation force transmitted from the main assembly 100; (3) to transmit the rotation force to the feeding member 3; and (4) to engage with an engageable member 6 provided in the main assembly of the apparatus to open and close the toner supply port portion 1*a*. The driving force received by the sealing member 3 from the main assembly 100 is transmitted to the shaft portion 2A through the extending portion 2*c* to rotate the feeding member 2.

The one end portion 2*a* of the extending portion 2*c* has a configuration which can receive the rotation force through the sealing member 3 from the main assembly 100, and it is H-shaped in this embodiment. The one end portion of the shaft portion 2A is supported by a sealing member 3 through a one end portion 2*a* of the extending portion 2*c*. The other end portion 2*b* of the shaft portion 2A is rotatably engaged with a receiving portion 1*b* of the main body 1A of the container, so that feeding member 2 is rotatable when the container is unsealed.

The feeding member 2 is supported by the sealing member 3 in such a manner that feeding blade 2B is out of contact with the internal wall surface 1*a*1 of the toner supply port portion 1*a* and that shaft portion 2*a* and the internal wall surface of the toner supply port portion 1*a* are substantially horizontal. By supporting the feeding member 2 in such a manner, the toner can be fed substantially horizontally toward the toner supply port 1*g* when the feeding member 2 is rotated. If the fine toner particles are sandwiched between the internal wall surface 1*a*1 of the toner supply port portion 1*a* and the feeding blade 2B and are rubbed therebetween, the toner may be fused on the internal wall surface 1*a*1, or the toner may be aggregated. These can be avoided.

The feeding member 2 may preferably be manufactured through injection molding or the like from a plastic resin material, as has been described, but another method or material may be usable. It may be divided into a plurality of parts which are separately manufactured, and then are joined.

Referring to FIG. 6, the sealing member 3 with be described. In FIG. 6, (A) is a front view of the sealing member; (B) is a perspective view as seen in the direction A in (A); (C) is a view in the direction B in (A); and (D) is a sectional front view.

In (A)-(D) of FIG. 6, designated by 3*b* is a sealing portion, provided at its side closer to the toner supply container, for openably sealing the toner supply port 1*g* of the toner supply container 1. The outer diameter of the sealing portion 3*b* is quite larger than the inner diameter of the toner supply port 1*g*. Therefore, the sealing member 3 seals the toner supply port 1*g* by press-fitting the engaging portion 3*b*1 of the sealing portion 3*b* into the toner supply port portion 1*a* through the toner supply port 1*g*.

Designated by 3*c* is a coupling engaging portion which functions as a driving force receiving portion for receiving a driving force for rotating the feeding member 2 from the main assembly 100 of the apparatus when the toner supply container 1 is mounted to the main assembly 100. The coupling engaging portion 3*c* is provided with a projected portion 3*c*1 extended coaxially with a shaft portion 2A of the feeding member 2 in a direction away from the main body 1A from the sealing portion 3*b* (when the sealing member 3 is mounted to the main body 1A of the container). The coupling engaging portion 3*c* is provided with elongated spline projections (rib) 3*d* on the peripheral surface of the projected portion 3*c*1, which projections function as a driving force receiving portion engageable with the coupling member 4. In this embodiment, four of such spline projections are provided circumferentially equidistantly.

The sealing member 3 is provided with an engaging hole 3*a* functioning as a driving force transmitting portion for transmitting, to the feeding member 2, the driving force from the main assembly 100 by engagement with one end portion 2*a* of the feeding member 2, and the engaging hole 3*a* is in the form of an opening (hole) formed in the sealing portion 3*b* and the coupling engaging portion 3*c*. The engaging hole 3*a* is H-shaped corresponding to the H-shape of the shaft end 2*a* of the feeding member 2 projected from the powder toner supply portion 1*a*, and is slightly larger than that of the shaft end 2*a*. By this, the shaft end 2*a* is loosely engaged with the engaging hole 3*a*.

By the shaft end 2*a* loosely engaged with the engaging hole 3*a*, the feeding member 2 and the sealing member 3 are locked with each other in the rotational direction of the feeding member 2, while being movable relative to each other in the thrust direction. Thus, the sealing member 3 can be separated from the main body 1A of the container when the toner supply container is mounted to the main assembly, as will be described hereinafter, so that unsealing (opening) of the powder toner supply port 1*g* is accomplished.

The engagement length between the shaft end 2*a* and the engaging hole 3*a* is long enough to prevent disengagement between the sealing member 3 and the main body 1A of the container when the sealing member 3 is moved away from the main body. Therefore, even if the sealing member 3 is moved away from the main body 1A of the container, the feeding member 2 can receive the driving force through the sealing member 3 (coupling engaging portion 3C).

Between the coupling engaging portion 3*c* and the sealing portion 3*b*, there is provided a flange portion 3*f* abutting the end of the port 1*a* for the toner supply when the sealing portion 3*b* is press-fitted into the port 1*a*. The outer diameter of the flange portion is substantially equal to the outer diameter of the toner supply port portion 1*a*. By the flange portion 3*f*, the sealing portion 3*b* is press-fitted into the toner supply port portion 1*a* through a distance corresponding to the length of the engaging portion 3*b*1.

Designated by 3*e* is a locking projection 3*q* functioning as a locking portion which is formed at an end of a coupling engaging portion and which is to be engaged with the locking member 6 in the main assembly 100 (FIG. 5), and by engagement between the locking projection 3*e* and the locking member 6, the sealing member 3 can be fixed when the powder toner supply port 1*g* is unsealed.

The sealing member 3 having such a structure may preferably be manufactured by injection molding of a resin material or the like, but another method and/or material is usable. The sealing member 3 is required to have a proper elasticity to press-fit in the toner supply port 1*a* and seal the port. The material is preferably a low density polyethylene, and other usable examples include polypropylene, high density polyethylene or the like.

An assembling method of the toner supply container 1 will be described

In the assembling method of the toner supply container 1, the feeding member 2 is inserted into the lower portion of the main body 1A of the container through the toner supply port 1*g* (FIG. 5). Then, the predetermined amount of the toner (unshown) is filled into the main body 1A, and finally, the toner supply port 1*g* is sealed by a sealing member 3, by which filling of the toner supply container 1 is accomplished. Thus, the assembling of the toner supply container 1 of this embodiment is very simple and easy, and the number of the manufacturing steps is very small.

The toner may be filled through the toner supply port 1*g*; alternatively, an additional toner filling port (unshown) may be formed at a proper portion of the main body 1A of the container, and the toner may be filled through the toner filling port, which is then sealed. Further alternatively, the main body 1A of the container may be divided into two or more parts, which are joined together after the toner is filled. Where the toner supply port 1*g* of the integrally formed main body 1A is also used as a filling port, no additional cap or joining step after the filling is necessary.

In the toner supply port portion 1*a*, the feeding member 2 is extended, and therefore, it is preferable to have a sufficient size to permit smooth discharging of the toner. A description will be provided as to the ratio of the cross-sectional area of the toner supply port portion 1*a* and the cross-sectional area of the passing portion (shaft portion 2A) of the feeding member 2. The cross-sectional area of the toner supply port portion 1*a* is preferably not less than twice the cross-sectional area of the shaft portion 2A of the feeding member 2, and further preferably, not less than three times, and even further preferably not less than five times.

In this embodiment, it is about three times. In this embodiment, the toner supply port portion 1*a* is cylindrical, and therefore, the inner diameter of the toner supply port portion 1*a* is about three times the outer diameter of the shaft portion 2A of the feeding member 2.

On the other hand, if the inner diameter of the toner supply port portion 1*a* is too large, the toner contamination around the toner supply port 1*g* is significant, and the maintenance of the hermeticality during transportation or in the case of an ambient condition change, may be difficult. Therefore, the inner diameter of the toner supply port portion 1*a* is preferably not more than 40 mm. In this embodiment, it is approximately 24 mm.

A description will be provided as to an exchanging method of the toner supply container.

When the toner is entirely consumed from the toner supply container 1 with image formations, toner supply container emptiness detecting means (unshown) provided in the main assembly 100 of the apparatus detects it, and displays the event to the user on displaying means 100*b* (FIG. 2) such as a liquid crystal display.

In this embodiment, the toner supply container 1 is exchanged by the user through the following steps.

Figure 2:
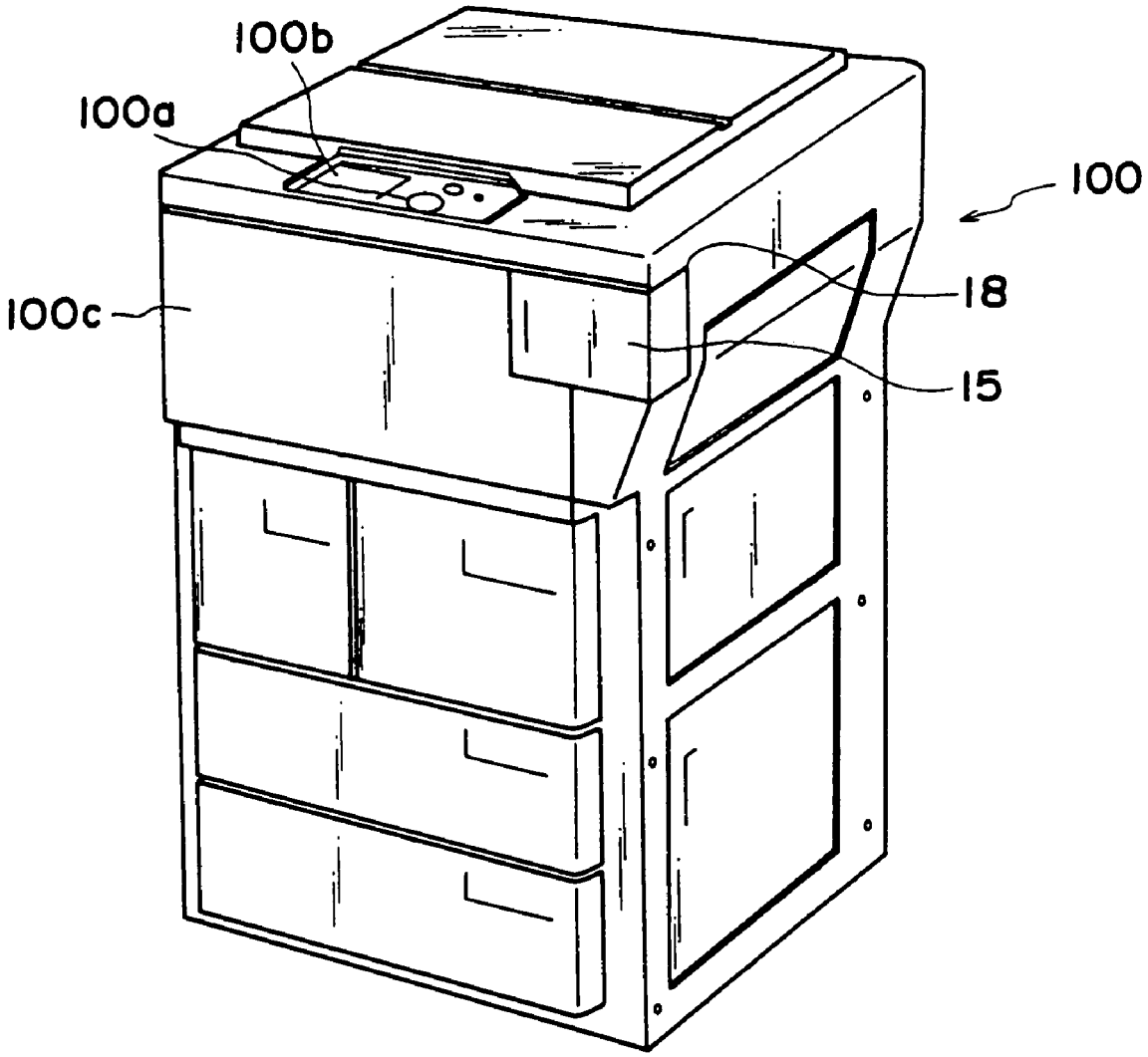
FIG. 2 is a perspective view of the electrophotographic copying machine.
Figure 7A:
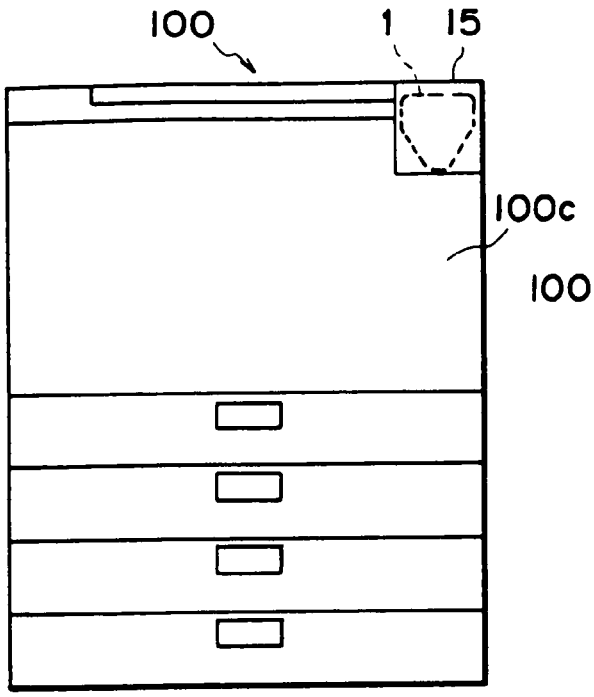
Figure 7B:
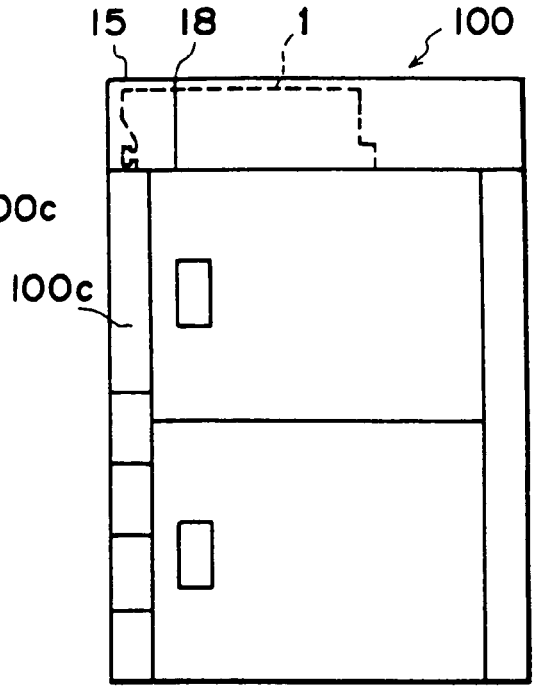
Figure 7C:
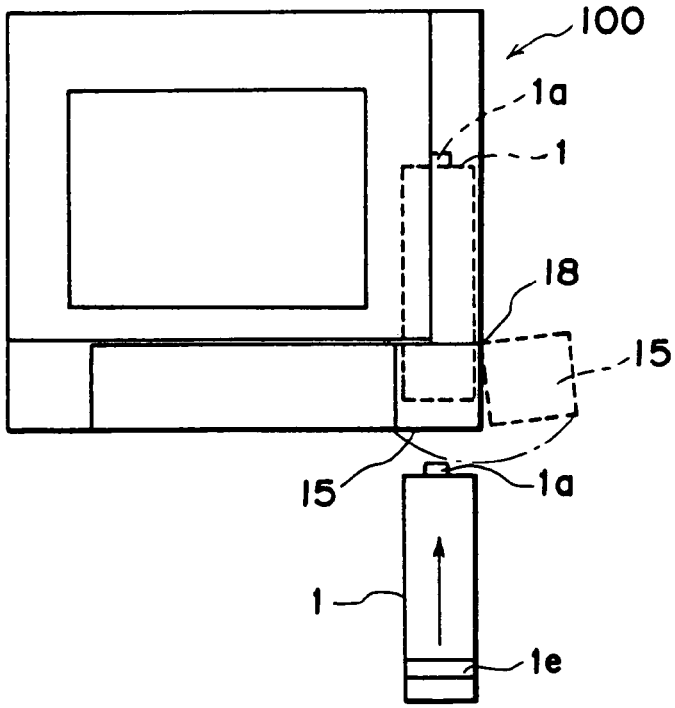

As shown in (A) and (B) of FIGS. 2 and 7, the cover 15, which is at this time closed, is opened by rotating it about the hinge 18 to a position as shown in FIG. 3(C). The main body 1A is moved by toner supply portion opening means, which will be described hereinafter, in interrelation with the opening of the cover 15, and the sealing member 3 (FIG. 9) which is at the open position away from the main body 1A to open the toner supply port 1*g*, is press-fitted into the toner supply port portion 1*a*, by which the toner supply port 1*g* is closed (FIG. 8).

The user draws out the toner supply container 1 now not containing the toner from the main assembly 100 in the direction opposite from the direction indicated by the arrow in (C) to take it out of the main assembly 100. Thereafter, the user inserts the fresh toner supply container 1 into the main assembly 100 in the direction of the arrow, and then closes the cover 15 ((A) and (B)). In interrelation with the closing action of the cover 15, the sealing member 3 is separated from the main body 1A of the container by toner supplying portion opening means, thus opening the toner supply port 1*g*. In this manner, the toner supply container is exchanged.

Figure 8:
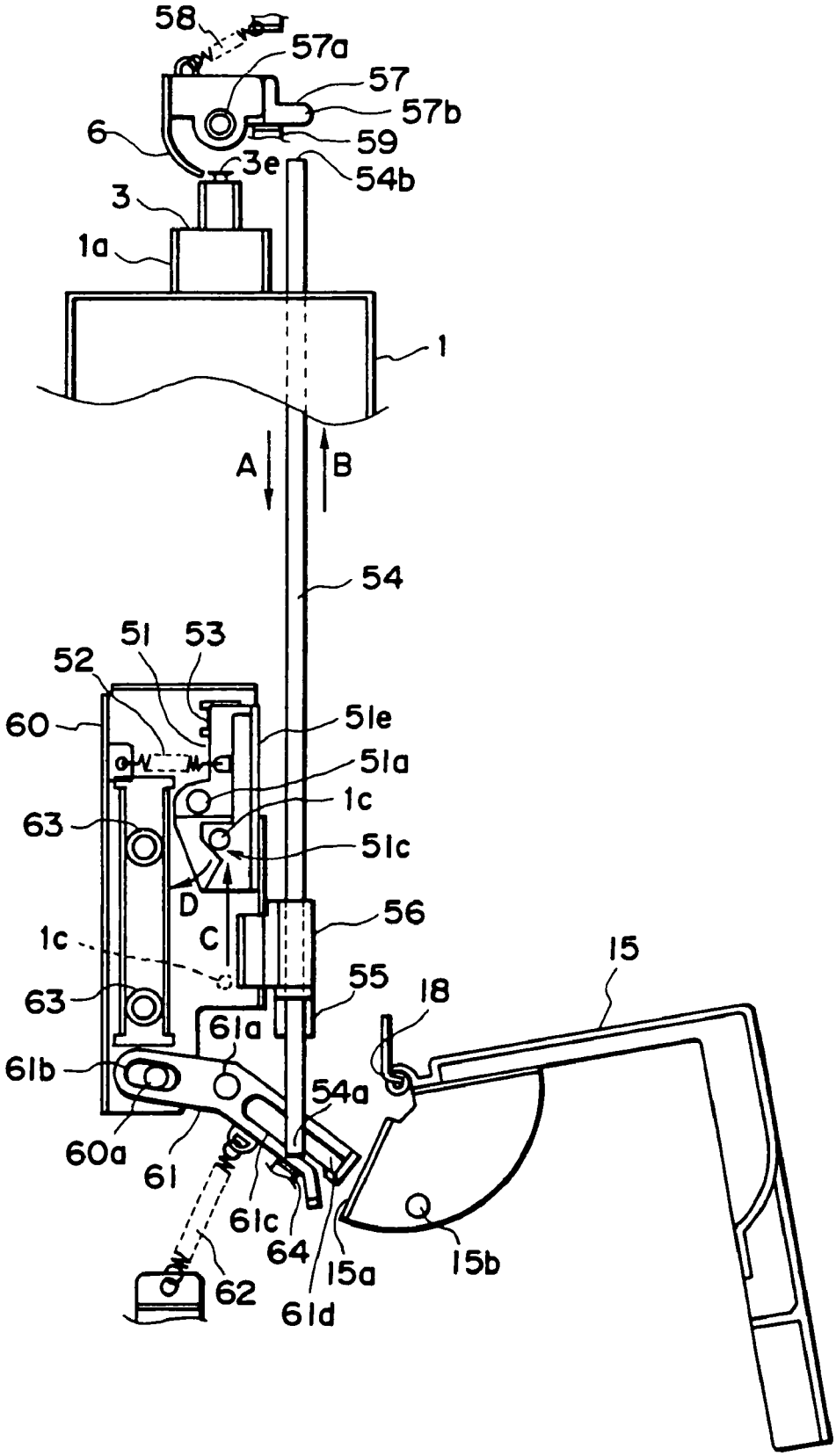
FIG. 8 illustrates toner supplying portion opening and closing means and the parts therearound when the cover is open.
Figure 9:
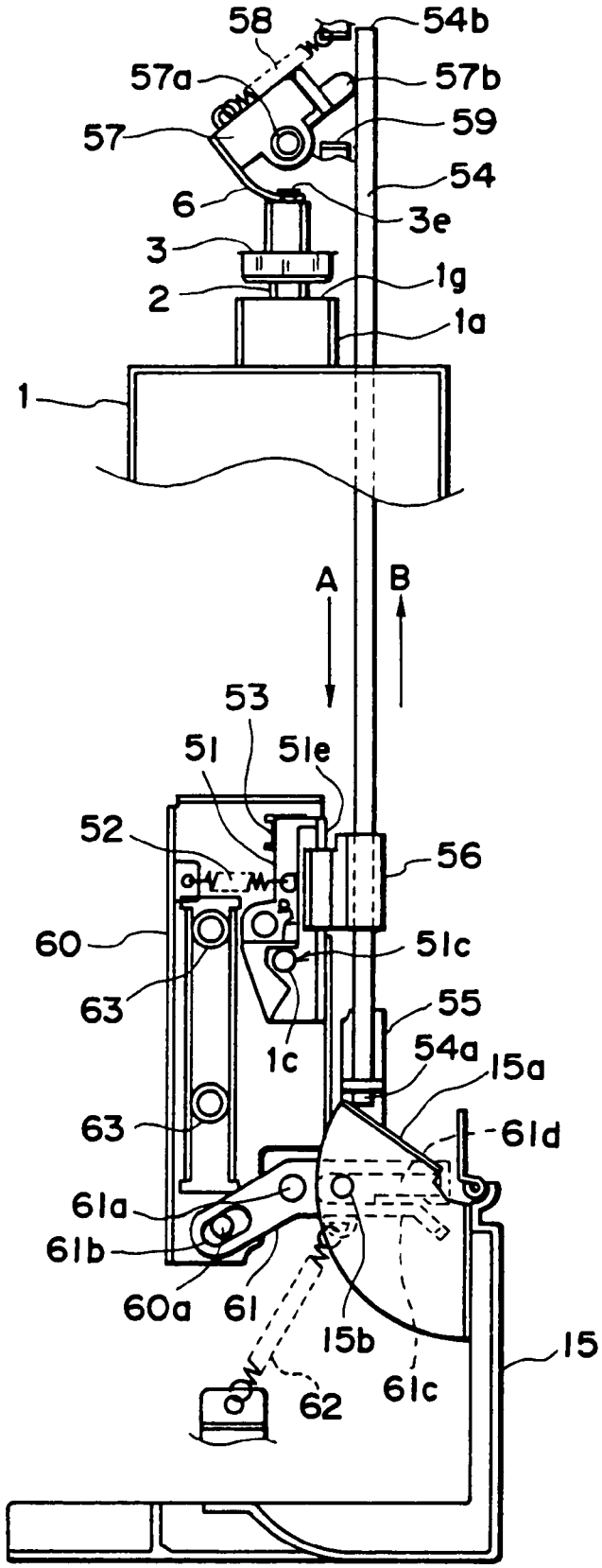
FIG. 9 illustrates toner supply port opening and closing means and the parts therearound when the cover is closed.

Referring to FIGS. 8 and 9, a description will be provided as to opening and closing operations of the toner supply port 1*g*, which are interrelated with the opening and closing operation of the cover 15. The structures in the following description are provided in the main assembly 100 of the apparatus. In FIGS. 8 and 9, designated by 6 is a locking member functioning as locking means for locking the sealing member 3 by engagement with the locking projection 3*e* of the coupling engaging portion 3*c*. Designated by 57 is a supporting table having the locking member 6 mounted thereto, and the supporting table 57 is rotatable about a rotation shaft 57*a*, and is urged in the clockwise direction by the urging member 58. Designated by 59 is a stopper for positioning the supporting table 57.

Designated by 60 is a slide table which is slidable by a rotatable roller 63. Designated by 51 is a container chucking member provided on the slide table 60, and the container chucking member 51 is rotatable about the rotation center 51*a*, and is urged in the counterclockwise direction by a spring 52. Designated by 53 is a stopper for positioning the container chucking member 51.

The toner supply container moving member is constituted by the container chucking member 51 and the slidable table 60. The toner supply port opening and closing means is constituted by the container chucking member 51, the slide table 60 and the locking member 6.

On the other hand, the container chucking member 51 is provided with a locking portion 51*c* for locking the engaging projection 1*c* of the main body 1A of the container. When the engaging projection 1*c* advances in the direction indicated by the arrow C as shown in FIG. 8 upon the insertion of the toner supply container 1 into the main assembly 100 of the apparatus, the container chucking member 51 rotates against the elastic force of the spring 52 in the direction of the arrow D. When the engaging projection 1*c* enters the locking portion 51*c*, the chucking member 51 returns by the elastic force of the spring 52 to lock the engaging projection 1*c*. When the chucking member 51 locks the engaging projection 1*c*, the toner supply container 1 is movable by the slide table 60 in the mounting-and-demounting directions (arrows A and B in FIGS. 7, 8).

Designated by 54 is a slide shaft which is supported by supporting means (unshown) for sliding motion in the axis direction. The slide shaft 54 is urged in the direction away from the supporting table 57 (downward direction in FIG. 8) as indicated by arrow A by urging member (unshown). The position thereof is determined by the shaft stopper 55.

Designated by 56 is a locking member mounted to the slide shaft 54. When the slide shaft 54 slides in the direction of the supporting table 57 as indicated by the arrow B, the locking member 56 is brought into engagement with the rib portion 51*e* of the container chucking member 51 to lock the container chucking member 51. The arrow A direction is the direction of demounting the supply container 1 from the main assembly 100 of the apparatus, and the arrow B direction is the direction of mounting it to the main assembly of the apparatus.

The slide table 60 is provided with a projection 60*a* formed therein. The projection 60*a* is engaged with an elongated hole 61*b* formed at one end portion of a swingable arm 61 which is swingable about a swing shaft 61*a*. The swingable arm 61 is urged in the clockwise direction by the elastic force of the urging member 62, and is positioned by the stopper 64. The other end portion of the swingable arm 61 is provided with a groove portion 61*d* having one open end.

The cover 15 is provided with a projection 15*b* which enters the groove portion 61*d* when the cover 15 is closed. By the projection 15*b* entering the groove portion 61*d*, the swingable arm 61 is swung in the counterclockwise direction against the elastic force of the urging member 62 in interrelation with the closing operation of the cover 15.

The cover 15 for exchange is provided with a wall portion 15*a* which abuts one end portion 54*a* of the slide shaft 54 when it is closed. By the wall portion 15*a*, the slide shaft 54 slides in the direction of the arrow B in interrelation with the closing operation of the cover 15. By the slide of the slide shaft 54 in such a manner, the other end 54*b* of the slide shaft 54 is abutted to the projection 57*b* of the supporting table 57. By this, the supporting table 57 and the locking member 6 rotate against the elastic force of the urging member 58, by which the locking member 6 locks the locking projection 3*e* of the sealing member 3.

With such structures, when the toner supply container 1 is inserted into the main assembly 100 of the apparatus as shown in (C) of FIG. 7, the engaging projection 1*c* of the main body of the container moves in the direction of the arrow C shown in FIG. 8. Thereafter, the engaging projection 1C is locked with the locking portion 51*c* of the container chucking member 51, and the fresh or new toner supply container 1 is mounted to the main assembly 100 with this state. In other words, the toner supply container 1 is correctly positioned in the main assembly 100 of the apparatus by the engaging projection 1C.

After the toner supply container 1 is thus mounted, the cover 15 is closed, and by this, the wall portion 15*a* of the cover 15 abuts one end portion 54*a* of the slide shaft 54, so that slide shaft 54 slides in the direction of the arrow B. Thereafter, the other end 54*b* of the slide shaft 54 abuts the projection 57*b* of the supporting table 57. By this, the supporting table 57 and the locking member 6 are rotated against the elastic force of the urging member 58, by which the locking member 6 locks the locking projection 3*e* of the sealing member 3.

The locking member 56 of the slide shaft 54 moves toward the container chucking member 51 with the sliding motion of the slide shaft 54 and engages with the rib portion 51*e* of the container chucking member 51. By doing so, the container chucking member 51 is locked.

When the cover 15 is closed to a predetermined position, the projection 15*b* of the cover 15 enters the groove portion 61*d* of the swingable arm 61 to swing the swingable arm 61 in the counterclockwise direction against the elastic force of the projection 15*b*. By the swinging of the swingable arm 61, the slide table 60 slides in the direction of the arrow A. By this, the toner supply container 1, which is locked by the container chucking member 51 at the engaging projection 1*c*, also slides in the same direction.

When the supply container 1 moves in the direction of the arrow A, the sealing member 3 is locked by the locking member 6 so that it is unable to move in the direction of the arrow A. Therefore, the main body 1A of the container is separated away from the sealing member 3, thus opening the toner supply port 1*g* as shown in FIG. 9. The toner supply port portion 1*a*, as shown in FIG. 5, is held by a holder 5 of the main assembly 100 with the outer periphery being sealed with an annular seal member 7. Therefore, when the supply container 1 is mounted to the main assembly 100, the position thereof is determined by the engaging projection 1C and the toner supply port portion 1*a*. In this embodiment, the sealing member 3 is supported at a position away from the toner supply port 1*g*. By doing so, it can be kept at a position away by a distance necessary to permit smooth discharge of the toner, depending on the coagulation property of the toner. Thus, plugging adjacent the discharging outlet and various problems resulting therefrom can be avoided.

On the other hand, when the user opens the cover 15 after the toner in the toner supply container 1 is substantially entirely consumed, the projection 15*b* of the cover 15 is moved from the position shown in FIG. 9 to be abutted to the wall portion 61*c* of the swingable arm 61 to swing the swingable arm 61 in the clockwise direction. Then, the slide table 60 slides in the direction of the arrow B, and the toner supply container 1 slides in the same direction.

At this time, the container chucking member 51 receives a force in the clockwise direction from the engaging projection 1*c* of the toner supply container 1. However, since the locking member 56 locks rotation of the container chucking member 51, the engaging projection 1*c* is prevented from disengaging from the container chucking member 51. Therefore, the toner supply container 1 slides until the toner supply port 1*g* abuts the flange portion 3*f* of the sealing member 3, by which the toner supply port 1*g* is closed.

Then, the cover 15 is further opened, the slide shaft 54 is moved to a predetermined position determined by the shaft stopper 55 since it is urged in the direction of arrow A by the urging means as described hereinbefore. With this, the locking member 6 rotates in the clockwise direction to be away from the sealing member 3. Therefore, the sealing member 3 is released by the locking member 6. The container chucking member 51 is released from locking of the locking member 56.

With this state, the toner supply container 1 is removable from the main assembly 100. Then, the toner supply container 1 can be taken out by pulling it in the direction of the arrow A. By application of the pulling force in the direction of arrow A, the locking of the engaging projection 1*c* by the container chucking member 51 is released.

As described hereinbefore, when the toner supply container 1 is mounted to the main assembly 100, the locking projection 3*e* of the sealing member 3 is locked by the locking member 6 and is supported away from the toner supply port 1*g* of the toner supply container 1. At this time, the engagement relation in the rotational direction between the sealing member 3 and the feeding member 2 is maintained.

When the toner supply port 1*g* is unsealed, the sealing member 3 becomes rotatable so that the main assembly 100 can rotate the sealing member 3.

Therefore, by the rotation received by the sealing member 3 from the main assembly 100, the feeding member 2 rotates to supply the toner gradually to the main assembly 100 through the toner supply port 1*g*. In the embodiment, a toner detection sensor 201*g* is provided on the toner hopper. When the detecting sensor 201*g* detects that there is no toner, the sealing member 3 rotates. When the detecting sensor 201*g* detects the presence of the toner, the rotation of the sealing member stops. In this manner, the sealing member 3 intermittently rotates in accordance with the consumption of the toner in the main assembly 100, so that toner is intermittently and gradually supplied into the main assembly 100. However, it is possible to supply all of the toner into the main assembly 100 when the toner supply container 1 is mounted to the main assembly 100.

On the other hand, when the toner supply container 1 is mounted to the main assembly, the coupling engaging portion 3*c* of the sealing member 3, as shown in FIG. 5, is engaged with the coupling member 4 of the main assembly 100. The coupling member 4 functions to transmit, to the sealing member 3, the driving force of the driving device (unshown) provided in the main assembly 100.

Figure 10A:
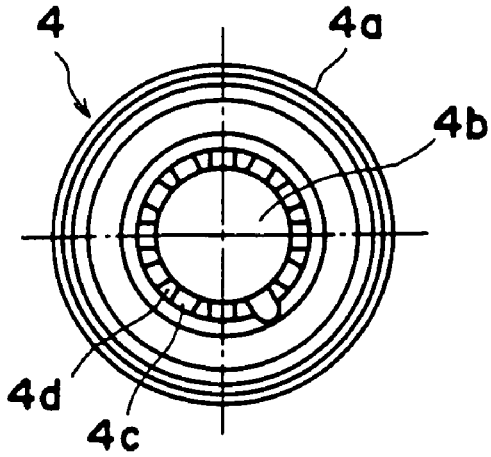
Figure 10B:
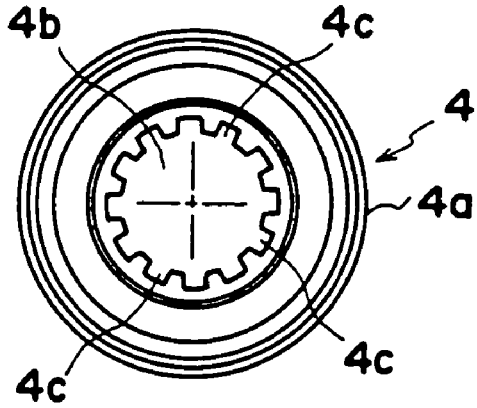
Figure 10C:
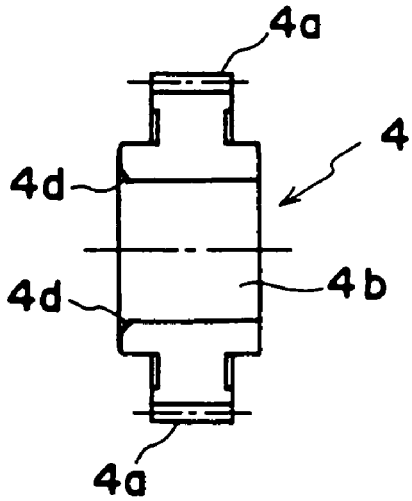

FIG. 10 shows in detail the coupling member, wherein (A) is a front view of the coupling member, and (B) is a rear side view, and (C) is a sectional side view. In FIG. 10, designated by 4*a* is a gear portion formed at the outer surface of the coupling member 4. It receives the driving force from the main assembly 100 side through the gear portion 4*a*.

Designated by 4*b* is a receiving hole for receiving the sealing member 3, and it is formed at the center of the coupling member 4. The inner surface of the hole 4*b* is provided with an engaging groove 4*c* for engagement with the spline projections 3*d* of the sealing member 3. The end of the hole 4*b* opposed to the toner supply container 1 is provided with a tapered guiding portion 4*d*.

In this embodiment, four of such spline projections 3*d* are formed on the outer curved surface of the sealing member 3, equidistantly. Additionally, twelve engaging grooves 4*c* are formed in the coupling member 4. The number of the engaging grooves 4*c* is larger than the number of the projections 3*d*, and guiding portions 4*d* are provided, so that when the toner supply container is mounted to the main assembly, they can be assuredly engaged even if a phase difference exists between the spline projections 3*d* and the engaging grooves 4*c*. The number of the projections 3*d* of the sealing member 3 is not limited to four, but may be properly selected by one skilled in the art. The same applies to the number of the engaging grooves 4*c*, and is not limited to 12.

A description will be provided as to discharging of the toner.

The coupling member 4 receives the rotation force through the drive transmitting means (unshown) such as a gear or the like from the driving source, (unshown) such as a motor or the like, of the main assembly 100. The driving force is transmitted to the sealing member 3 through the engagement between the spline projection 3*d* and the engaging groove 4*c*, and is transmitted to the feeding member 2 through the engagement between the H-shaped free end 2*a* and the H-shaped engaging hole 3*a*. In this embodiment, the rotational speed of the feeding member 2 is 25 rotations per minute.

When the feeding member 2 is rotated, the toner accommodated in the main body 1A of the container is fed toward the toner supply port 1*g*, and thereafter, falls from the toner supply port 1*g* into the toner hopper 201*a* through the toner receiving port 9 of the main assembly 100. The portion from the toner supply port 1*g* to the toner receiving port 9 is hermetically sealed by the seal member 7 as described hereinbefore, and therefore, the toner discharged from the toner supply port 1*g* is prevented from leaking to the outside or from scattering.

A rotational sliding portion exists at a portion where the sealing member 3 and the main assembly 100 are contacted, but the portion is away from the toner supply port portion 1*a*, and therefore, it does not directly contact the toner, so that coagulation of the toner or the like does not result. The position of the rotational sliding portion can be away from the toner supply port portion 1*a* by a proper distance in accordance with the flowability of the toner, the feeding power of the feeding member 2, and the discharging speed of the toner.

The present invention is not limited to any detail of the first embodiment.

For example, the disengagement method of the sealing member 3 may be such that main body 1A side is moved while the sealing member 3 is fixed, or may be such that sealing member 3 is moved while the main body 1A of the container is fixed. However, the sealing member 3 is given the rotation force from the main assembly 100 as described hereinbefore. Therefore, when the sealing member 3 is moved while fixing the main body 1A of the container, the mechanism is more complicated, and therefore, the sealing member 3 is preferably fixed.

The rotational speed of the feeding member 2 is properly selected by one skilled in the art in accordance with the toner feeding amount, but if it is too high, the loads of the driving source of the main assembly 100 or the drive transmission mechanism are increased, and if it is too low the toner cannot be sufficiently fed. Preferably, it is 3-100 rotations per minute, and further preferably, 5-50 rotations per minutes.

The configuration of the main body 1A of the container may be any shape if the space can be effectively used, and the size and capacity of the toner container can be selected properly by one skilled in the art. Even if the toner amount is as large as approximately 2 kg, for example, what is rotated is only the feeding member 2, and therefore, the required rotation torque is as small as 2-3 kgf-cm. The sealing member 3 is press-fitted into the toner supply portion 1*a*, but a seal member may be used to seal the portion, or a threaded portion corresponding to the main body 1A and the sealing member 3 may be used to seal the portion.

Figure 11A:
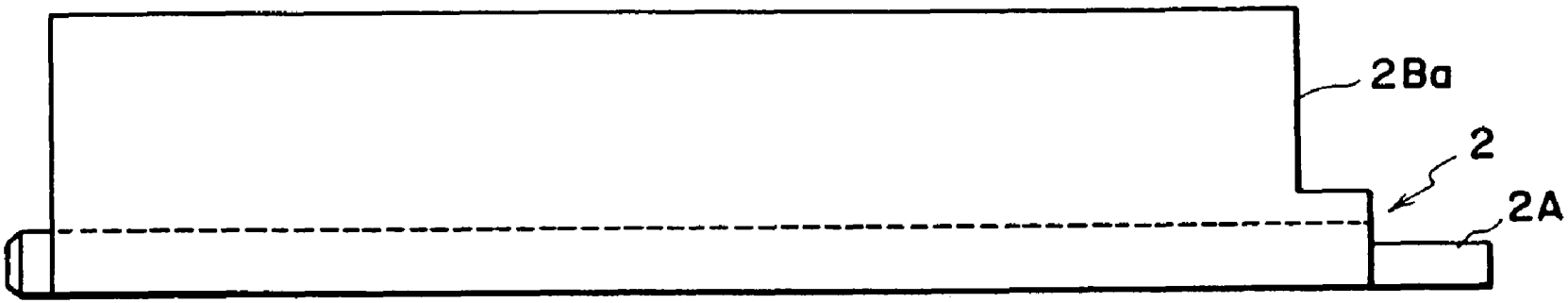
Figure 11B:
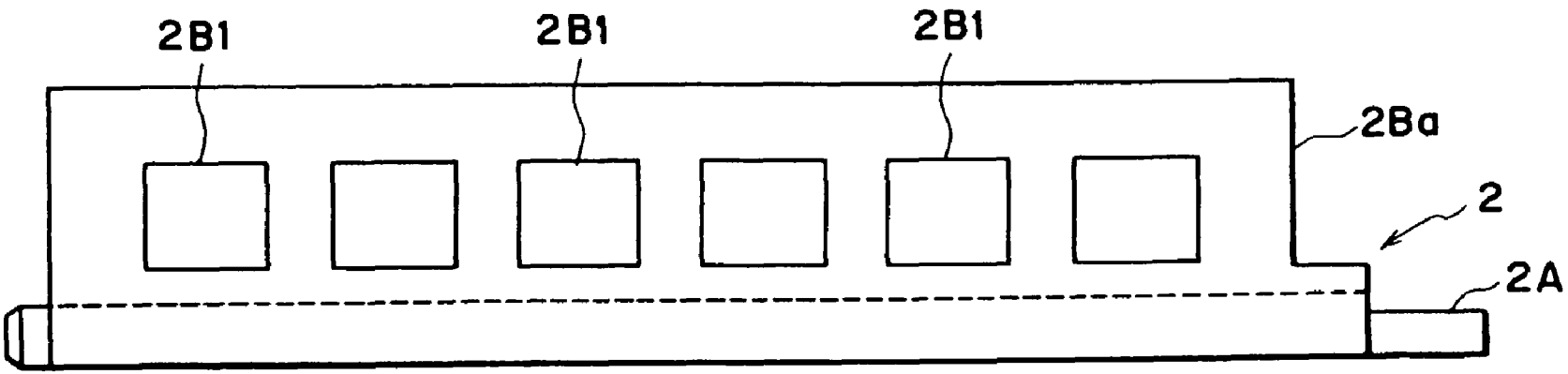

In the first embodiment, the feeding element of the feeding member 2 is of a helical shape which has a high feeding power, but the helical shape is not inevitable. For example, as shown in FIG. 11, (A), a blade portion 2Ba in the form of a film as a feeding element may be mounted on the shaft portion 2A. In such a case, the toner is discharged using the flowability of the toner. As shown in FIG. 11, (B), the blade portion 2Ba may be provided with a window 2B1 by which the driving torque of the feeding member 2 can be reduced.

A second embodiment of the present invention will be described wherein the toner supply container 1 has a feeding member 2 provided with such a blade portion.

Figure 12:
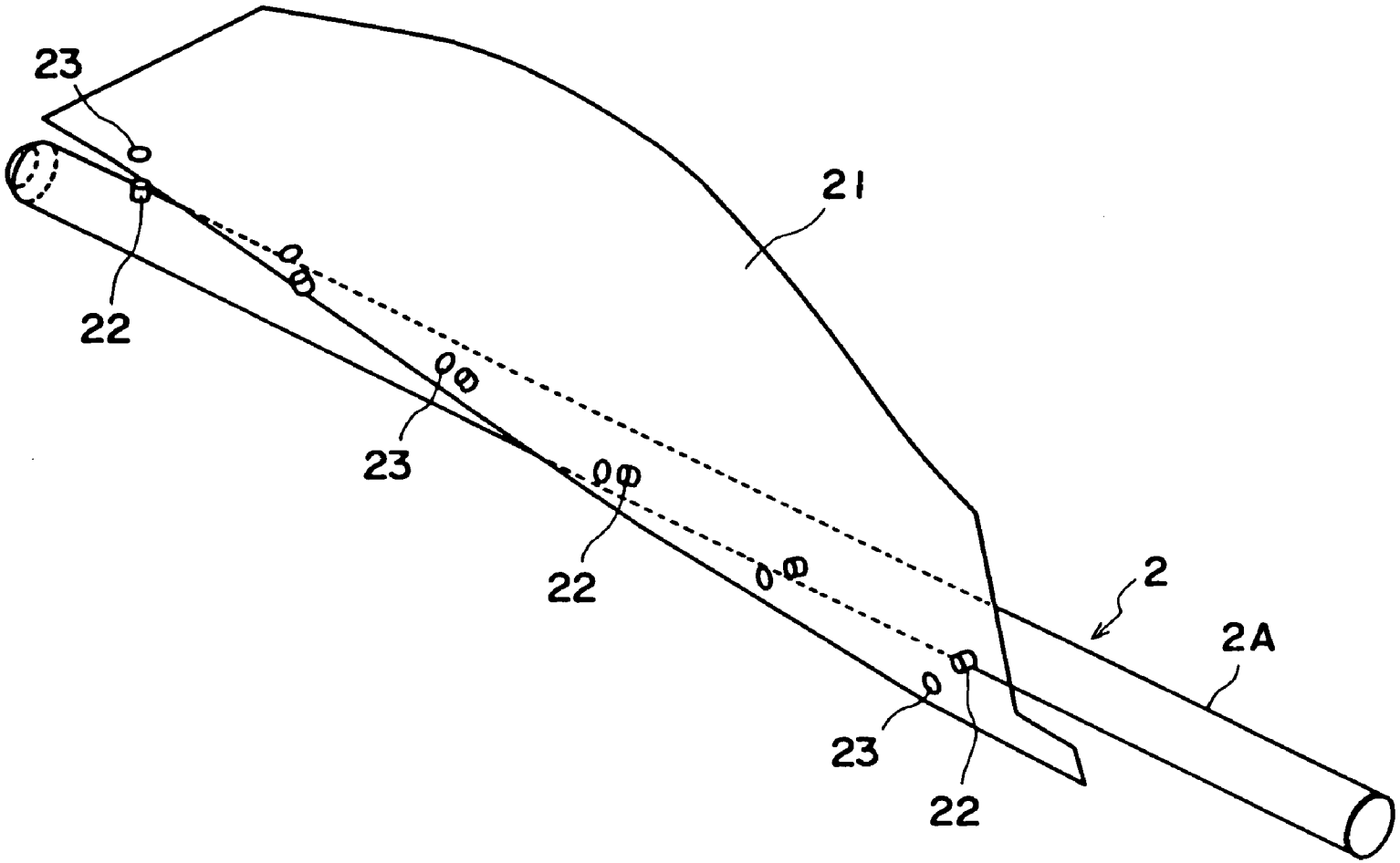
FIG. 12 is a perspective view of a feeding member of a toner supply container according to a second example of the first embodiment of the present invention.

FIG. 12 is a perspective view of the feeding member 2 for the toner supply container according to the second embodiment. In this figure, designated by 21 is a blade portion of the feeding member 2 mounted such that the phase thereof is continuously changed in the axial direction of the shaft portion 2A. The feeding member 2 provided with such a blade portion 21 is preferably formed integrally through injection molding or the like, but may be divided into two or more parts which are unified by welding or bonding or the like.

As a material of the shaft portion 2A when the feeding member 2 is divided into two parts, there are plastic resin material, metal or the like having a rigidity. The blade portion 21 is preferably made of a sheet material having flexibility and more particularly, a single layer material or multiple layer material of polyester, polypropylene, Nylon, polyethylene or fluorine resin material. The thickness of the blade portion 21 is preferably approximately 50 μm-1 mm.

In this embodiment, a polyester sheet having a thickness of 188-250 μm is satisfactorily used.

The configuration of the blade portion 21 is not necessarily a particular shape such as a trapezoidal shape, but what is needed is that the length from the center of rotation of the shaft portion 2A to the free end of the blade portion 21 is substantially constant along the total length of the blade portion 21 (as with rectangular configuration for example). From the standpoint of the assembling property of the feeding member 2, the blade portion 21 is an integral member along its entire length.

Therefore, an integral blade portion 21 is preferable, and by doing so, the material can be efficiently used since the blade portion 21 can be cut out from a blank. When the toner is caked in the main body 1A of the container as a result of the main assembly 100 being kept unused for a long term, the toner can be continuously scraped off and efficient toner discharging is accomplished when the blade portion 21 is integral.

A description will be provided as to the mounting method of the blade portion 21 to the shaft portion 2A.

When the feeding member 2 is constituted by the shaft portion 2A and the blade portion 21, it is required that the blade portion 21 is mounted to the shaft portion 2 with a twist relative to the axial direction of the shaft portion 2A so that the phase is continuously changed relative to the axial direction of the shaft portion 2A.

As for the mounting method, as shown in FIG. 12, the drum portion of the shaft portion 2A is provided with crimp bosses 22 at several portions to permit mounting of the blade 2B. On the other hand, the blade portion 21 is provided with a crimp hole portion 23 for receiving the crimp bosses 22 of the shaft portion 2. The crimp bosses 22 are engaged in the crimp hole portions 23, and they are coupled and unified by a heat crimp or an ultrasonic crimp.

Figure 13:
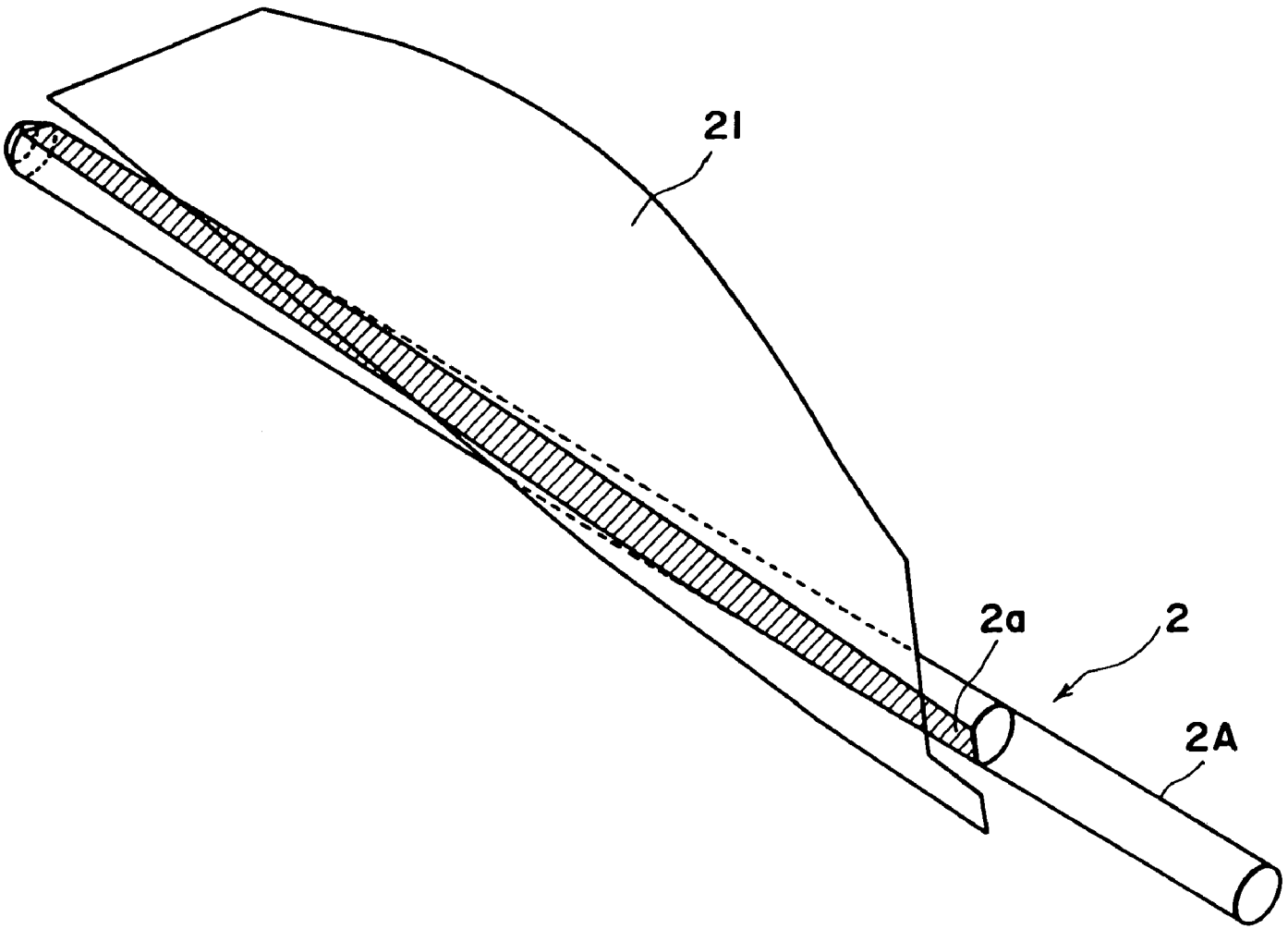
FIG. 13 illustrates an example of assembling of the feeding member according to the first embodiment.

On the other hand, when the blade mounting surface of the shaft portion 2A is twisted relative to the axial direction, as shown in FIG. 13, the mounting surface 2*d* (hatched portion) of the blade portion 21 of the shaft portion 2 is continuously changed with respect to the axial direction of the shaft portion 2A. Then, the blade portion 21 is mounting to and unified with the shaft portion by adhesive material or double coated tape or the like on the surface 2*d*.

In any of the types, it is preferable that the phase difference of the blade portion 21 relative to the axial direction is approximately 90 degrees.

Referring to FIGS. 14-1 through 14-5, the toner discharging operation of the feeding member 2 having the above-described structures will be described.

By rotation, through 0-360 degrees, of the shaft portion 2A of the feeding member 2 in the direction of arrow A in FIG. 14-1, the entirety of the feeding member 2 sequentially rotates in the order of FIG. 14-1->FIG. 14-2->FIG. 14-3->FIG. 14-4->FIG. 14-1. During the rotation FIG. 14-1->FIG. 14-2, the blade portion 21 is flexed and curved while entering the space formed between the inner lower surface of the main body lA of the container and the shaft portion 2A. The blade portion 21 rotates through (2)->(3)->(4) while rubbing the inner lower surface of the main body lA of the container.

At this time, since the phase of the blade portion 21 continuously changes in the direction of the axis of the shaft portion 2A, the degrees of flexing of the blade portion 21 are different between the axial ends of the blade portion. Therefore, the toner feeding function in the axial direction of the shaft portion 2A is produced, so that toner is fed in the longitudinal direction (lateral direction of the main assembly) of the main body 1A of the container.

Since the blade portion 21 contacts the inner lower surface of the main body 1A of the container, the toner can be effectively fed even when the toner amount in the main body 1A of the container decreases, and as a result, the remainder toner amount can be reduced after the end of the toner discharge therefrom.

Furthermore, the toner is fed toward the discharging outlet by the spring-back action of the blade portion 21 at the time of FIG. 14-4 to FIG. 14-1. Thus, in addition to the toner feeding effect by the flexibility of the blade portion 21 at the time of contact thereof to the inner lower surface of the main body 1A of the container, the spring-back effect of the blade portion 21 further feeds the toner, and therefore, the toner can be further efficiently fed.

As shown in FIG. 14-5, by providing a sufficient length from the shaft portion 2A to the free end of the blade portion 21, caked toner T1 can be uncaked by the elasticity of the blade portion 21. Thus, this embodiment is usable with a container of the type wherein the height of the main body lA is so large that the toner supply port portion 1*a* takes a position below the main body lA of the container, so that the latitude is enhanced to reduce the limit to the configuration, by which the space in the main assembly of the image forming apparatus can be effectively utilized.

Toner discharging experiments have been carried out using the toner supply container 1 of the above-described structure, and it was confirmed that a stable toner discharging property (toner discharging amount per unit time) was accomplished, and the remainder toner amount in the container after the end of the discharge was as small as approximately 10 g. The initial torque required for the rotation of the feeding member 2 was approximately 2 kgf-cm. In the experiments, the blade portion 21 of the feeding member 2 was made of a polyester sheet having a thickness of approximately 188 μm, and was mounted to the shaft portion 2A of ABS resin material-using a double coated tape. The main body 1A of the container contained approximately 1,500 g of the toner, and the feeding member 2 was rotated at the speed of rotational frequency approximately 30 rotations per minute to discharge the toner.

The rotational speed of the feeding member 2 was changed in the range of 20-50 rotations per minute, and the discharging property change was checked, and it was found that the toner discharging amount per unit time increased with increase of the rotational speed. It therefore was found that the toner discharging amount per unit time can be controlled by controlling the rotational speed of the feeding member 2.

As a case of caked toner in the main body 1A of the container, the main body 1A of the container was tapped after the toner was filled, and thereafter, the discharging experiments were carried out. More particularly, the container filled with the toner, was fixed on a tapping table with the same pose of the container as in the toner discharge, and the tapping table was let fall 1000 times from the height of 10 mm and with the frequency of 2 Hz.

As a result, the toner discharging property and the remainder toner amount were substantially the same as with the experiments without the tapping, so that it was confirmed that toner can be effectively discharged while uncaking the caked toner. The required initial torque for the rotation of the feeding member 2 is slightly higher (approximately 5 kgf-cm), but it is not so high that the driving source is overloaded.

The rotation torque is a maximum when the blade portion 21 enters the caked toner (between (1) and (2) in FIG. 14). When the feeding member 2 has such a structure that the phase of the blade portion 21 in the axial direction is changed, the timing of the blade portion 21 entering into the toner is different in the axial direction, so that rotation torque can be reduced.

In this embodiment, the phase of the blade portion 21 is changed in the axial direction, and therefore, even if a part of the blade portion 21 is in the state shown in FIG. 14, (3), the state of (1) in FIG. 14 exists in another portion, so that blade portion 21 is prevented from winding around the shaft portion 2A.

Thus, according to the present invention, the blade portion is prevented from winding around the shaft portion.

Figure 16:
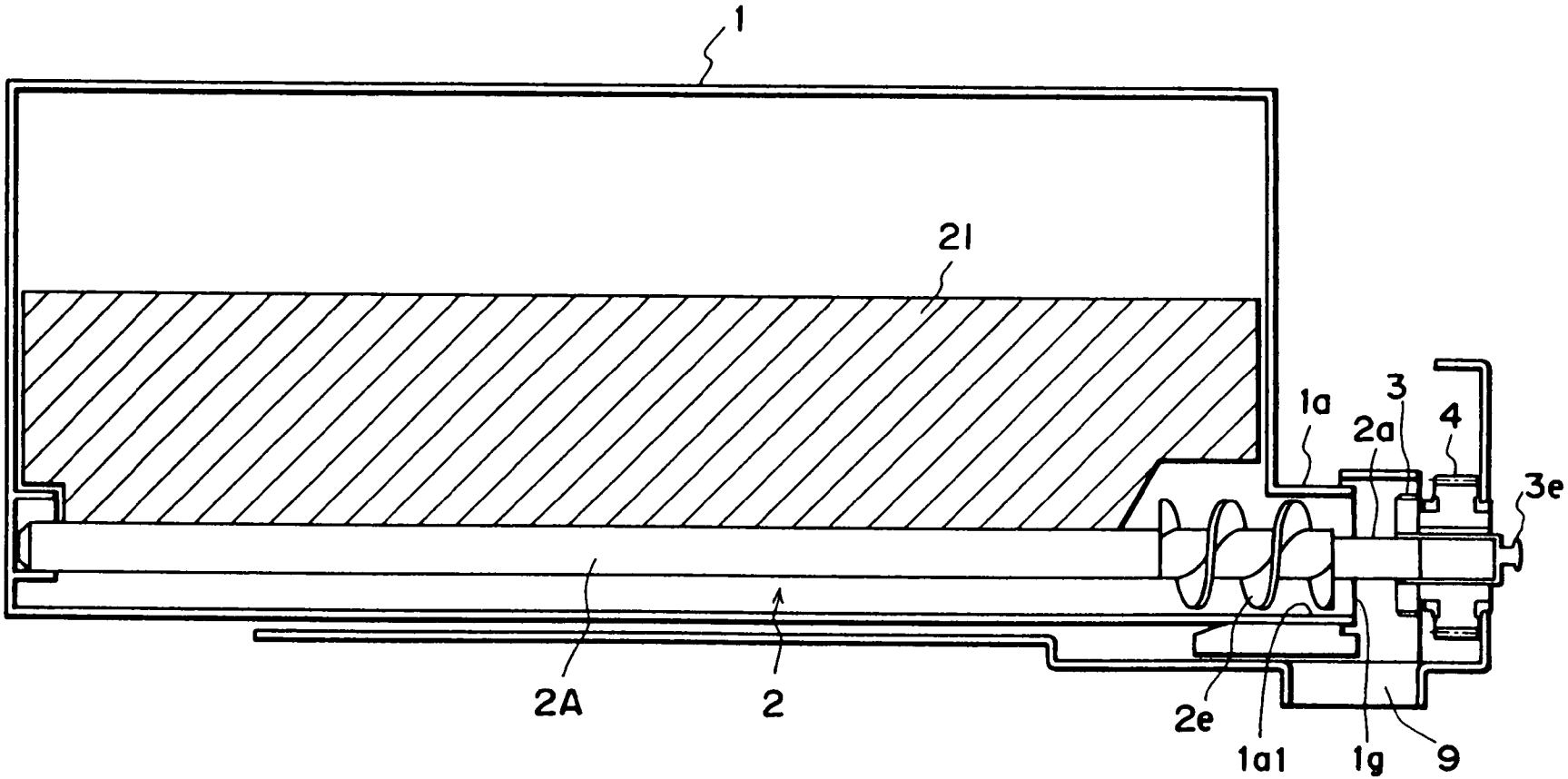
FIG. 16 illustrates a structure of the feeding member according to a second example of this embodiment.

FIG. 16 shows a feeding member 2 according to the second embodiment wherein a screw member 2*e* is added to the structure of FIG. 12 adjacent the toner supply port portion 1*a* of the feeding member 2. In the other respects, the structures of this embodiment is the same as that of the first embodiment, and the toner discharging experiments were carried out under the same conditions using the toner supply container 1 of the first embodiment.

As a result, the toner discharging property was better than in the first embodiment, and the remainder toner amount after the end of the toner discharge was approximately 10 g. As a result of the addition of the screw member 2*e*, the variation of the toner discharging amount was 5-10 g/min., which was better than 10-20 g/min. In the first embodiment, the improved stability of the toner discharging amount was confirmed. The required initial torque for the rotation of the feeding member 2 was approximately 4 kgf-cm.

The rotational speed of the feeding member 2 was changed in the range of 20-50 rotations per minute, and the change of the discharging property was checked, and it was found that the toner discharging amount per unit time increased with the increase of the rotational speed. It therefore was found that toner discharging amount per unit time can be controlled by controlling the rotational speed of the feeding member 2.

The toner discharging amount per unit time was stable from the initial stage to the final stage of the toner discharging when the toner was caked before the toner discharge by tapping the container and when the toner was uncaked by shaking the supply container 1 by the user before it is mounted to the main assembly 100 of the apparatus. For example, when the feeding member 2 is rotated at 36 rpm, the toner discharging amount was 70-100 g/min, irrespective of the state of the toner beforehand. When the toner is not caked and loose, toner having high flowability tends to rush into the discharging outlet (toner supply port 1*g*) and discharges at an unnecessarily high speed (flushing), but such a phenomenon does not occur with the embodiment of FIG. 16. This is because at least one full turn of the screw member 2*e* having the helical configuration is disposed in the cylindrical toner supplying portion 1*a* so that rushed toner can be properly stopped thereby.

Discharging experiments were carried out for the toner supply container 1 filled with the toner after it was tapped 1000 times. As a result, the toner discharging property and the remainder toner amount in the container were similar to the case without the tapping. The required initial torque for the rotation of the feeding member 2 is slightly higher (approximately 8 kgf-cm), but it is not so high that the driving source is overloaded.

Figure 17:
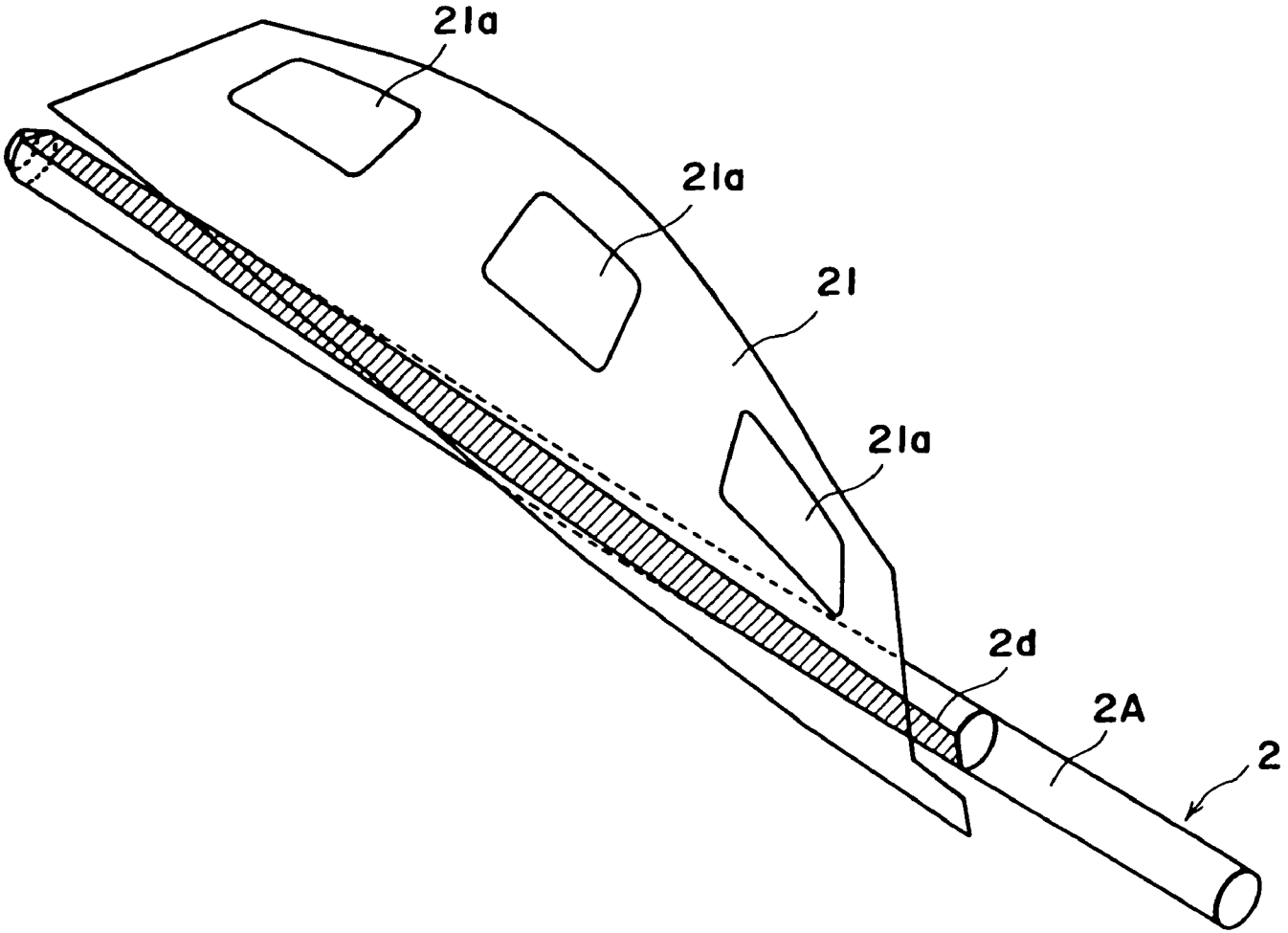
FIG. 17 illustrates a structure of the feeding member according to a third example of this embodiment.

FIG. 17 shows a structure wherein a part of the blade portion 21 of the feeding member 2 shown in FIG. 13 is removed to provide a window configuration 21*a*, according to a third embodiment of the present invention. With the provision of the window configuration 21*a*, the toner discharging experiments were carried out under the same conditions for the toner supply container 1 having the same structure as with the first embodiment except for the window.

As a result, the toner discharging property, and the remainder toner amount in the main body 1A of the container after the end of the discharge, were the same as with the first embodiment. The initial torque required by the rotation of the feeding member 2 when no tapping was carried out, was approximately 2 kgf-cm, which is the same as first embodiment. The required initial torque after the 1000 tappings, was decreased from approximately 5 kgf-cm, which is the torque without the window, to approximately 4 kgf-cm; the initial torque when the toner is agglomerated is decreased by the window.

Figure 18:
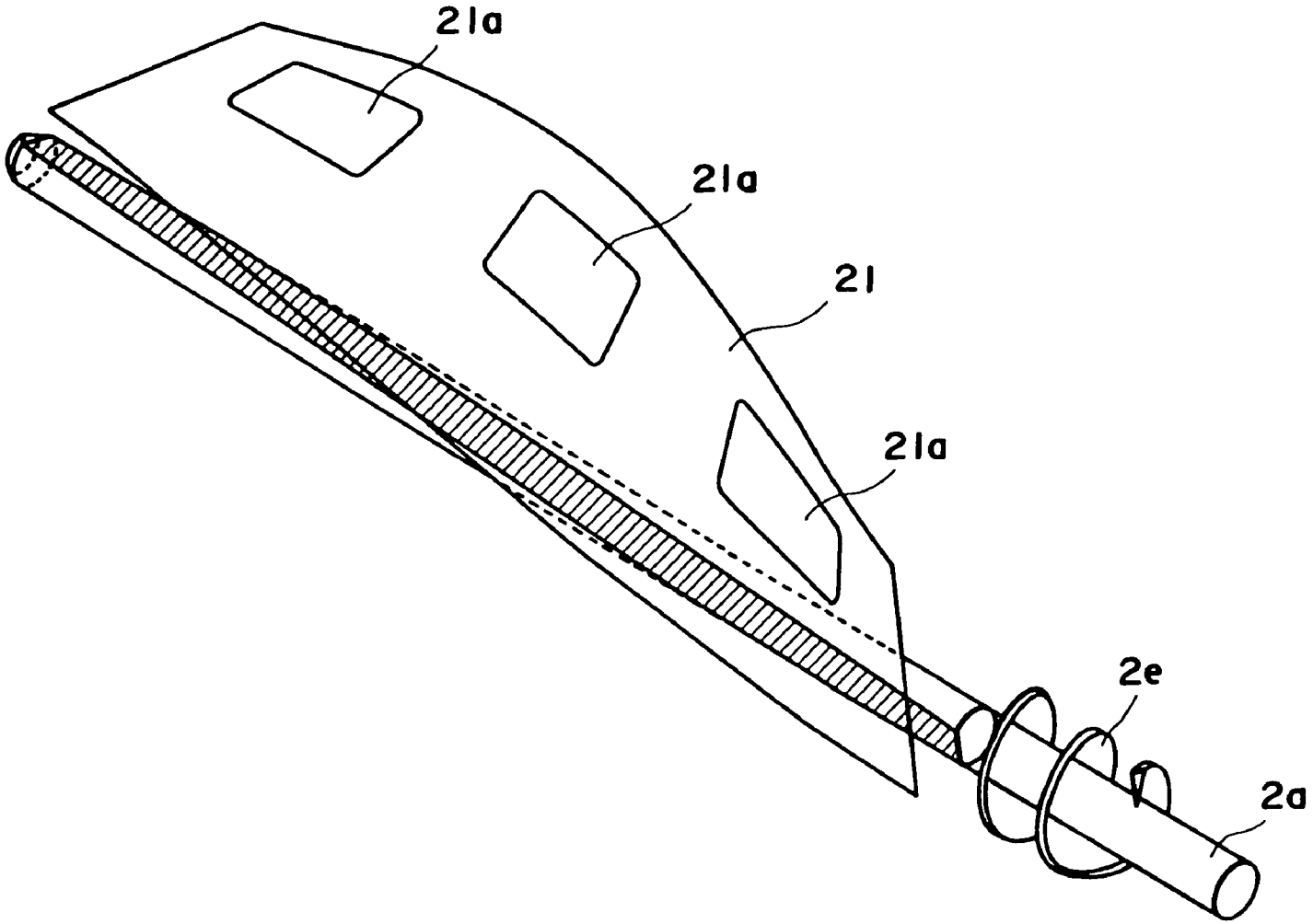
FIG. 18 illustrates a structure of the feeding member according to a third example of this embodiment.

FIG. 18 shows a structure of a feeding member 2 according to a fourth embodiment wherein a screw member 2*e* shown in FIG. 16 is added to the feeding member 2 shown in FIG. 17. The toner discharging experiments were carried out under the same conditions as with the first embodiment except for the provision of the screw member 2*e* and the window configuration 21*a*.

As a result, the toner discharging property was better than that with the third embodiment in stability, and the remainder toner amount in the container after the end of the discharge was equivalent to that of the third embodiment. The required initial torque without tapping was approximately 4 kgf-cm similarly to the second embodiment. The required initial torque after 1000 tappings decreased from approximately 8 kgf-cm without the window to approximately 6 kgf-cm.

Thus, by the provision of the blade portion 21 on the shaft portion 2A of the feeding member 2 in which the phase of the blade is continuously changed relative to the axial direction of the shaft portion 2A, the toner feeding function becomes more effective, and the toner amount remaining on the main assembly of the container can be reduced. Furthermore, by the provision of the windows at one or more portions of the blade portion 21, the required rotation torque can be reduced.

Figure 19:
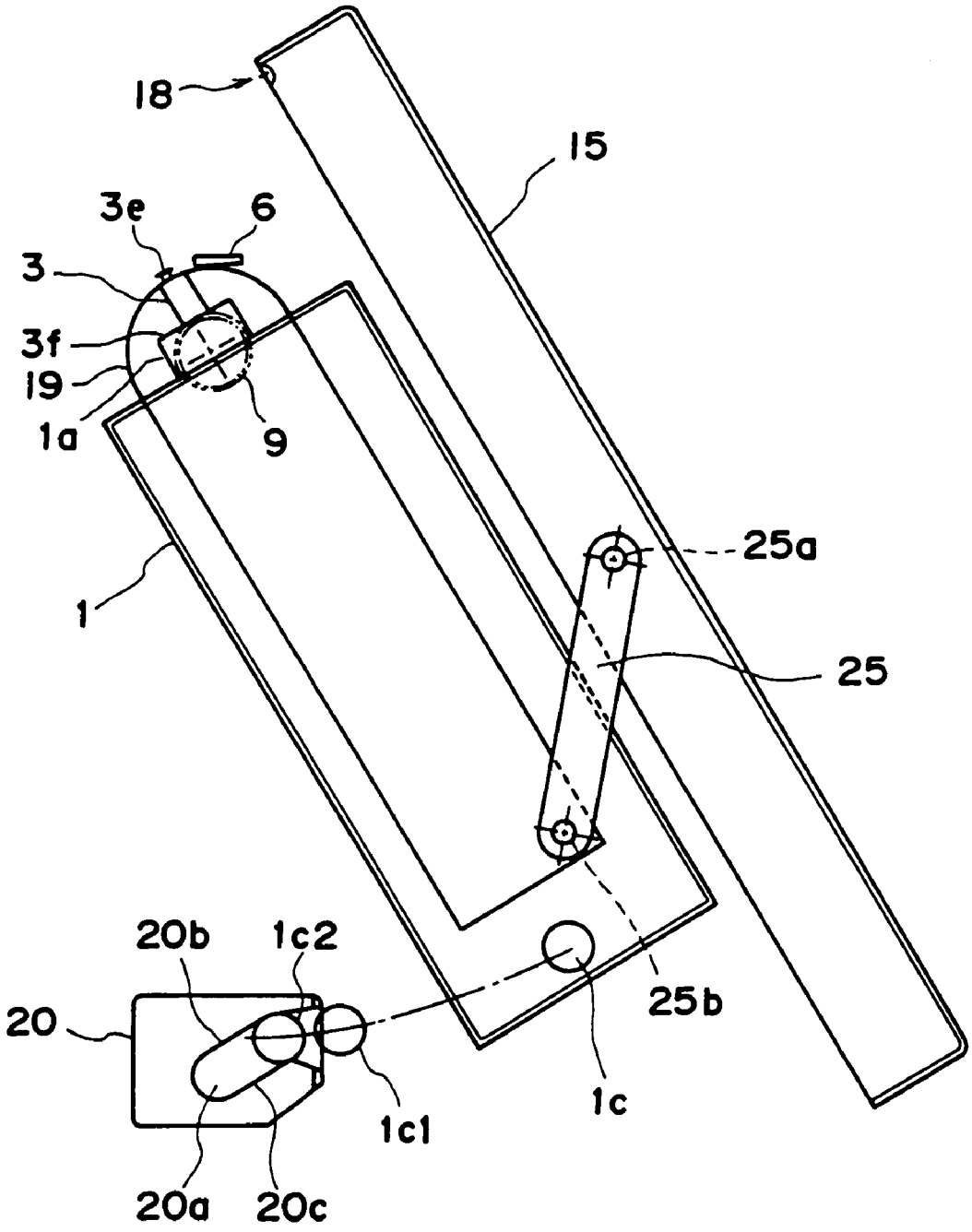
FIG. 19 illustrates the toner supply port opening and closing means and the parts therearound when the cover of the electrophotographic copying machine is open.

In this invention, the cover 15 for the exchange and the hinge portion 18 therefor can be provided at the positions shown in FIG. 19.

Figure 20:
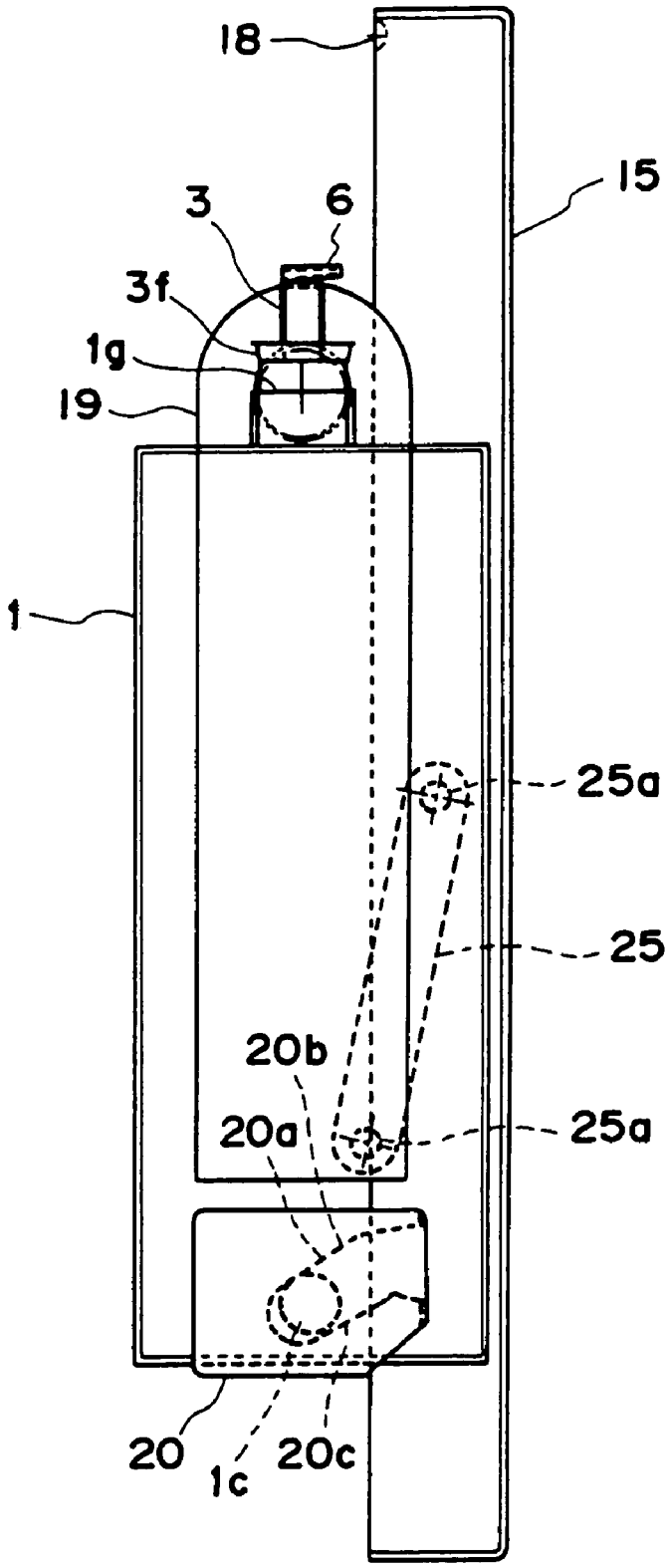
FIG. 20 illustrates the toner supply port opening and closing means and the parts therearound when the cover of the electrophotographic copying machine is closed.

Referring to FIGS. 19 and 20, the structure for opening and closing the toner supply port 1*g* by the motion of the exchanging cover provided at the position, will be described. FIG. 19 shows the state wherein the cover 15 is open, and FIG. 20 shows the state wherein the cover 15 is closed. In these figures, the same reference numerals as in FIG. 8 are assigned to the elements having the corresponding functions, and detailed descriptions thereof are omitted for simplicity.

In FIGS. 19, 20, designated by 19 is a toner supply container holding member having a center of rotation which is concentric with the toner receiving port 9, and the toner supply container 1 is mounted to the toner supply container holding member 19 upon the exchange operation. Designated by 20 is a guiding member provided with an engaging groove 20*a* which is engageable with an engaging projection 1*c* provided in the main body 1A, and is fixed in the main assembly 100 of the apparatus. Designated by 25 is a link for interrelating the cover 15 and the toner supply container holding member 19 at the connecting portions 25*a*, 25*b*. When the cover 15 is closed, the toner supply container holding member 19 is rotated to a position shown in FIG. 20 by the link 25.

With such a structure, when the user closes the cover 15 after the new toner supply container 1 is mounted on the toner supply container holding member 19, the toner supply container holding member 19 is rotated to the position shown in FIG. 20 by the link 25. With the rotation of the toner supply container holding member 19, the main body 1A of the container also rotates so that engaging projection 1*c* provided in the main body 1A moves through 1C-1C1-1C2 as shown in FIG. 19. Here, with the rotation of the main body 1A, the sealing member 3 rotates in the clockwise direction, and the locking projection 3*e* of the sealing member 3 is locked with the locking member 6 at a position where the engaging projection 1*c* reaches 1C1.

After the sealing member 3 is locked with the locking member 6, the cover 15 is further closed, and the engaging projection 1*c* enters the engaging groove 20*a* of the guiding member 20 and moves along the wall portion 20*b* of the engaging groove 20*a* in the direction away from the rotational center of the toner supply container holding member 19. By this, the main body 1A of the container is moved away from the sealing member locked with the locking member 6, so that toner supply port 1*g* is opened as shown in FIG. 20.

On the other hand, when the user opens the cover 15 in the state shown in FIG. 20, after substantially all of the toner in the toner supply container 1 is used up, the engaging projection 1*c* of the main body 1A moves along the wall portion 20*c* of the guiding member 20. With the movement of the engaging projection 1*c*, the main body 1A moves until the toner supply port 1*g* abuts the flange portion 3*f* of the sealing member 3, by which the toner supply port 1*g* is closed.

A third embodiment of the present invention will be described.

In this embodiment, a feeding member and a stirring member, which is a separate member from the feeding member, are provided.

Figure 21A:
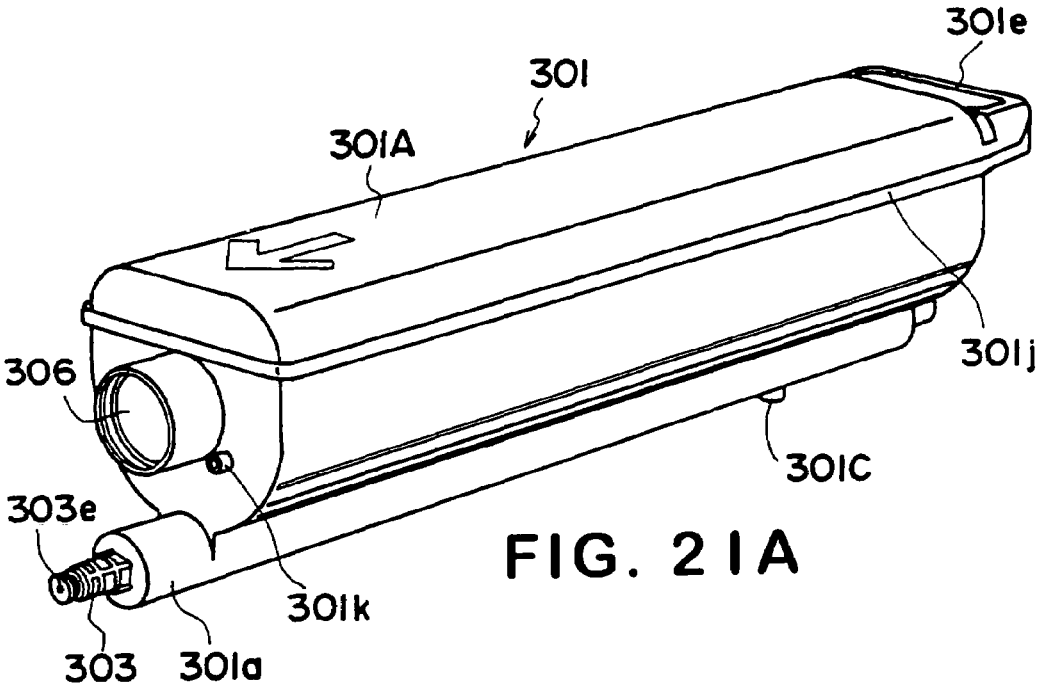
Figure 21B:
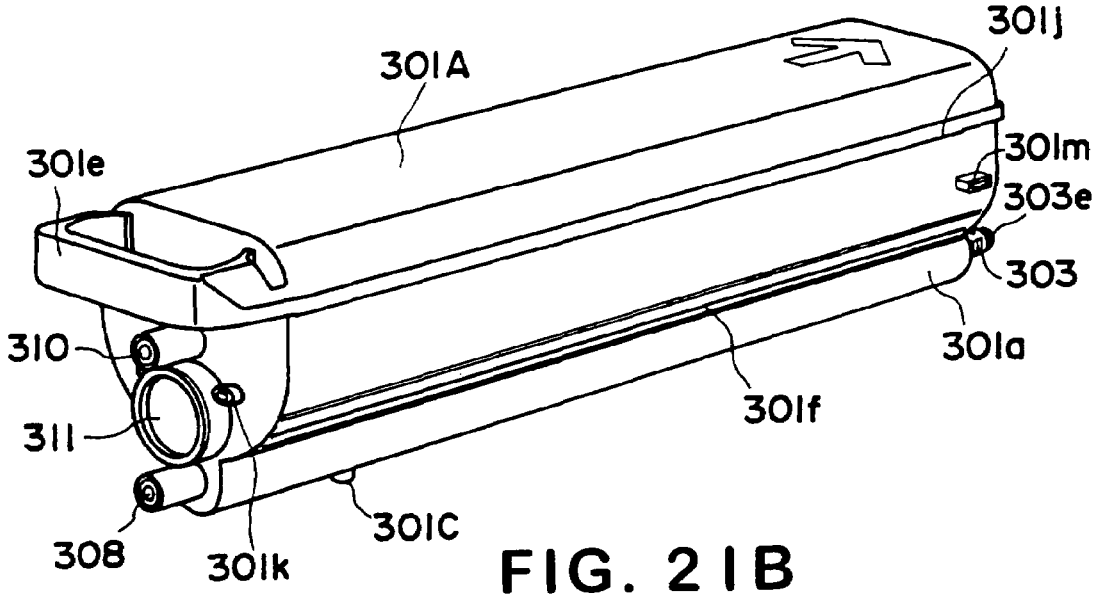

FIG. 21 is a perspective view of a toner supply container 301 according to the third embodiment of the present invention.

Figures 22A, 22B, 22C, 22D, 22E, 22F:
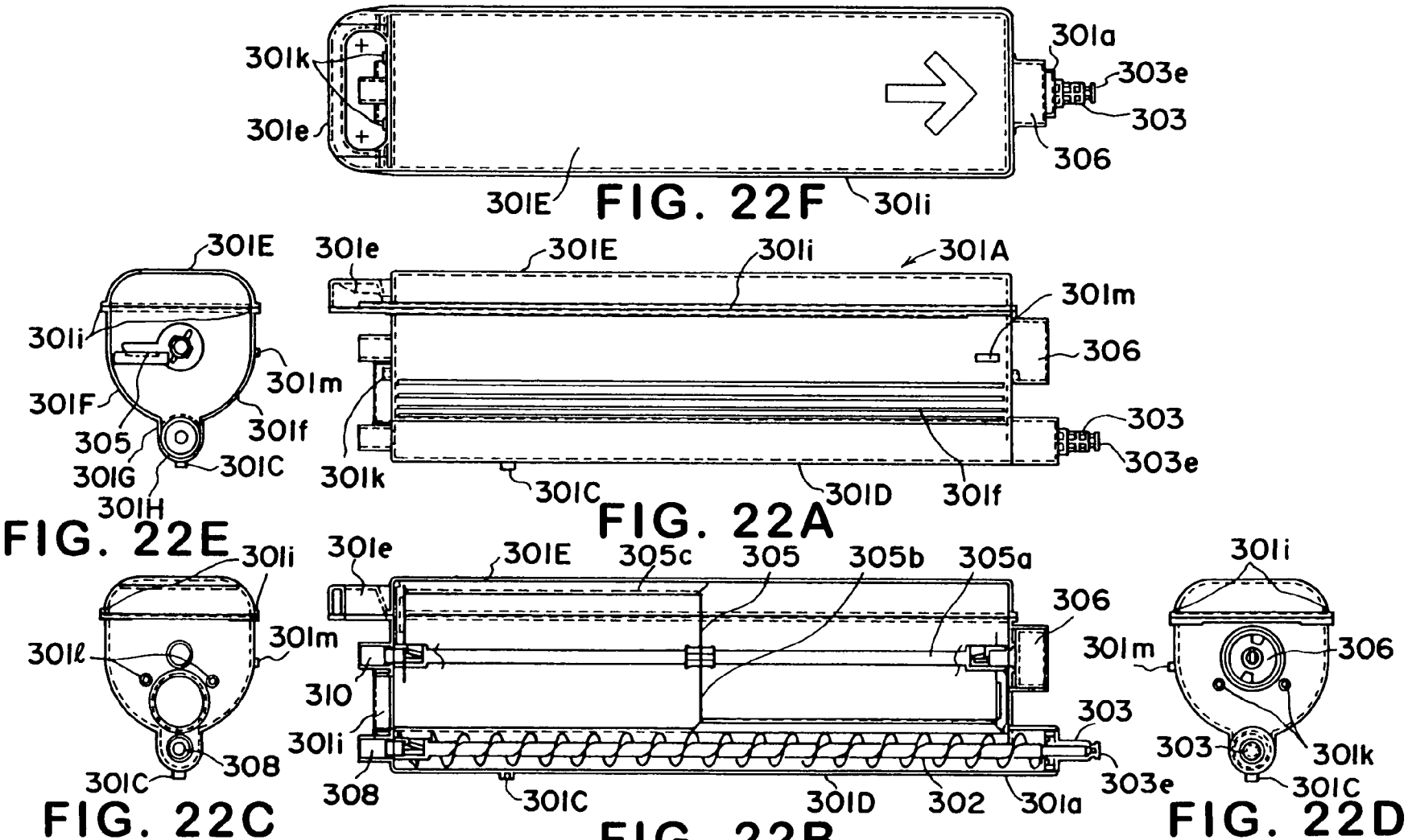
Figure 23:
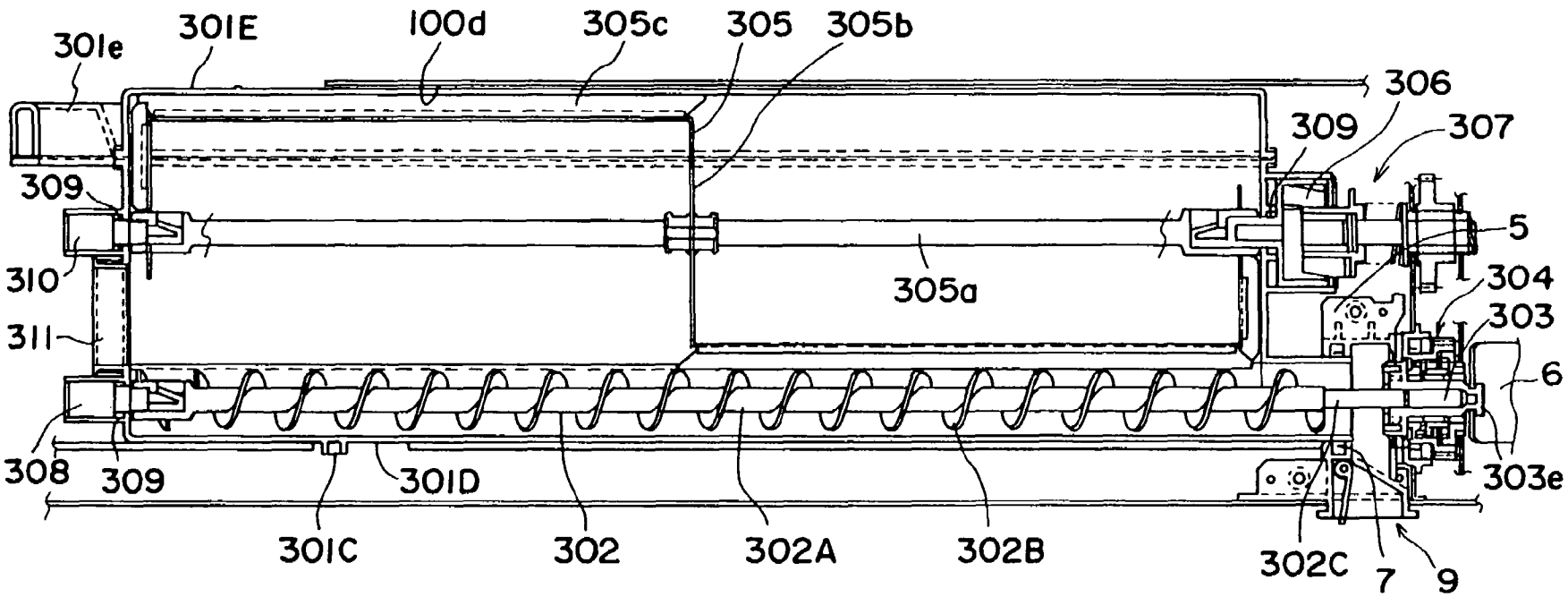
FIG. 23 is a sectional front view of a toner supply container which is placed in the main assembly of the apparatus and a supply port of which is in the sealed state.
Figure 24:
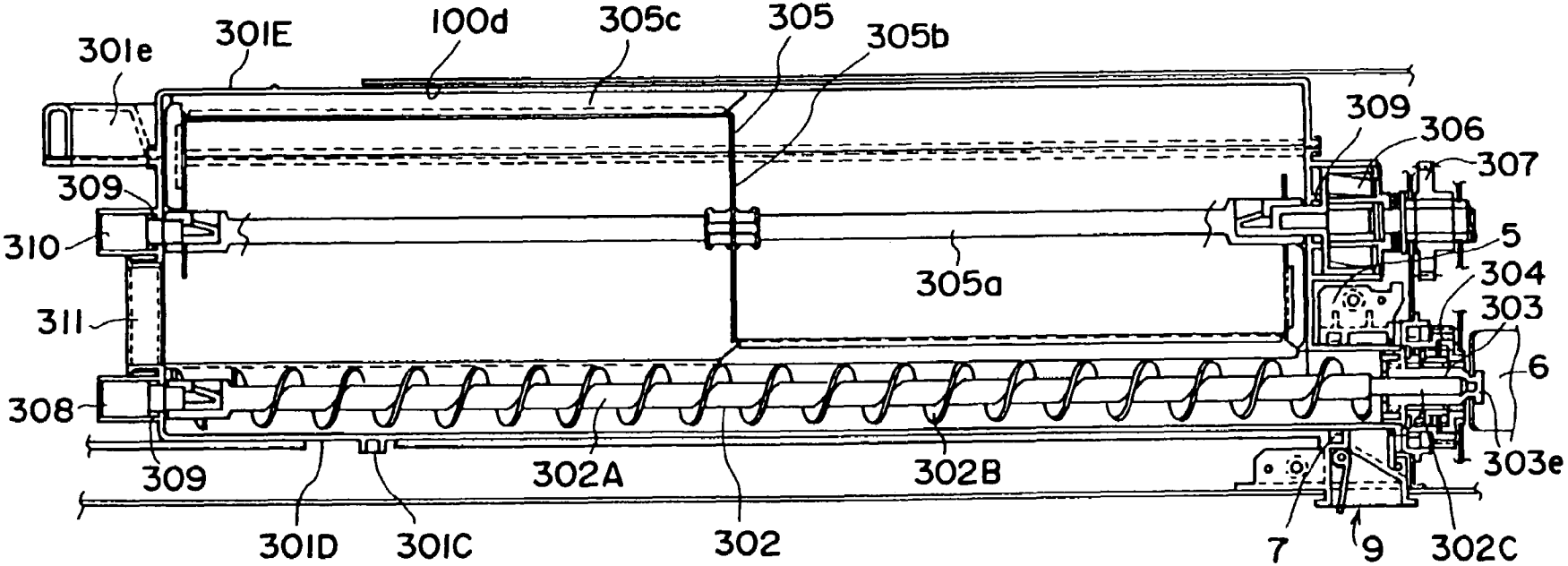
FIG. 24 is a sectional front view of a toner supply container which is placed in the main assembly of the apparatus and a supply port of which is in the unsealed state.

FIG. 22, (A) is a front view of the toner supply container according to this embodiment, and (B) is a sectional view. FIG. 22, (C) is a left side view of the toner supply container, (D) is a right side view of the toner supply container, (E) is a sectional side view of the toner supply container, and the (F) is a top plan view of the toner supply container. FIG. 23 is a sectional front view wherein the toner supply container is loaded in the main assembly 100 of the apparatus, and the supply port is open. FIG. 24 is a sectional front view wherein the toner supply container is loaded in the main assembly 100 of the apparatus, and the supply port is sealed.

In FIGS. 21-24, designated by 301A is a main assembly of the container, and 302 is a feeding member for feeding the toner accommodated in the main body 301A of the container toward the toner supply port portion 301*a*. Designated by 303 is a sealing member for sealing the toner supply port 301*g*, and 304 is a coupling member for transmitting the driving force to the sealing member 303 when the toner supply container is mounted to the main assembly 100 of the apparatus. Designated by 305 is a stirring member for stirring the toner in the main body 1A. Designated by 306 is a transmitting member engageable with the stirring member 305 to transmit the rotation force from the image forming apparatus to the stirring member. Designated by 307 is a second coupling member for transmitting the driving force to the transmitting member 306 when the toner supply container is mounted to the main assembly 100.

Designated by 309 is an oil seal for preventing leakage of the toner.

Figure 25A:
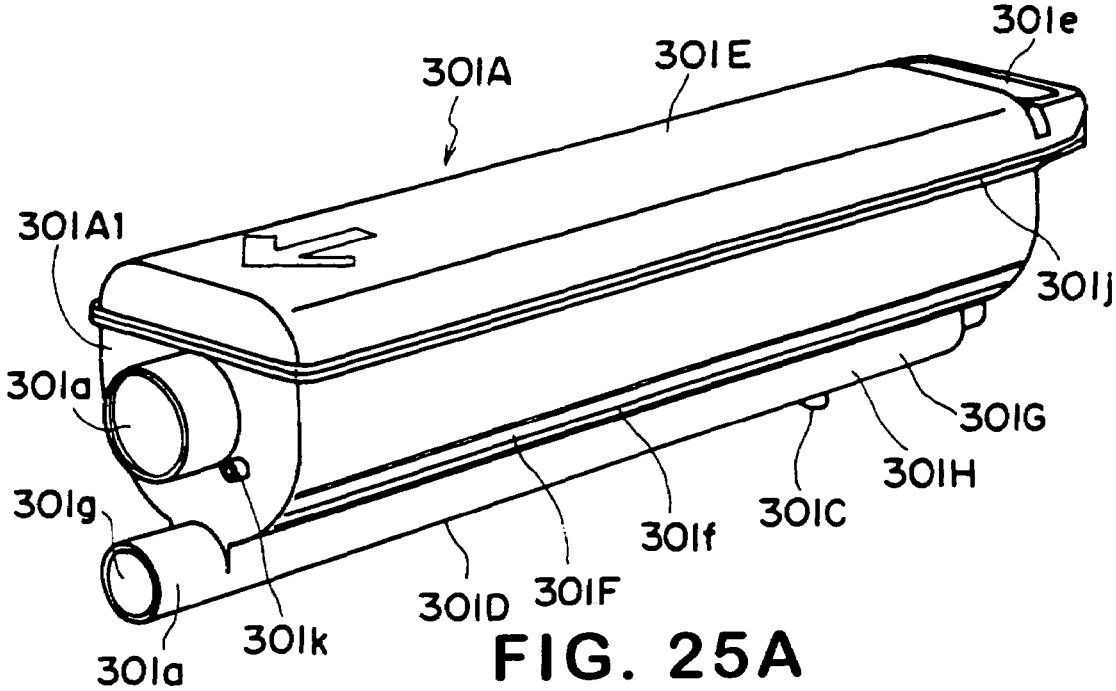
Figure 25B:
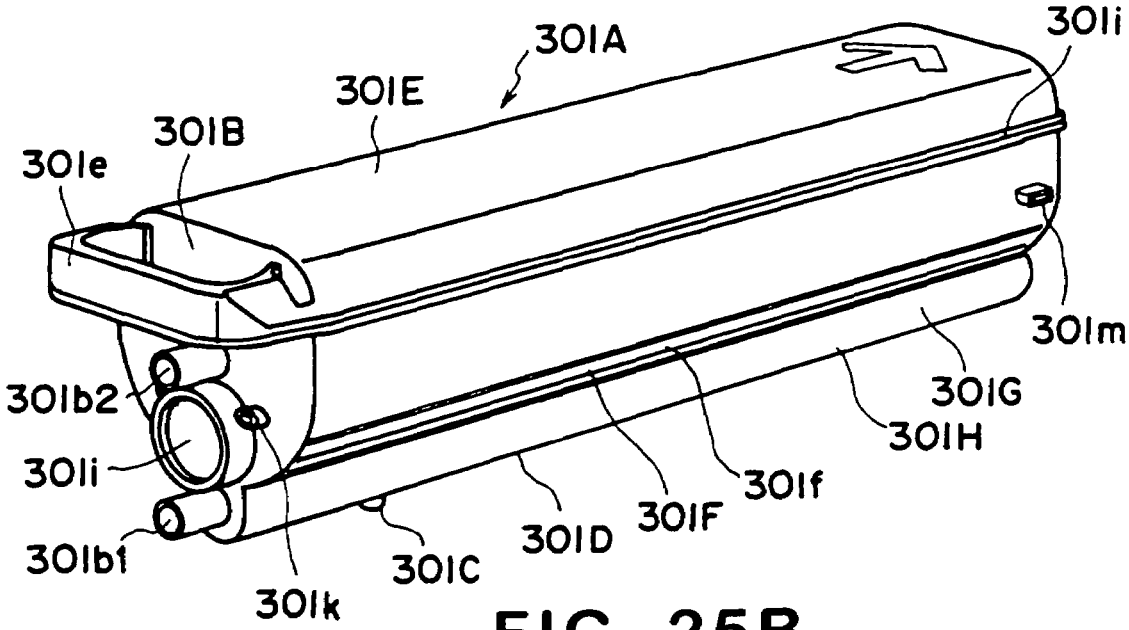
Figures 26A, 26B, 26C, 26D, 26E, 26F:
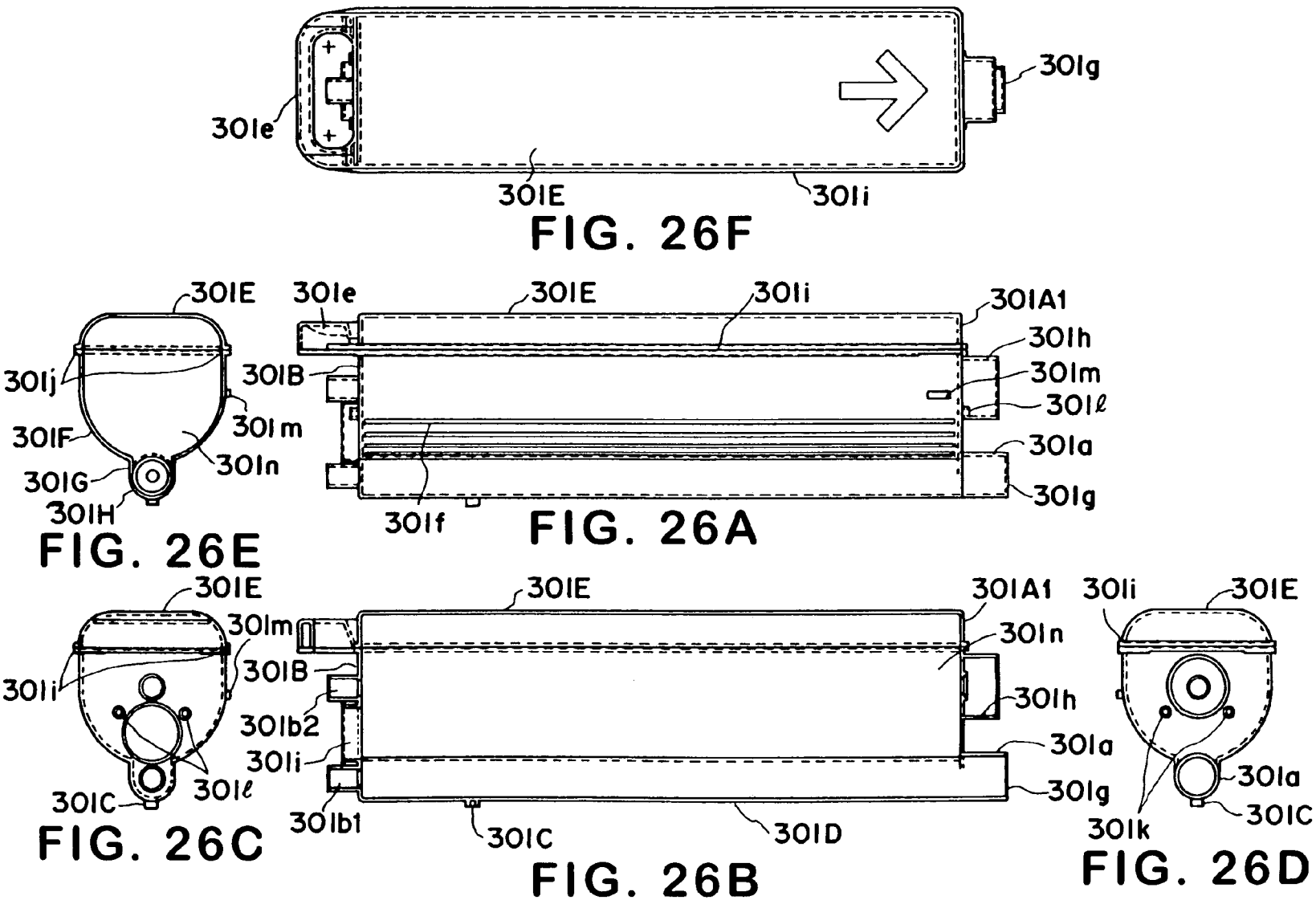
Figure 27C:
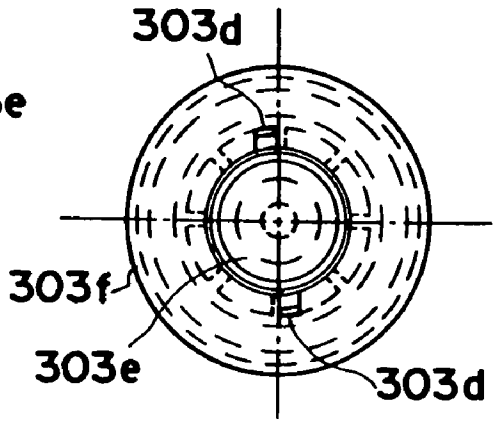
Figure 27A:
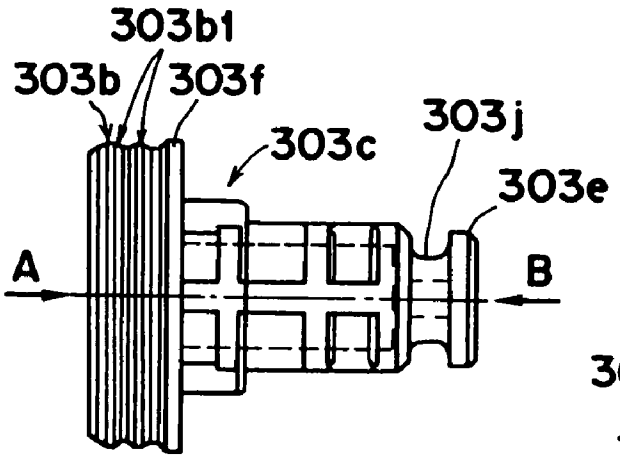
Figure 27B:
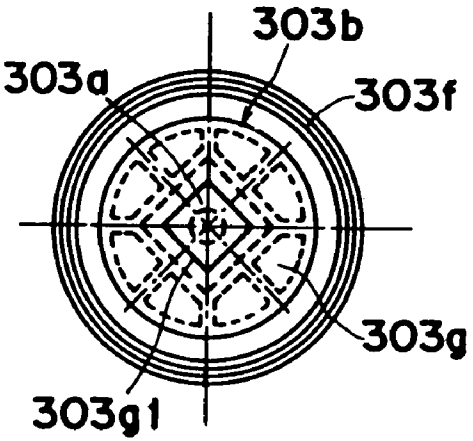
Figure 27D:
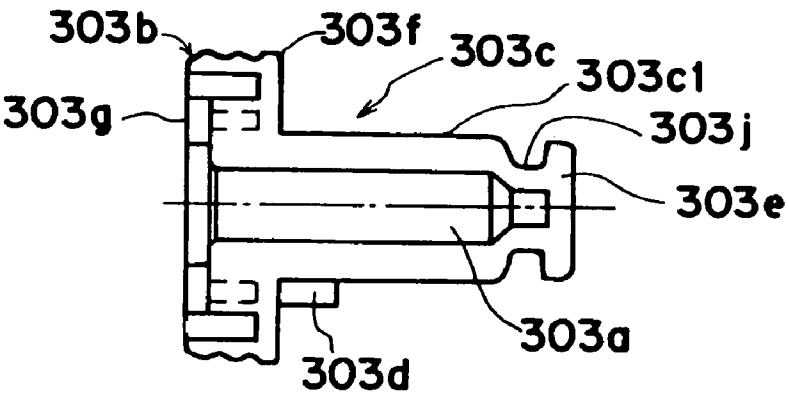
Figure 31C:
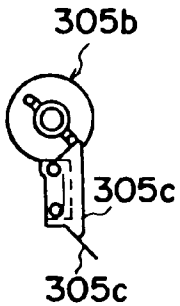
Figure 31A:
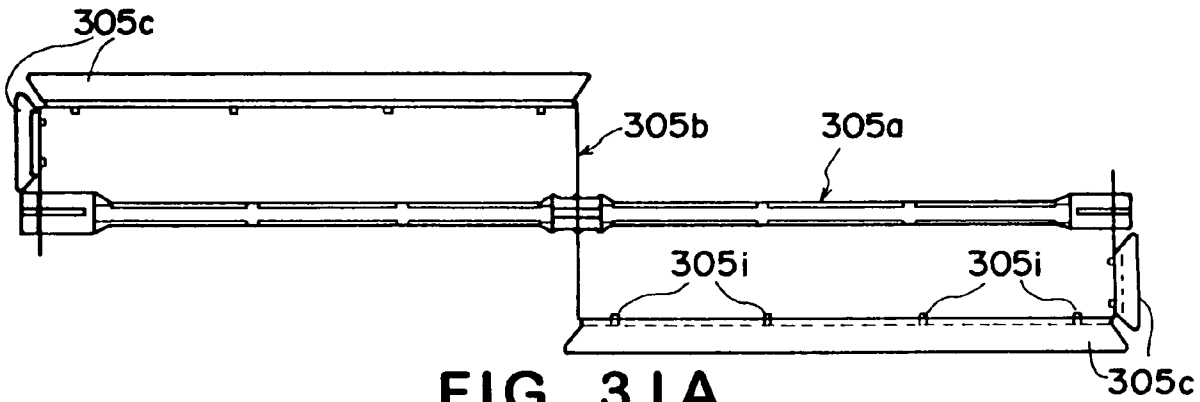
Figure 31D:
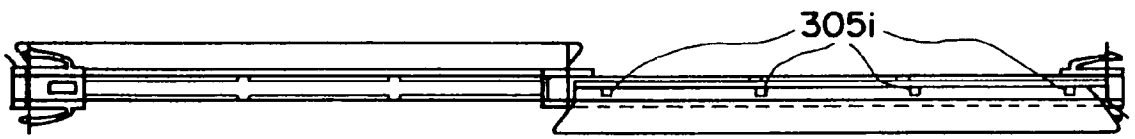
Figure 31B:
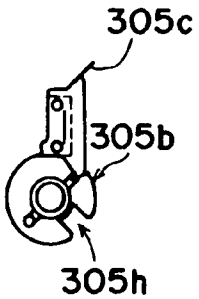

Referring to FIG. 25 and FIG. 26, the toner supply container part 301A, which is a main assembly of the toner supply container, will be described. FIG. 25 is a perspective view of the main assembly of the container.

In FIG. 26, (A) is a front view of the main assembly of the container, (B) is a sectional view, (C) is a left side view, (D) is a right side view, (E) is a cross-sectional view, (F) is a top plan view.

The main body 1A of the toner supply container includes a curved portion 301F having a width decreasing toward the lower portion, a flat surface portion 301G having a substantially constant width extended from the lower portion of the curved portion, and an arcuate configuration portion 301H extended from the lower portion of the flat surface portion.

At a lower portion of one side surface 1A1 of the main body 301A of the container, a cylindrical member defining a toner supply port portion 301*a* is projected which functions to supply toner accommodated in the toner accommodating portion 1*n* to the main assembly of the apparatus. A toner supply port 301*g* is provided at one end portion of the toner supply port portion 301*a*. At a position corresponding to the toner supply port portion 301*a* of the other side surface 301B, a first receiving portion 301*b* for rotatably supporting the feeding member 2 is formed. Outside the lower surface 301D, there is provided an engaging portion 301*c* for engaging with the toner supply port opening and closing means provided in the main assembly 100 to move the toner supply container 301 in the mounting and demounting direction. In this embodiment, the engaging portion 301C is in the form of a dowel projected outwardly from the lower surface 301D. The upper surface 301E is provided with a handle 301*e* for facilitating mounting of the toner supply container to the main assembly 100 and removal thereof from the main assembly 100. The lower inclined surface (curved portions 301F of the front side and the rear side, there are provided grooves 301*f* extended substantially parallel with each other in the longitudinal direction of the container to facilitate handling of the main body 1A of the container when the toner supply container 1 is mounted to the main assembly 100 of the apparatus.

Above the first receiving portion 301*b*1 of the other side surface 301B, there is provided a second receiving portion 301*b* 2 for rotatably supporting the stirring member 305.

The toner supply port portion 301*a* is disposed in a side surface 301A1 opposite from the side surface 301B having the handle 301*e* in the longitudinal direction of the main body 301A. By this arrangement, when the user mounts the toner supply container 301 to the main assembly 100, the user is prevented from inadvertently touching the toner supply port portion 301*a*. The toner supply port portion 301*a* is located at the lower position of the side surface 301A1. Therefore, even if the amount of the toner accommodated in the main body 301A becomes small, the toner can be discharged efficiently.

The toner supply port portion is projected from the side surface 301A by 20 mm-40 mm, preferably approximately 27.8 mm. The toner supply port portion 301*a* is cylindrical in shape, and the outer diameter of the cylindrical portion is 20 mm-30 mm, preferably approximately 27.6 mm.

As described hereinbefore, an engaging portion 301C is provided on the outside of the lower surface 301D. The engaging portion 301C is correctly positioned by a locking portion 51C (FIG. 8) provided in the main assembly 100 of the apparatus when the toner supply container is mounted to the main assembly 100. The engaging portion 301C, as described hereinbefore, is in the form of a columnar projection (dowel) projecting outwardly from the lower surface 301D. The circular column shape portion has an outer diameter 8 which is 5 mm-12 mm, preferably approximately 8 mm. The positioning portion is disposed at a position 2 mm-6 mm away from the lower surface 301D, and the engaging portion 301C (positioning portion) is disposed at a position 60 mm-80 mm preferably approximately 71 mm away from the lateral end surface 301B opposite from the side of the toner supply port portion 301*a* in the longitudinal direction of the lower surface 301D.

The side surface 301A1 and the other side surface 301B, are each provided with two bosses 301*k*, 3011 for positioning the main assembly of the container when the dimensional inspection for the main assembly of the container is carried out before the container is delivered from a plant.

Designated by 301*m* is a rib for preventing erroneous mounting.

The user is prevented from mounting an erroneous container by disposing the rib 301*m* at different positions for the toner supply containers.

The main body 301A is preferably manufactured through an injection molding of resin material such as plastic resin material, blow molding or injection blow molding, but another material and/or another manufacturing method is usable. The main body 301A of the container may be divided into two or more portions, which are unified by welding, bonding or the like.

In the embodiment, upper frame and lower frame of high impact polystyrene are unified by vibration welding.

The feeding member 302, as shown in FIG. 23, includes a shaft portion 302A and a helical rigid feeding blade 302B, on the shaft portion 302A, which functions as a feeding portion for feeding the powder toner in a predetermined direction by rotation of the shaft portion 302A. The feeding member 302 is mounted to the main body 301A of the container with the axis of the shaft portion 302A substantially aligned with the center of the substantially circular toner supply port 301*g*.

The feeding member 302 is not limited to the screw type, as described above, but a flexible blade may be mounted to the shaft portion 302A, for example. The shaft portion and the blade may be integrally molded, and may be separate members. In this embodiment, the shaft portion 302A and the blade 302B are made of plastic resin material molded integrally.

In the embodiment, the feeding member 302 has an extending portion 302C extending into the cylindrical portion of the toner supply port portion 301*a*. In this embodiment, the extending portion 302C is further extended out of the toner supply port portion 301*a*. A free end portion of the extended-out portion of the extending portion 302C receives the rotation force from the main assembly 100. Therefore, in this embodiment, the sealing member 303 is movably (in the axial direction) mounted to the free end portion.

One end portion 302*a* of the extending portion 302C has a configuration, such as a polygonal configuration, and more particularly, a rectangular configuration, to receive the rotation force through the sealing member 303 from the main assembly 100. The one end portion of the shaft portion 302A is supported on the sealing member 303 through one end portion 302*a* of the extending portion 302C. The other end portion 302*b* of the shaft portion 302A is provided with a first bearing member 308. It is supported rotatably (upon unsealing) to the main body 301A through the first bearing member 308.

The feeding member 302 is supported on the sealing member 303 such that the feeding blade 302B is out of contact with the internal wall surface 301*a*1 of the toner supply port portion 301*a* and that internal wall surface of the toner supply port portion 301*a* is substantially parallel with the shaft portion 302*a*. By supporting the feeding member 302 in this manner, the toner can be fed substantially horizontally to the toner supply port 301*g* by rotation of the feeding member 302. It is possible that fine toner particles enter between the feeding blade 302B and the internal wall surface 301*a*1 of the toner supply port portion 301*a* and are fused on the internal wall surface 301*a*1 by strong rubbing therebetween with the result of massive toner particles produced. However, this can be avoided by supporting the feeding member 302 in that manner.

The feeding member 2 is also preferably manufactured through injection molding or the like of plastic resin material or the like, but another method and/or another material is usable. It may be made of separate members, which are connected.

Referring to FIG. 27, a description will be provided as to a sealing member 303. In FIG. 27, (A) is a front view of a sealing member, (B) is a view taken along a line A-A, (C) is a view taken along a line B-B, and (D) is a sectional front view.

In (A)-(D) of FIG. 27, designated by 303*b* is a sealing portion which is provided at a side opposite from the toner supply container 301 of the sealing member 303 to openably seal the toner supply port 301*g* of the toner supply container 301. The outer diameter of the sealing portion 303*b* is larger than an inner diameter of the toner supply port 301*g* by a proper amount. The sealing member 303 hermetically seals the toner supply port 301*g* by press-fitting the engaging portion 303*b*1 of the sealing portion 303*b* into the toner supply port portion 301*a* from the toner supply port 301*g*.

Designated by 303*c* is a coupling engaging portion which functions as a driving force receiving portion (driver) for receiving a driving force for rotating the feeding member 302 from the main assembly 100 of the apparatus when the toner supply container 301 is mounted to the main assembly 100. The coupling engaging portion 303*c* is provided with a projected portion 303*c*1 extended from the sealing portion 303*b* substantially coaxially with the axis of the shaft portion 302A of the feeding member 302 in the direction opposite from the main body 301A of the toner container (when the sealing member 303 is mounted to the main body 301A of the container). The coupling engaging portion 303C is provided on the curved surface of the projected portion 303*c*1, and is provided with elongated projections (ribs) 303*d* (spline-like), which function as a driving force receiving portion engageable with the coupling member 304. In this embodiment, two of such spline projections 3*d* are provided equidistantly.

More particularly, they are disposed at an approximately 180° interval.

The rib 303*d* is projected from the outer surface of the sealing member by 0.5 mm-3 mm and preferably approximately 1.8 mm.

The outer diameter of the projected portion 303C1 is 10 mm-14 mm and preferably approximately 12 mm.

The sealing member 303 includes an engaging hole 303*a* as a driving force transmitting portion for transmitting a driving force received from the main assembly 100 to the feeding member 302 by engagement with one end portion 302*a* of the feeding member 302. The engaging hole 303*a* is formed as an opening (hole) through the sealing portion 303*b* and the coupling engaging portion 303*c*. Here, the engaging hole 303*a* has a rectangular portion corresponding to the rectangular configuration of the end 302*a* of the shaft of the feeding member 302 projected from the powder toner supply portion 301*a*. It has a dimension slightly larger than that of the end 302*a* of the shaft, so that end 302*a* is loosely fitted in the engaging hole 303*a*.

The feeding member 302 and the sealing member 303 are locked with each other in the rotational direction by the loose fitting between the end 302*a* and the engaging hole 303*a*. On the other hand, in the axial direction, relative motion therebetween is permitted. By doing so, the sealing member 303 and the main body 301A of the container are separable from each other so that toner supply port 301*g* is openable upon the toner supply container mounting.

The engagement length between the engaging hole 303*a* and the shaft end 302*a*, is long enough to prevent disengagement therebetween when the sealing member 303 and main body 301A of the container are moved away from each other. Therefore, even if the sealing member 303 is moved away from the main body 301A, the feeding member 302 can receive the driving force through the sealing member 303 (coupling engaging portion 303*c*).

Between the coupling engaging portion 303*c* and the sealing portion 303*b*, a flange portion 3*f* is provided which abuts the end of the powder toner supply portion 301*a* when the sealing portion 303*b* is press-fitted into the toner supply port portion 301*a*. The outer diameter of the flange portion is substantially equal to the outer diameter of the toner supply port portion 301*a* (preferably, it is smaller than the outer diameter of the toner supply port portion 301*a*). By the flange portion 303*f*, the sealing portion 303*b* enters the toner supply port portion 301*a* by the length of the sealing portion 303*b*.

On the other hand, designated by 303*e* is a locking projection 303*e*, formed at a free end of the coupling engaging portion 303*c*, for locking engagement with the locking member 6 provided in the main assembly 100 of the apparatus. By locking the locking member 6 with the locking projection 303*e*, the sealing member 303 can be fixed when the toner supply port 301*g* is opened.

The sealing member 303 is preferably manufactured by integral injection molding of plastic resin material or the like resin material, but another material, manufacturing method and/or non-integral structure is usable. The sealing member 303 is required to have a proper elasticity to effect press-fitting into the toner supply portion 301*a* to seal it. The preferable material is polypropylene, Nylon, high density polyethylene or the like, but further preferable material is low density polyethylene.

Designated by 303*j* is a locking groove for receiving a locking member 6 provided in the main assembly 100 of the apparatus. The width of the locking groove 303*j* is 1.5 mm-5 mm, and preferably approximately 3 mm. The depth of the locking groove is 0.5 mm-5 mm, and preferably approximately 2.5 mm.

As described in the foregoing, the sealing member 303 has a substantially cylindrical engaging portion 303*b*1 engageable with the toner supply port portion 303*a*. The flange portion 303*f* is substantially coaxial with the engaging portion 303*b*1. It further includes a projected portion 303*c*1 projected from the flange portion 303*f* substantially coaxially with the engaging portion 303*b*1 at a side opposite from the side where the engaging portion 303*b*1 is provided. Adjacent the free end portion of the projected portion 303*c*1 it is provided with a locking groove 303*c*, and a free end portion is formed into a locking portion 303*e*. There is provided a hollow portion extending from the engaging portion 303*b*1 side to the locking portion 303*e* side, and in the hollow portion, a driving force transmitting portion 303*a* is provided. The locking portion 303*e* of the hollow portion does not open, and therefore, when the engaging portion 303*b*1 is engaged with the toner supply port portion 303*a*, the toner does not leak from the hollow portion to the outside. Thus, the toner supply port portion 303*a* is sealed by mounting the sealing member 303.

Similarly to Embodiment 1 and 2, the sealing member 303 has four functions. More particularly, the functions are (1) to seal the toner supply port portion 301*a*, (2) to receive the transmission of the rotation force from the main assembly 100 of the apparatus, (3) to transmit the rotation force to the feeding member 303 and (4) to engage with the engageable member 6 provided in the main assembly of the apparatus. Thus, the sealing member 303 transmits the driving force received from the main assembly 100 of the apparatus to the shaft portion 302A through the extending portion 302C to rotate the feeding member 302.

A description will be provided as to the stirring member 305. Referring to FIG. 28, (A) is a front view of the stirring member 305, (B) is a left side view, and (C) is a right side view. As shown in FIG. 28, the stirring member 305 includes a shaft portion 305*a*, a rigid blade portion 305*b* and a flexible blade portion 305*c*. FIG. 29 is an enlarged side view of the rigid blade portion 305, and FIG. 30 is an enlarged view of the flexible blade portion 305*c*. The shaft portion 305*a* is made of a relatively high rigid plastic resin material and is manufactured by injection molding. The rigid blade portion 305*b* is made of metal, such as stainless steel or a highly rigid material, and the flexible blade portion 305*c* is made of low rigidity material such as plastic resin material film or sheet or elastomer sheet. In this embodiment, it is of a polyester sheet.

One end 305*d* of the stirring member 305 is engaged with the above-described transmitting member 306 at the bearing portion 301*h* of the main body of the toner supply container. The other end 305*e* is engaged with a stopper member (second bearing member) 310*f* at the second receiving portion 301*b*2 of the main body of the toner supply container. The shaft portion 305*a* in this embodiment is made of relatively high rigidity plastic resin material and is manufactured through injection molding, but may be of another material such as metal.

The rigid blade portion 305*b* is preferably integrally molded using metal or the like, another material and/or manufacturing method is usable, or it may be divided into two or more parts, which are unified by welding or bonding or the like. In this embodiment, a pressed stainless steel plate having a thickness of approximately 0.8 mm is used. The engaging portion of the rigid blade portion 305*b*, which is engageable with the shaft portion 305*a*, has a configuration conforming with the shaft portion 305*a* to receive the driving force from the shaft portion 305*a*, and it rotates with the rotational motion of the shaft portion 305*a*, to stir the toner in the container.

It is preferable to provide a cut-away portion 305*h* at one end as shown in FIG. 28 since then the assembling is easy. The entire length of the rigid blade portion 305*b* is in the form of a substantially parallel plate relative to the tangential direction of rotation, and downstream of the blade portion with respect to the rotational direction is bent toward the internal wall surface of the toner supply container. The length r of the bent portion 305*b*1 shown in FIG. 29 is approximately 2 mm-8 mm, and the bending angle 6 is preferably approximately 30°-50°. Further preferably, the length r of the bent portion 305*b* is approximately 3 mm-5 mm, and the bent angle is preferably approximately 45°.

In this embodiment, the length of the bent portion 305*b*1 is approximately 5 mm, and the bending angle is approximately 45°. The distance from the center of the rotation shaft to the free end of the rigid blade portion is properly determined depending on the size of the main body of the container, and it is preferably approximately 70-95% of the inner radius of the main body of the container. In this embodiment, the inner diameter of the main body of the container is approximately 44.5 mm, and therefore, it is approximately 39.4 mm (89%).

The flexible blade portion 305*c* is made of low rigidity material such as a plastic resin material film or a sheet or an elastomer sheet. The thickness thereof is preferably approximately 50 μm-500 μm and further preferably 100 μm-300 μm. In this embodiment, the use was made of a polyester sheet having a thickness of approximately 100 microns.

The flexible blade portion 305*c* is bonded such that a free end contacts the internal wall surface of the main body over the entire length of the bent portion 305*b*1 of the rigid blade portion 305*b*. It rotates, scraping the toner off the internal wall surface of the container with the rigid blade portion. The length, in the radial direction, of the flexible blade portion 305*c* is preferably longer by approximately 0.5 mm-10 mm than the distance between the internal wall surface of the container and the free end of the rigid blade portion 305*b* since then the above-described effect can be enhanced.

In this embodiment, it is longer by approximately 6 mm. The bonding between the rigid blade portion 305*b* and the flexible blade portion 305*c* is made by a double coated tape

305*i* (DIC#8800CH) as shown in FIG. 30 on the bent portion 305*b* of the rigid blade portion 305*b*. Another method using rivets or another known means is usable, or the integral molding with the rigid blade portion is usable.

As shown in FIG. 31, the rigid blade portion 305*b* may be divided with a phase difference of 180° substantially at the central portion relative to the axis direction, so that divided parts are staggered. The number of the division is properly determined depending on the configuration and length of the main body of the container, and it may be 3 or 4 or more. The phase of the rigid blade portion 305*b* may be changed over the entire length to provide a spiral-like configuration. The engaging portion between the central portion of the shaft portion and the opposite ends of the rigid blade portion 305*b* are preferably provided with a cut-away portion 305*h* as shown in the figure since then the assembling property is improved. The length of the bent portion of the rigid blade is approximately 3 mm to reduce the resistance of the toner and to decrease the projected area of the rigid blade portion in the rotational direction. The length and the bending angle of the bent portion is preferably 2-8 mm and 30-50°, and further preferably approximately 3-5 mm and approximately 45°.

The rigid blade portion 305*b* and the flexible blade portion 305*c* may be crimped by means of aluminum rivets 4*i*. In this case, if the position of the rivet hole of the flexible blade portion 305*c* is deviated even slightly, waving may result, and therefore, it is preferable to provide a perforation or half cutting at a portion of the flexible blade portion 305*c* contacting bent portion C of the rigid blade portion 305*b*. The bonding means may be a double coated tape or another known means.

A description will be provided as to an assembling method of the toner supply container 301.

In the assembling method of the toner supply container 301, the feeding member 302 is inserted into the lower portion of the lower frame 301K from the top. An oil seal 309 is inserted into the first receiving portion 301*b*1, and thereafter, a bearing member 308 is engaged with the other end portion 302*b* of the feeding member 302. The toner supply port 301*g* is sealed by the sealing member 303. Then, the stirring member 305 is inserted from the top. An oil seal 309 is inserted into the main body of the container, and thereafter, the second bearing member 310 and the transmitting member 306 are engaged at the opposite ends of the stirring member 305. Then, the upper frame 301J is welded to the lower frame 301K by vibration welding, and a predetermined amount of the toner is supplied into the main body 301A of the container through the filling port 301*i* of the main body of the toner supply container 301, and the filling port 301*i* is sealed by the sealing member 311, so that assembling is completed. In this manner, the assembling of the toner supply container 301 is very easy, and the number of steps of the assembling is very small.

The filling of the toner may be effected through the toner supply port 301*g*.

In this embodiment, the exchange steps of the toner supply container 301 are the same as with the first embodiment and the second embodiment.

When the toner supply port portion 301*a* is opened by the toner supplying portion opening and closing means, the main body 301A of the container receives forces at the toner supply port portion 301*a* and the engaging portion 301*c*. At this time, as described hereinbefore, the engaging portion 301*c* is disposed at a side opposite from the side having a toner supply port portion 301*a* in the longitudinal direction at the lower surface of the main body 301A of the container, the main body 301A is prevented from rising relative to the main assembly 100. Even if the main body 301A is raised, the motion of the main body 301A beyond a predetermined distance is limited by contact of the upper surface 301E to the top surface portion 100*d* (FIG. 32) of the main assembly 100 of the apparatus.

The engaging projection 301*c* and the toner supply port 301*g* of the toner supply container 301 are preferably disposed on a line in the sliding direction of the container. By doing so, the production of a moment in either direction in FIG. 32 relative to the slide direction in the toner supply container 301 can be prevented. Even if a moment in either direction is produced, the movement of the main body 301A beyond a predetermined distance can be prevented by abutment of the rib 301*j* as a lateral stopper portion provided in the side surface 301B to the side wall portion 100*e* provided in the main assembly 100.

The height of the engaging projection 301*c* of the toner supply container 301 is such that overlapping x between the engaging projection 301*c* and the container chucking member 51 (FIG. 32) is larger than the clearance Y between the upper portion 301E of the container and the top surface 100*d* of the main assembly of the apparatus (FIG. 32) in order to prevent the upward disengagement of the toner supply container 301 during the slide movement.

Figure 32:
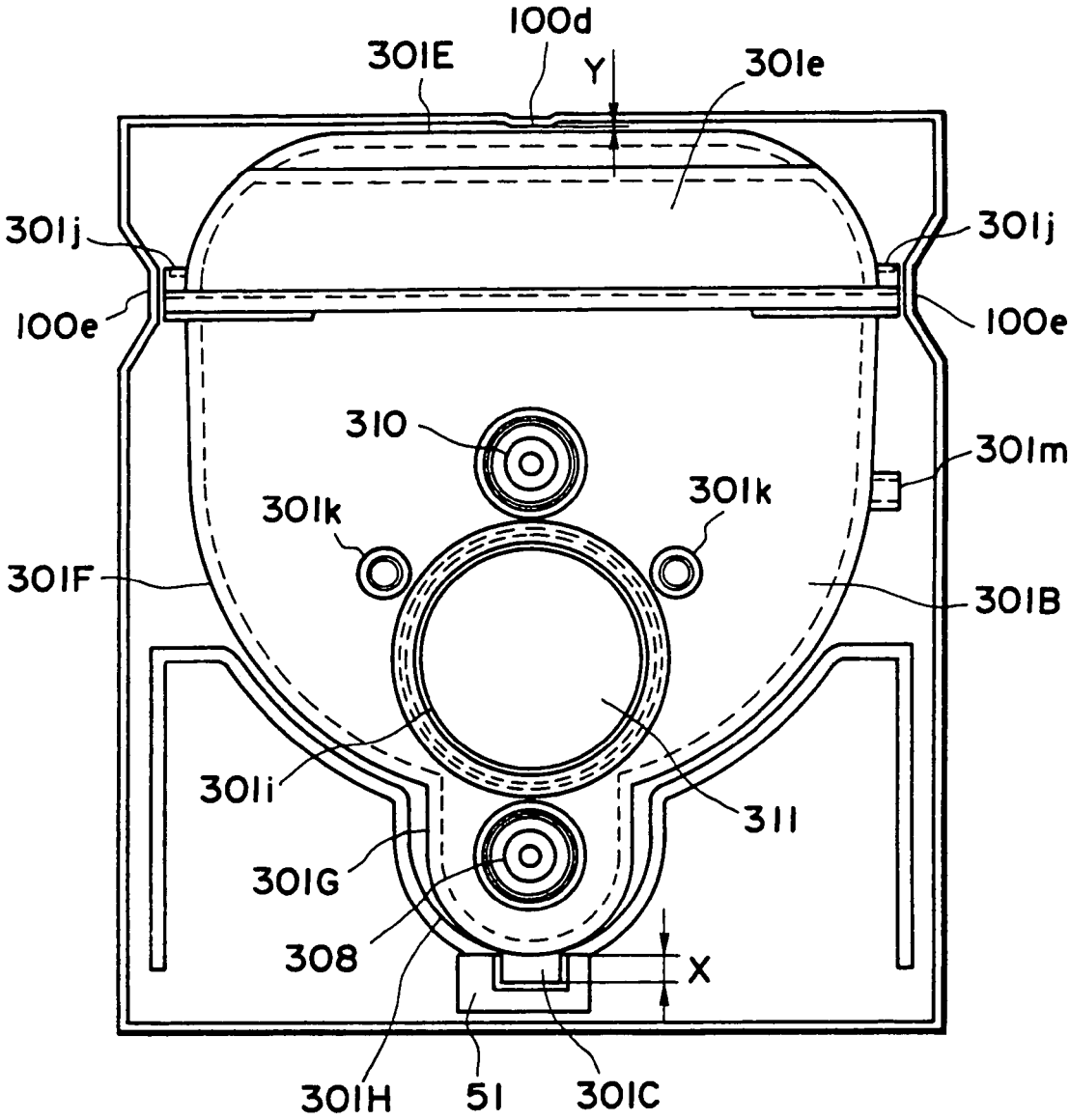
FIG. 32 shows a toner supply container which is mounted in the main assembly of the apparatus.

The horizontal ribs 301*j* of the toner supply container 301 in FIG. 32 are preferably provided on the top part of the toner supply container 301 to prevent clogging, and in this embodiment, they are disposed at an upper portion (higher than the height center) of the toner supply container 1 with a proper clearance from the side wall portion 100*e*.

A description will be provided as to a driving mechanism for the tone supply container 301 in this embodiment.

When the toner supply container 301 is to be mounted, the coupling engaging portion 303*c* of the sealing member 303 is brought into engagement with the first coupling member 304 of the main assembly 100 of the apparatus as shown in FIG. 23. The first coupling member 304 functions to transmit a driving force of a driving device (unshown) provided in the main assembly 100 to the sealing member 303.

Figure 33:
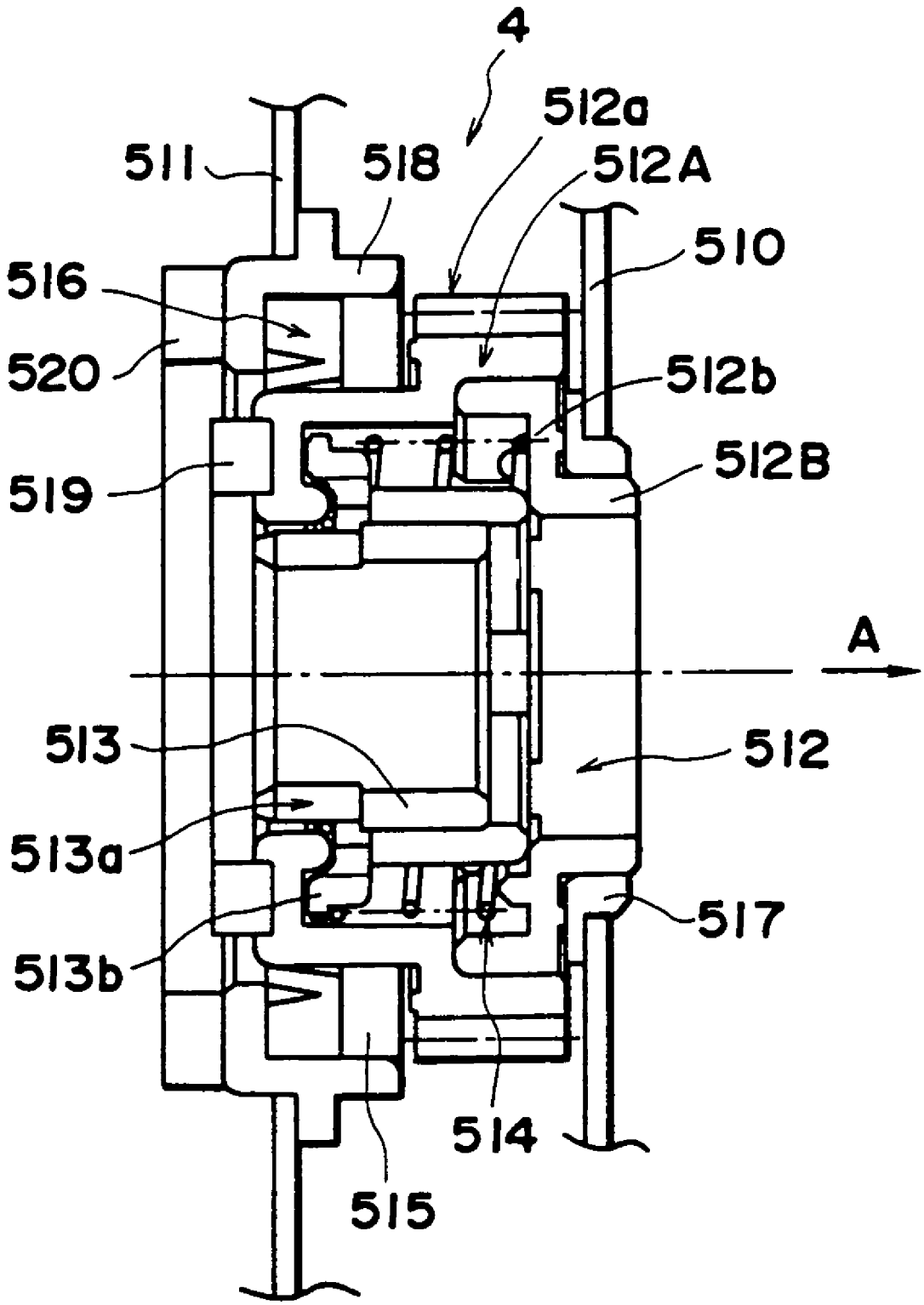
FIG. 33 shows a detailed configuration of the first coupling member.

FIG. 33 shows details of the first coupling member 304.

Designated by 512 is a gear member having a gear portion at the outer surface 512*a*. The gear member 512 is constituted by two members, namely, gear portion 512A and cap portion 512B, which are securedly fixed by snap fitting, bonding or the like. The inside of the gear member 512 is provided with urging means 514 and a movable member 513. The urging means 514 abuts the 512*b* portion of the gear member 512 and the 513*b* portion of the movable member 513.

Figure 34C:
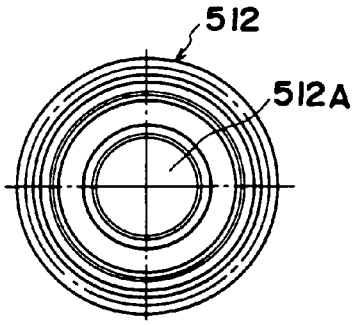
FIGS. 34(A) through 34(C) are detailed illustrations of a gear portion.
Figure 34A:
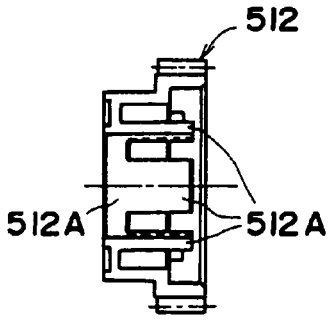
Figure 34B:
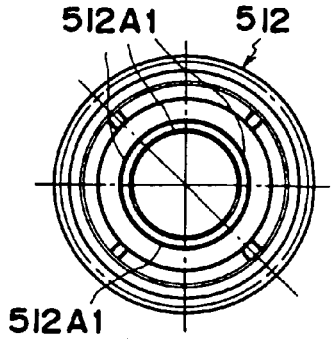
Figure 35C:
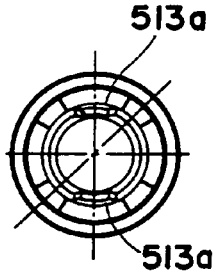
FIGS. 35(A) through 35(D) are detailed illustrations of a movable member.
Figure 35D:
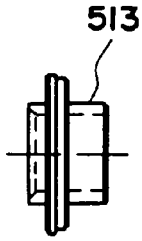
Figure 35B:
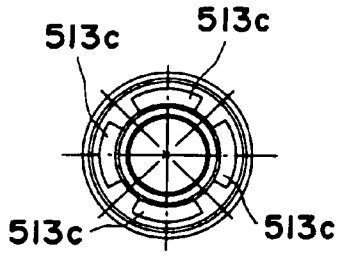
Figure 35A:
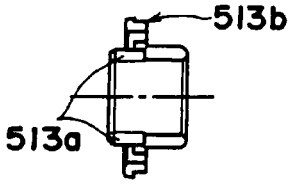

FIG. 34 is a detailed illustration of the gear portion 512, wherein (A) is a sectional front view, and (B) and (C) are side views. FIG. 35 is a detailed illustration of the movable member 513, wherein (A) is a sectional front view, and (H) and (C) are side views, and (D) is front view.

In FIG. 34, gear portion 512A is provided with four slide guiding ribs 512A1 arranged circumferentially. In FIG. 35, the movable member 513 has four slide guiding hole portions 513*c* circumferentially arranged, and are engaged with the slide guiding ribs 512A1 of the gear portion 512A, by which the movable member 513 is slidable in the gear member 512.

Designated by 513*a* is a drive transmitting portion of the movable member 513. The drive transmitting portion 513*a* is engaged with an elongated projection 303*d* of the sealing member 303 to transmit the rotation force to the sealing member when the toner supply container 1 is mounted to the main assembly 100 of the apparatus.

In FIG. 33, designated by 517, 515 are bearing members for rotatably supporting the gear member 512, and 516 is an oil seal. The toner discharged through the toner supply port 301*g* is prevented, by the oil seal 516, from entering the bearing members 515, 517, resulting in the locking of the gear member 512. Designated by 519 is a gear seal member, and when the toner supply container 301 is mounted to the main assembly 100 of the apparatus, it is press-contacted to the 303*h* portion (FIG. 27) of the sealing member 303 to prevent the toner discharged through the toner supply port 301*g* from entering the gear member 512. Designated by 511, 510 are driving side plates for supporting the first coupling member 304. Designated by 518 is a bearing holder, which functions to support the bearing 515 and the oil seal 516 and which is securedly fixed on the driving side plate 511 by screws or by bonding. Designated by 520 is a holder seal member, which prevents the toner from leaking between the bearing holder 518 and the holder 5 as shown in FIG. 27.

The gear seal member 519 and the holder seal member 518 are fixed to the gear member 512 and the bearing holder 518, respectively, by double coated tape or the like, and the material thereof is elastic material such as urethane foam.

A description will be provided as to an operation of the first coupling member 304. The movable member 513 of the coupling member is retractable in a direction A in FIG. 33 because of the structure described in the foregoing. Normally, it is urging to a position shown in FIG. 33 by urging means 514. When the toner supply container 301 is mounted to the main assembly 100 of the apparatus, the sealing member 303 enters the coupling member as shown in FIG. 27. If the phases of the projections 303*d* of the sealing member 303 and those of the drive transmitting portions 513*a* of the movable member 513 are matched, the locking member 6 locks the locking portion 303*e* and the toner supply port 301*g* is unsealed, and then, the gear member 512 and the movable member 513 are rotated by an unshown main assembly driving mechanism, so that the sealing member 303 is rotated through the drive transmitting portion 513*a*. When the phases are not matched, the movable member 513 is urged in the direction A in FIG. 33 by the projection 303*d* of the sealing member 3. When the gear member 512 and the movable member 513 are rotated by the main assembly driver in this state, the movable member 513 rotates idle until the phase matching is reached between the projection 303*d* of the sealing member 303 and the drive transmitting portion 513*a* of the movable member 513. When the phases are matched, the movable member 513 is slid by the urging means 514 to the position shown in FIG. 33 where the drive transmitting portion 513*a* and the elongated projection 303*d* of the sealing member 303 are engaged to transmit the driving to the sealing member 303. In the same manner as with the foregoing embodiment, the locking, unsealing and rotational driving operations are accomplished.

Figure 36:
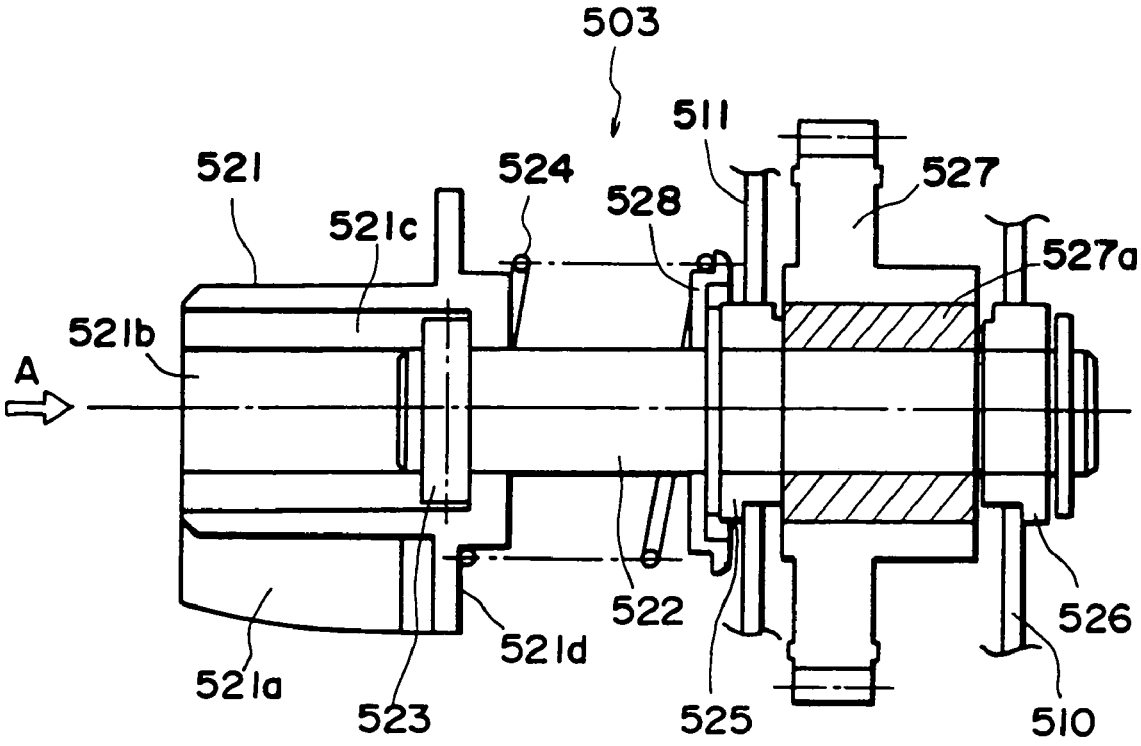
FIG. 36 shows a detailed configuration of the second coupling member.
Figure 37D:
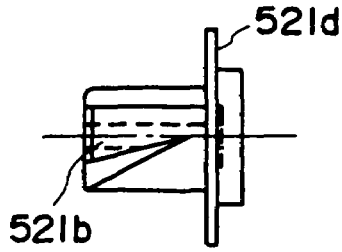
Figure 37A:
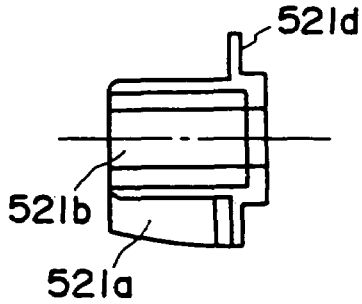
Figure 37B:
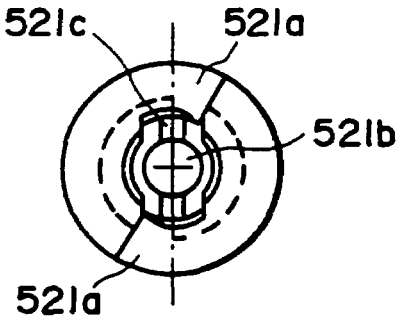
Figure 37C:
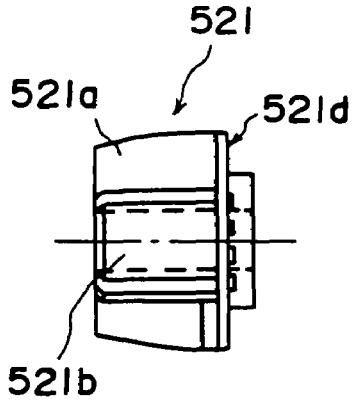
Figure 38B:
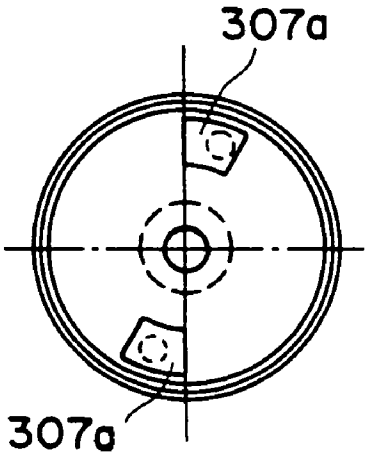
Figure 38D:
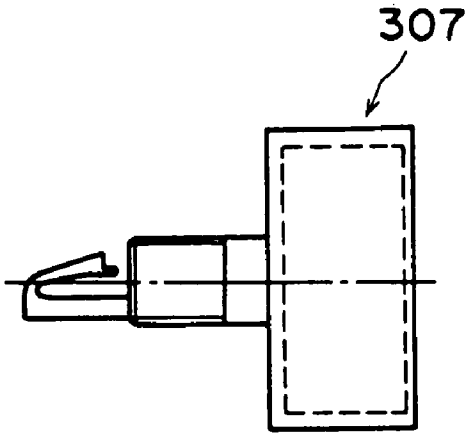
Figure 38A:
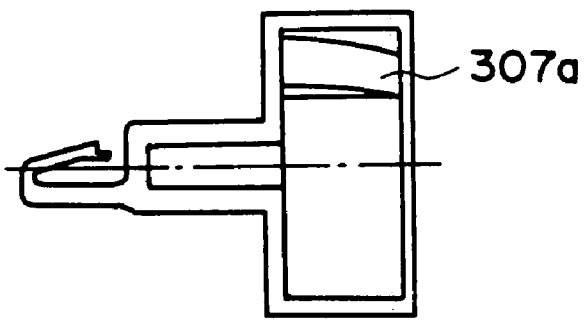
Figure 38C:
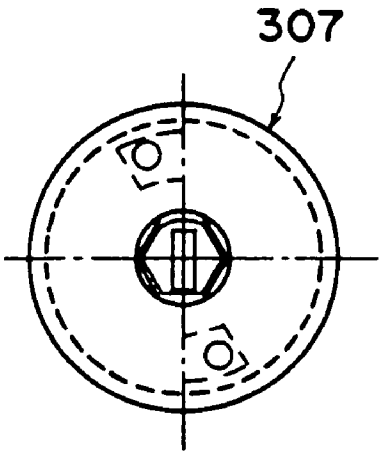

FIG. 36 shows the details of the second coupling member 307. Designated by 521 is a drive transmission claw. In FIG. 37, (A) is a sectional front view of the drive transmission claw 521, (B) is a side view, (C) is a front view, and (D) is an upper surface Figure. In FIG. 37, designated by 521*a* is a claw portion, 521*b* is a slide guiding portion, 521*c* is a parallel pin groove portion, and 521*d* is a spring receiving surface. FIG. 38 is a detailed illustration of the transmitting member 306 shown in FIG. 26, wherein (A) is a sectional front view, (B) and (C) are side view, and (D) is a front view. In FIG. 38, designated by 307*a* is a transmission claw portion.

In FIG. 36, designated by 522 is a driving shaft which is rotatably supported on driving side plates 510 and 511 through bearings 525, 526, and is provided with a one-way gear 527 which is provided with an integral one way 527*a* which transmits rotation only in one rotational direction.

The driving transmission pawl or claw 521 is slidable by engagement between the slide guiding portion 521*b* and the driving shaft 522, and by engagement with the parallel pin groove portion, the rotation of the driving shaft 522 is transmitted to the drive transmission claw 521. Designated by 524 is urging means which is contacted to the spring seat 528 and the spring receiving surface 521*d* of the drive transmission claw 521.

A description will be provided as to an operation of the second coupling member 307. The drive transmission claw 521 of the second coupling member 307 is movable in the direction A in FIG. 39 because of the structure described in the foregoing, and is normally urged to a position shown in FIG. 36 by the urging means 524. When the toner supply container 301 is mounted to the main assembly 100 of the apparatus, the transmitting member 306 enters the second coupling member 307 when the phase relation is such that transmission claw portions 307*a* of the transmitting member 307 are abutted to the claw portions 521*a* of the drive transmission claw 521.

The claw portions 521*a* of the drive transmission claw 521 are rotated by the transmission claw portions 307*a* of the reaching member 307. At this time, the driving shaft 522 rotates with the rotation of the transmission member 306, but it rotates idle due to the one way clutch 527*a* portion of the one way gear 527, and therefore, when the toner supply container 301 is mounted to the main assembly 100 of the apparatus, the drive transmission claw 521 and the transmitting member 306 are not interfered with.

In the toner supply container in the state shown in FIG. 23 to which it is moved from the position shown in FIG. 24, the drive transmission claw 521 moved by the urging means 524 with the retraction of transmitting member 306 to the left, so that engagement between the transmission claw portion 306*a* of the transmitting member 306 and the claw portion 521*a* of the drive transmission claw 521 is maintained.

Thus, the transmitting member 306 receives the rotational driving force through the one way gear 527, the driving shaft 522 and the drive transmission claw 521 from the unshown main assembly driving means, so that stirring member 305 is rotated.

A description will be provided as to discharging of the toner.

When the toner supply container 301 is mounted to the main assembly 100 of the apparatus, the locking portion 303*e* at the end of the sealing member 303 is locked with the locking member 51C of the image forming apparatus, and is supported at a position away from the toner supply port 301*g* of the main body 301A of the container. At this time, the engaging relation, in the rotational direction, between the feeding member 302 and the sealing member 303 is maintained.

The sealing member 303 is engaged with a first coupling member 304 of the main assembly of the apparatus by the coupling engaging portion (driving force receiving portion) 303C. The first coupling member 304 receives the rotation through the drive transmitting means (unshown) such as a gear or the like from the driving source (unshown) such as a motor or the like of the main assembly of the apparatus, and is transmitted to the sealing member 303 through engagement with the spline-like projections 303*d*. It is further transmitted to the feeding member 302 through engagement with the free end 302*a* of the feeding member 302 to the non-circular or square hole 303*a*. Similarly, the transmitting member 306 engaged with the one end 304*d* of the stirring member 304 is engaged with a second coupling member 307 of the main assembly of the apparatus. The second coupling member 307 of the main assembly of the apparatus receives the rotation force through the (unshown) drive transmitting means such as a gear from the driving source (unshown) such as a motor of the main assembly of the apparatus, and is transmitted to the stirring member 304 through the engagement with the engaging claw 306*a*. The rotational frequencies of the feeding member 302 and the stirring member 304 are approximately 52 rotations/min and approximately 10 rotations/min in this embodiment.

When the stirring member 304 rotates, the toner which has been caked by removal of air due to long term non-use or due to vibration during transportation, is loosened, and is fed toward the toner supply port portion 301*a* by rotation of the feeding member 302, and is discharged and let fall through the toner supply port 1*g* to be supplied to the toner hopper 201*a*.

The discharging experiments were carried out using the containers of the structures. The main body of the container is filled with toner, and the toner was discharged by the stirring member rotated at a speed of approximately 10 rotations/min., and by the feeding member rotated at a speed of approximately 52 rotations/min. The sieve (opening is 75 μm, and made of SUS) was used to check the existence of larger particles, and it was confirmed that no large particle exists. The remainder toner amount in the container is 20 g, and therefore, the reducing effect of the toner remaining amount is also confirmed.

Figure 39:
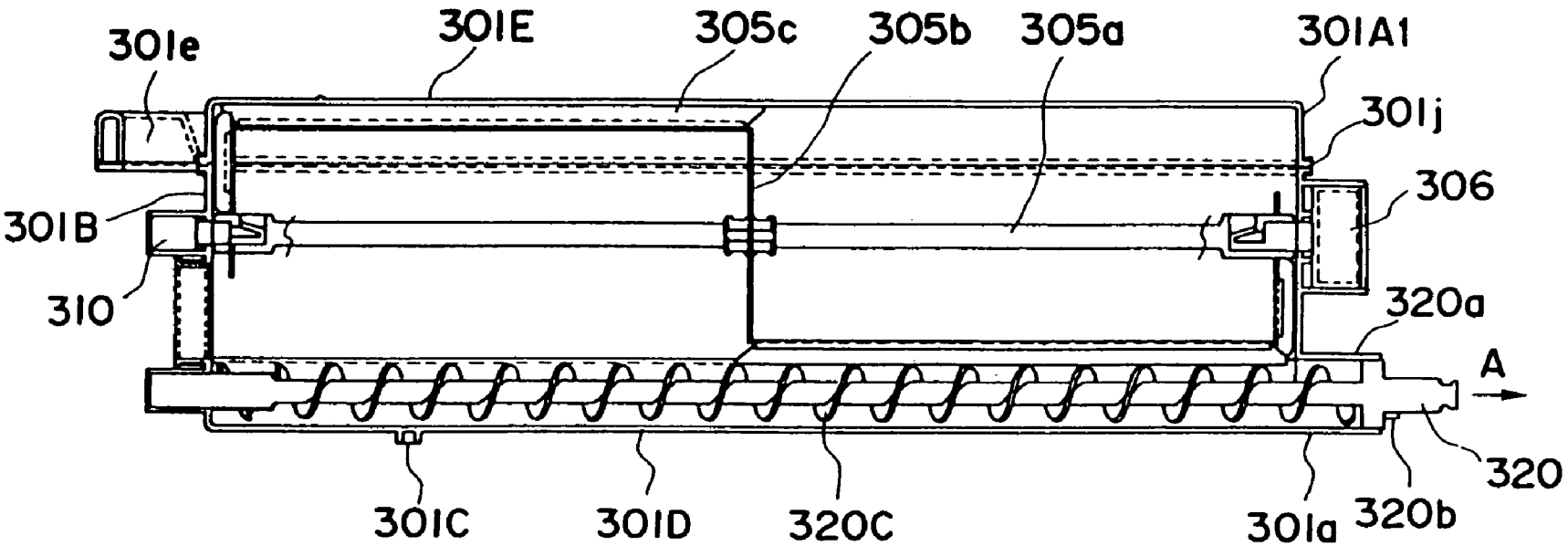
FIG. 39 shows an example wherein the sealing member and the feeding member are integrally formed.

In this embodiment, the sealing member 303 is movable in the axial direction relative to the feeding member 302, but the sealing member and the feeding member may be integral. In FIG. 39, the sealing member 320 includes the sealing portion 320*a*, the driving force receiving portion 320*b* and the sealing member 320. The sealing member 320 is movable in the direction A in FIG. 39.

The one end of the feeding member 302*b* is not necessarily projected outwardly from the toner supply port 320*a*.

Figure 40:
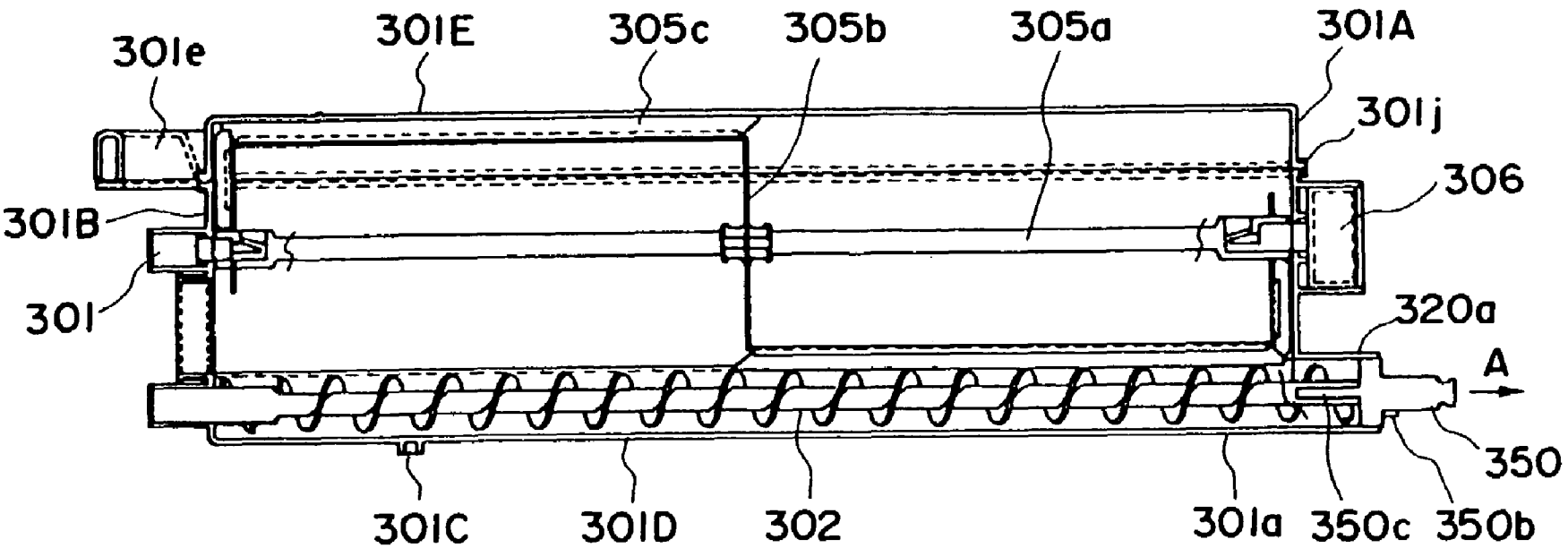
FIG. 40 shows a toner supply container according to a modification of the third embodiment.

For example, as shown in FIG. 40, the toner feeding member may receive the driving force from the main assembly 100 of the apparatus in the toner supply port 320*a* or in the toner accommodating portion 301*n*. In this case, the sealing member 350 receives the driving force from the main assembly 100 of the apparatus by a rib 350*b*. The driving force is transmitted to the toner feeding member 302 by the projection 350*c*.

The toner supply container as described above is summarized as follows:

A toner supply container detachably mountable to a main assembly of an electrophotographic image forming apparatus, comprising:

(a) a toner accommodating portion (e.g. 1*n*, 301*n*) for accommodating toner;

(b) a toner supply opening or port (e.g. 1*a*. 301*a*) for discharging toner accommodated in said toner accommodating portion;

(c) a toner feeding member (e.g. 2, 302) for feeding the toner accommodated in the toner accommodating portion toward the toner supply opening by rotation thereof, wherein a center of rotation of the toner feeding member is in an opening region of the toner supply port as seen in the longitudinal direction of the toner feeding member.

The toner supply port is projected outwardly from a lateral end surface (e.g. 1A1, 301A1) crossing with the longitudinal direction of the toner accommodating portion.

The center of rotation of the toner feeding member is substantially concentric with the center of the opening region of the toner supply port as seen in the longitudinal direction of the toner feeding member.

The toner supply port is substantially cylindrical having an outer diameter of 26 mm-29 mm.

The toner feeding member has a driving force receiving portion (e.g. 2*a*, 302*a*) adjacent a toner supply port in the longitudinal direction, wherein the driving force receiving portion, when the toner supply container is detachably mounted to the main assembly of the apparatus, receives a driving force from the main assembly of the apparatus, using the toner supply port.

The toner feeding member includes a shaft portion (e.g. 2A, 302A) and a helical feeding portion (e.g. 2B, 302B) extended along a longitudinal direction of the shaft portion, and the driving force receiving portion is extended from the shaft portion in its axial direction.

The driving force receiving portion is projected outwardly from the toner supply port.

At least one full-turn of the helical portion is in the toner supply port.

A section crossing with the longitudinal direction of the driving force receiving portion has a polygonal shape.

The toner accommodating portion includes a curved portion (e.g. 301F) having a decreasing width downwardly when it is detachably mounted to the main assembly of the apparatus in a cross-section in a direction crossing with the longitudinal direction, a linear portion (e.g. 301G) having a substantially constant width extended from a bottom portion of said curved portion and a substantially semicircle portion (301H) extended from a bottom portion of the linear portion, and toner feeding member is disposed in the linear portion and the semicircle portion.

The toner supply container supplies, into the main assembly of the apparatus from the toner supply port, the toner accommodated in the toner accommodating portion by the toner feeding member in accordance with consumption of the toner in the main assembly of the apparatus, when the toner supply container is detachably mounted to the main assembly of the apparatus.

As described in the foregoing, according to the embodiments of the present invention, there is provided a highly reliable toner supply container which can supply the toner into the main assembly of the apparatus while being kept in the main assembly of the electrophotographic image forming apparatus.

Furthermore, the present invention provides a toner supply container, the manufacturing cost of which is low.

The embodiments provide a toner supply container which can discharge the toner efficiently through the toner supply port.

Also, they provide an electrophotographic image forming apparatus to which such a toner supply container is detachably mountable.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container detachably mountable to an electrophotographic image forming apparatus, said container comprising:

a container body configured to contain toner, said container body being provided with a toner discharge opening;

a feeding member configured and positioned to feed the toner in said container body toward the toner discharge opening; and a coupling member engageable with coupling means provided in the image forming apparatus, wherein said coupling member has a rotational force receiving portion configured and positioned to receive a rotational force, a rotational force transmitting portion configured and positioned to transmit a rotational force received by said rotational force receiving portion to said feeding member, and an opening force receiving portion configured and positioned to receive an opening force for opening said toner supply container.

* * * * *

UNITED STATES PATENT AND TRADEMARK OFFICE

CERTIFICATE OF CORRECTION

PATENT NO. : 7,386,250 B2
APPLICATION NO. : 11/271788
DATED : June 10, 2008
INVENTOR(S) : Ban et al.

It is certified that error appears in the above-identified patent and that said Letters Patent is hereby corrected as shown below:

ON THE COVER PAGE:
At (30) Foreign Application Priority Data

"Jun. 19, 1997 (JP) ……....1997-163078
Jun. 16, 1998 (JP) ……....1998-168369" should read --Jun. 19, 1997 (JP) ……....9-163078
Jun. 16, 1998 (JP) ……....10-168369--.

COLUMN 3:
Line 59, "thereof" should read --thereof,--.

COLUMN 4:
Line 48, "shows" should be deleted.

COLUMN 5:
Line 17, "thereof" should read --thereof.--.

COLUMN 7:
Line 39, "s" should be deleted.

COLUMN 8:
Line 38, "2cis" should read --2c is--.

COLUMN 10:
Line 36, "described" should read --described.--.

COLUMN 25:
Line 15, "Nylon" should read --nylon--.

UNITED STATES PATENT AND TRADEMARK OFFICE

CERTIFICATE OF CORRECTION

PATENT NO. : 7,386,250 B2
APPLICATION NO. : 11/271788
DATED : June 10, 2008
INVENTOR(S) : Ban et al.

It is certified that error appears in the above-identified patent and that said Letters Patent is hereby corrected as shown below:

COLUMN 28:
Line 33, “tone” should read --toner--.

Signed and Sealed this

Tenth Day of February, 2009

JOHN DOLL
*Acting Director of the United States Patent and Trademark Office*